US008297259B2

(12) United States Patent
Kondo et al.

(10) Patent No.: US 8,297,259 B2
(45) Date of Patent: Oct. 30, 2012

(54) FUEL INJECTION VALVE AND FUEL INJECTION DEVICE

(75) Inventors: Jun Kondo, Nagoya (JP); Tooru Taguchi, Handa (JP); Fumiaki Arikawa, Okazaki (JP); Daiji Ueda, Oobu (JP); Akitoshi Yamanaka, Hekinan (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 185 days.

(21) Appl. No.: 12/741,140

(22) PCT Filed: Oct. 27, 2008

(86) PCT No.: PCT/JP2008/069420

§ 371 (c)(1),
(2), (4) Date: Aug. 24, 2010

(87) PCT Pub. No.: WO2009/057541

PCT Pub. Date: May 7, 2009

(65) Prior Publication Data

US 2010/0313850 A1 Dec. 16, 2010

(30) Foreign Application Priority Data

| | | |
|---|---|---|
| Nov. 2, 2007 | (JP) | 2007-286520 |
| Nov. 6, 2007 | (JP) | 2007-289073 |
| Feb. 19, 2008 | (JP) | 2008-037846 |
| Sep. 18, 2008 | (JP) | 2008-239745 |

(51) Int. Cl.
*F02M 51/00* (2006.01)
*F02M 51/06* (2006.01)

(52) U.S. Cl. ..... 123/494; 123/470

(58) Field of Classification Search ..... 123/470, 123/305, 456, 498, 390, 387, 379, 494, 490, 123/499; 239/102.2, 585.1; 73/114.43, 114.45, 73/114.51
See application file for complete search history.

(56) References Cited

U.S. PATENT DOCUMENTS 4,295,115 A * 10/1981 Takahashi et al. ..... 338/4
4,438,496 A 3/1984 Ohie
4,817,568 A * 4/1989 Bedford ..... 123/431
(Continued)

FOREIGN PATENT DOCUMENTS

DE 21 43 476 4/1972
(Continued)

OTHER PUBLICATIONS

Extended Supplemental European Search Report dated Feb. 17, 2011, issued in corresponding European Application No. 08844634.9-2311.

(Continued)

*Primary Examiner* — Mahmoud Gimie
(74) *Attorney, Agent, or Firm* — Nixon & Vanderhye PC

(57) ABSTRACT

It is equipped with an injector body 4*z* which has formed therein high-pressure paths 6*az*, 6*bz*, and 6*cz* through which high-pressure fuel flows to a spray hole and stores therein a piezo-actuator 2*z* (i.e., an opening/closing mechanism) and a back-pressure control mechanism 3*z* (i.e., an opening/closing mechanism) which open or close the spray hole, and a fuel pressure sensor 50*z* installed in the body 4*z* to measure the pressure of the high-pressure fuel. The body 4*z* has formed therein a branch path 6*ez* diverging from the high-pressure paths 6*bz* and 6*cz* to deliver the high-pressure fuel to the fuel pressure sensor 50*z*.

11 Claims, 24 Drawing Sheets

U.S. PATENT DOCUMENTS

| | | | | |
|---|---|---|---|---|
| 5,803,369 | A | 9/1998 | Toyao et al. | |
| 5,988,142 | A | 11/1999 | Klopfer | |
| 6,622,549 | B1 * | 9/2003 | Wlodarczyk et al. | 73/114.51 |
| 7,228,745 | B2 | 6/2007 | Kunda et al. | |
| 7,340,118 | B2 | 3/2008 | Wlodarczyk et al. | |
| 7,552,717 | B2 | 6/2009 | Dingle | |
| 2006/0053894 | A1 | 3/2006 | Kunda et al. | |
| 2006/0170909 | A1 | 8/2006 | Wlodarczyk et al. | |
| 2008/0228374 | A1 | 9/2008 | Ishizuka et al. | |
| 2009/0038589 | A1 | 2/2009 | Dingle | |
| 2009/0223487 | A1 | 9/2009 | Dingle | |

FOREIGN PATENT DOCUMENTS

| | | |
|---|---|---|
| DE | 10 2005 032 086 | 1/2007 |
| JP | S56-118553 | 9/1981 |
| JP | 57-005526 | 1/1982 |
| JP | 9-42106 | 2/1997 |
| JP | H10-169524 | 6/1998 |
| JP | 2000-241273 | 9/2000 |
| JP | 2000-265892 | 9/2000 |
| JP | 2000-275128 | 10/2000 |
| JP | 2001-512564 | 8/2001 |
| JP | 2001-324402 | 11/2001 |
| JP | 2002-013994 | 1/2002 |
| JP | 2002-013997 | 1/2002 |
| JP | P2002-048028 A | 2/2002 |
| JP | 2006-113041 | 4/2006 |
| JP | 2007-016678 | 1/2007 |
| JP | 2007-218249 | 8/2007 |
| JP | 2007-231770 | 9/2007 |
| JP | 2007-270822 | 10/2007 |
| JP | 2008-144749 | 6/2008 |
| WO | WO 99/32783 | 1/1999 |
| WO | WO 99/32783 | 7/1999 |
| WO | WO 2009/019663 | 2/2009 |

OTHER PUBLICATIONS

International Search Report for PCT/JP2008/069420, mailed Jan. 20, 2009.

International Preliminary Report on Patentability for PCT/JP2008/069420, dated Jun. 17, 2010, 6 pages.

Extended European Search Report dated Feb. 17, 2011, issued in corresponding European Application No. 08843364.4-2311.

Japanese Office Action issued in corresponding Japanese Application No. 2008-239745 with English translation, Apr. 24, 2012.

* cited by examiner (a)

(b)

FUEL INJECTION VALVE AND FUEL INJECTION DEVICE

This application is the U.S. National Phase of International Application No. PCT/JP2008/069420, filed 27 Oct. 2008, which designated the U.S. and claims priority to Japanese Application No. (s) 2007-286520, filed 2 Nov. 2007, 2007-289073, filed 6 Nov. 2007, 2008-037846, filed 19 Feb. 2008 and 2008-239745, filed 18 Sep. 2008, the entire contents of each of which are hereby incorporated by reference.

TECHNICAL FIELD

The present invention relates generally to a fuel injection valve which is installed in an internal combustion engine to spray fuel from a spray hole and a fuel injection device.

BACKGROUND ART

In order to ensure the accuracy in controlling output torque of internal combustion engines and the quantity of exhaust emissions therefrom, it is essential to control a fuel injection mode such as the quantity of fuel to be sprayed from a fuel injection valve or the injection timing at which the fuel injection valve starts to spray the fuel. Accordingly, there have been proposed techniques for monitoring a change in pressure of the fuel upon spraying thereof from the fuel injection valve to determine an actual fuel injection mode.

For example, the time when the pressure of the fuel begins to drop due to the spraying thereof is monitored to determine an actual injection timing. The amount of drop in pressure of the fuel arising from the spraying thereof may be measured to determine the quantity of fuel sprayed actually from the fuel injection valve. Such actual measurement of the fuel injection mode ensures the desired accuracy in controlling the fuel injection mode based on such a measured value.

A fuel pressure sensor (i.e., a rail pressure sensor) installed directly in a common rail (i.e., an accumulator vessel) to measure the above change in pressure of the fuel has a difficulty in measuring the pressure of the fuel accurately because the change in pressure of fuel arising from the spraying of the fuel is absorbed within the common rail. Accordingly, in the invention of Patent Document 1, the fuel pressure sensor is installed in a joint between the common rail and a high-pressure pipe through which the fuel, is delivered from the common rail to the fuel injection valve to measure the fuel pressure change before it is absorbed within the common rail.

Patent Document 1: Japanese Patent First Publication No. 2000-265892

DISCLOSURE OF THE INVENTION

Problems to be Solved by the Invention

The fuel pressure change, as produced at a spray hole by the fuel spraying, will, however, surely attenuates within the high-pressure pipe. The use of the pressure sensor, as disclosed in Patent Document 1, installed in the joint to the common rail, therefore, does not ensure the desired accuracy in determining the fuel pressure change. The inventors have studied the installation of the pressure sensor in the fuel injection valve which is located downstream of the high-pressure pipe. Such study, however, showed that the installation of the fuel pressure sensor in the fuel injection valve poses a problem, as discussed below.

The installation of the fuel pressure sensor in the fuel injection valve enables a change in pressure of the fuel arising from spraying thereof to be measured with high precision, but however, adverse effects of flow of the fuel on the measurement of the pressure of the fuel will not be ignored. In other words, the flow of fuel will result in deterioration of the measurement accuracy.

The invention was made in order to solve the above problem. It is an object of the invention to provide a fuel injection valve and a fuel injection device which are designed to decrease the adverse effects of the flow of fuel on a fuel pressure sensor to ensure the accuracy in measuring a change in pressure of the fuel arising from spraying thereof.

Means for Solving the Problem

Means for solving the problem, operations thereof, and effects, as provided thereby will be described below.

The invention, as recited in claim 1, a fuel injection valve which is to be installed in an internal combustion engine to spray fuel from a spray hole, characterized in that it comprises: a body in which a high-pressure path is formed through which high-pressure fuel flows to the spray hole and has disposed therein an opening/closing mechanism for opening or closing the spray hole; and a fuel pressure sensor installed in the body to measure pressure of the high-pressure fuel which is changed by spraying of the fuel from the spray hole, and in that a branch path is formed in the body which diverges from the high-pressure path to deliver the high-pressure fuel to the fuel pressure sensor.

The branch path diverging from the high-pressure path to deliver the high-pressure fuel to the fuel pressure sensor serves to almost eliminate the flow of fuel as compared with in the high-pressure path, so that the high-pressure fuel which hardly flows in the high-pressure path is sensed by the fuel pressure sensor, thus avoiding the deterioration of the measurement accuracy of the fuel pressure sensor caused by the flow of the fuel. This enables the fuel pressure sensor to be installed in the fuel injection valve without the deterioration of the measurement accuracy.

The invention, as recited in claim 2, is characterized in that the high-pressure path has a large-diameter portion in which a sectional area of the high-pressure path is expanded, and the branch path is bifurcated from the large-diameter portion. The large-diameter portion having a greater volume produces an effect of accumulation, which enables the pressure of fuel to be measured which is reduced in a pulsation thereof causing noise. Further, the use of the invention, as recited in claim 4, enables the use of the large-diameter portion for disposing a filter to trap a foreign object in the high-pressure fuel as a large-diameter portion for achieving the effect of the accumulation.

The diverging of the branch path from the high-pressure path will facilitate the ease with which the stress concentrates on an intersection (i.e., a branching portion) of the paths in the body, thus requiring the need for ensuring the strength of the body. In the invention, as recited in claim 3, made in view of the above, the high-pressure path has the large-diameter portion in which a sectional area of the high-pressure path is expanded. The branch path is bifurcated from a small-diameter portion of the high-pressure path other than the large-diameter portion. This enhances the strength of the body as compared with when the branch path is bifurcated from the large-diameter portion.

The invention, as recited in claim 5, is characterized in that the high-pressure path includes a first path extending in an axial direction of the body and a second path extending in a direction in which the second path intersects with the first path, and in that the branch path diverges from an intersection of the first and second paths and extends coaxially with either of the first path or the second path.

There is, as already described, a concern about the concentration of stress on intersections of a plurality of paths. The invention, as recited in claim 5, is such that in the case where the high-pressure path is so shaped as to have the intersection of the first and second paths, the branch path is bifurcated from the intersection and extends coaxially with either of the first path or the second path. This results in a decrease in the intersection on which the stress will concentrate as compared with the case where the branch path 60*ez* is, as indicated by the two-dot chain line 60*ez* in FIG. 2, bifurcated from a place other than the intersection.

The invention, as recited in claim 6, is characterized in that the branch path is so formed that an axial direction of the branch path extends perpendicular to that of the high-pressure path. The invention, as recited in claim 7, is characterized in that the branch path is so formed that an axial direction thereof is inclined radially of the high-pressure path.

In the case where the branch path 6*ez* is, as demonstrated in FIG. 4, so formed as to extend perpendicular to the high-pressure path 6*bz* (i.e., claim 6), the concentration of stress on the branching portions 4*az* and 4*bz* (i.e., intersections) is minimized in the body as compared with the case where the branch path 61*ez* is, as illustrated in FIG. 5, so formed as to be inclined to the high-pressure path 6*bz* (i.e., claim 7). Alternatively, in the case where the branch path 61*ez* is so formed as to incline to the high-pressure path 6*bz*, the degree of freedom of layout of the fuel pressure sensor will be improved.

Further, in order to decrease the concentration of stress at the branching portion 4*az* in the structure of FIG. 5, the invention, as recited in claim 8, is characterized in that an acute-angle one (e.g., the portion 4*az* in FIG. 5(*b*)) of portions of the body where the branch path intersects with the high-pressure path is chamfered in the form (indicated by, for example, 6*gz* in FIG. 5(*b*)).

If the branching portion 4*az* is formed to have the shape, as indicated by the dashed line 6*hz* in FIG. 5(*b*), without being chamfered, unlike the invention, as recited in claim 8, the body will have the sharp edge 4*az* having an acute angle which is sensitive to breakage due to the concentration of stress thereon. In contrast, the invention, as recited in claim 8, has the acute-angle portion 4*az* chamfered to have the shape 6*gz* to decrease the possibility of the breakage due to the concentration of stress thereon.

The invention, as recited in claim 9, is characterized in that it comprises: a fluid path to which high-pressure fluid is supplied externally; a spray hole which connects with the fluid path and sprays at least a portion of the high-pressure fluid; a branch path which connects with the fluid path at a turned angle of 90° or more to a flow of the fluid in the fluid path; a diaphragm which is made of a thin wall in the branch path and which strains and displaces when subjected to pressure of the high-pressure fluid which is changed by spraying of fuel from the spray hole; and displacement sensing means for converting a displacement of the diaphragm into an electric signal. The diaphragm made of the thin wall is located in the branch path diverging from the fluid path, thus facilitating the ease of forming the diaphragm as compared with when the diaphragm is formed directly on the outer wall of the injector near the fuel path. Upon and after the fuel injection, the amount of fuel corresponding to that having been sprayed or discharged from the pressure control chamber is supplied from the fluid path. The pressure in the fluid path is high, so that in the case where the branch path is oriented at an angle smaller than 90° toward the direction of flow of the fluid in the fluid path, in other words, the branch path is connected to the fluid path in the forward direction, it will cause the high-pressure to be always exerted into the branch path during the delivery of the fluid, thus resulting in a small difference in pressure of the fuel between when the fluid is being sprayed and when the fluid is not sprayed. However, the turned angle greater than or equal to 90° causes the movement of the high-pressure fluid in the fluid path during the supply of the fluid to create an attraction which is exerted on the high-pressure fluid loaded into the branch path and oriented toward a branch point between the branch path and the fluid path. This also causes an additional attraction to be added to a drop in pressure in the high-pressure fluid in the same direction as such a pressure drop, thus resulting in an increased difference in pressure of the fluid between when the fluid is being sprayed and when the fluid is not being sprayed.

It is, as recited in claim 10, preferable that the diaphragm is a thinnest walled portion of the branch path. This increases a displacement of the diaphragm resulting from a change in the pressure.

It is, as recited in claim 11, preferable that the displacement sensing means has a semiconductor pressure sensor affixed integrally with one of surfaces of the diaphragm which is farther from the branch path.

BRIEF DESCRIPTION OF THE DRAWINGS

FIG. 5(*b*) is an enlarged view of FIG. 5(*a*);

FIG. 9(*b*) is a plan view of FIG. 9(*a*);

FIG. 9(*c*) is a sectional view of a pressure sensing member according to the sixth embodiment;

FIG. 9(*d*) is a plan view of FIG. 9(*c*);

FIG. 9(*e*) is a sectional view of a modification of a pressure sensing member of FIG. 9(*c*);

FIG. 10(*b*) is an A-A sectional view of FIG. 10(*a*);

FIG. 13(*b*) is a B-B sectional view of FIG. 13(*a*);

FIG. 13(*c*) is a C-C sectional view of FIG. 13(*a*);

FIG. 16(*b*) is a schematic view showing a comparative example;

FIG. 20(*b*) is a plan view of FIG. 20(*a*);

FIG. 20(*c*) is a partial sectional view which shows highlights of a pressure sensing member of the ninth embodiment;

FIG. 20(*d*) is a plan view of FIG. 20(*c*);

FIG. 20(*e*) is a sectional view which shows a positional relation between a control piston and a pressure sensing member when being installed in an injector body;

FIG. 21(*b*) is a plan view of FIG. 21(*a*);

FIG. 21(*c*) is a partial sectional view which shows highlights of a pressure sensing member;

FIG. 21(*d*) is a plan view of FIG. 21(*c*);

FIG. 21(*e*) is a sectional view which shows a positional relation between a control piston and a pressure sensing member when being installed in an injector body;

FIG. 22(*b*) is a plan view of FIG. 22(*a*);

FIG. 22(*c*) is a sectional view which shows a positional relation between a control piston and a pressure sensing member when being installed in an injector body;

FIG. 22(*d*) is a sectional view which shows a modification f a pressure sensing member;

FIG. 23(*b*) is a plan view of FIG. 23(*a*);

FIG. 26(*b*) is a plan view of FIG. 26(*a*);

FIG. 26(*c*) is a partially sectional view which shows highlights of a pressure sensing member;

FIG. 26(*d*) is a plan view of FIG. 26(*c*);

FIG. 27(*b*) is a B-B sectional view of FIG. 27(*a*);

FIG. 27(*c*) is a C-C sectional view of FIG. 27(*a*);

FIG. 28(*b*) is a plan view of FIG. 28(*a*);

FIG. 28(*c*) is a partially sectional view which shows highlights of a pressure sensing member;

FIG. 28(*d*) is a plan view of FIG. 28(*c*);

FIG. 29(*b*) is a plan view of FIG. 29(*a*);

FIG. 29(*c*) is a sectional view of a modification of the orifice member of FIG. 29(*a*);

FIG. 30(*b*) is a plan view of FIG. 30(*a*).

EXPLANATION OF REFERENCE NUMBER

Figure 1:
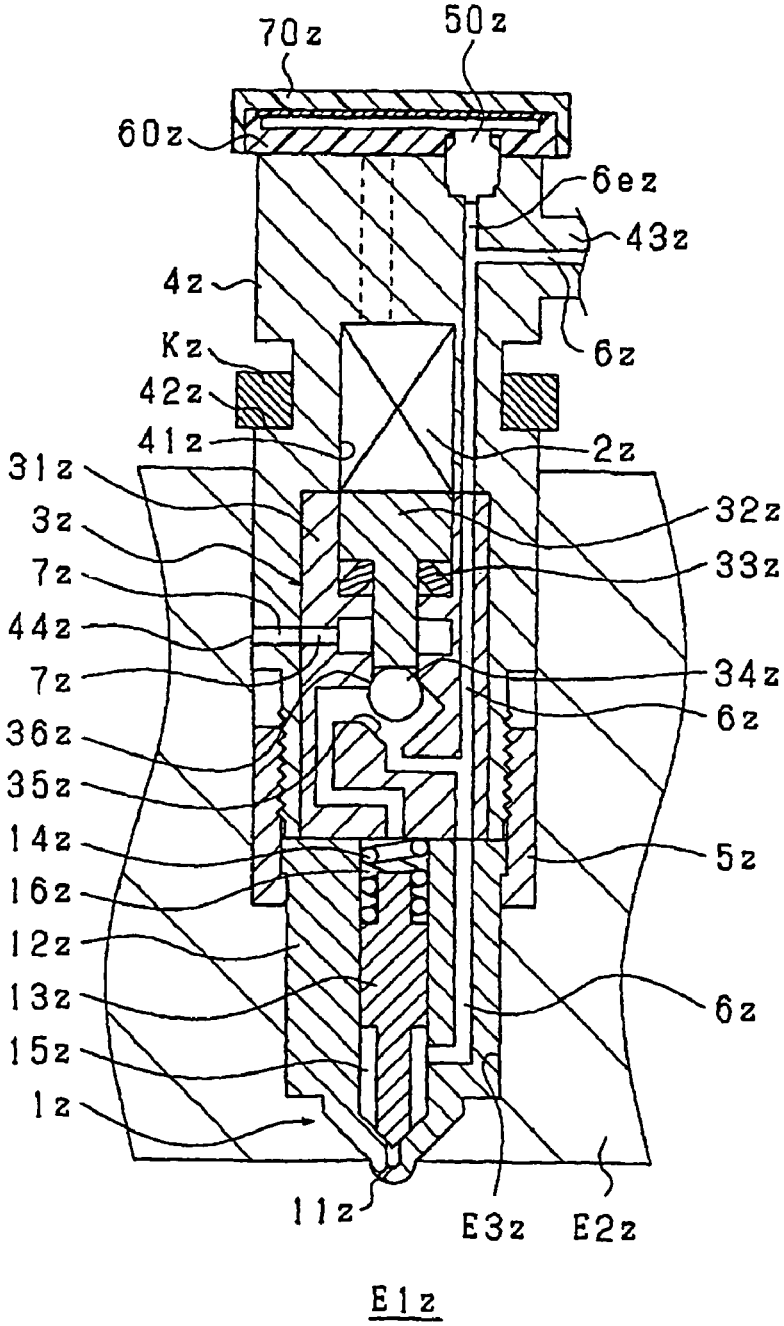
FIG. 1 is a schematic sectional view which shows an outline of internal structure of an injector according to the first embodiment of the invention.

2*z*—piezo-actuator (opening/closing mechanism)
3*z*—back pressure control mechanism (opening/closing mechanism)
4*z*—injector body
6*z*, 6*az*, 6*bz*, 6*cz*—high-pressure path
6*ez*, 60*ez*, 61*ez*—branch path
11*z*—spray hoe
50—fuel pressure sensor
11—lower body
11*b*—fuel supply path (first fluid path (high-pressure path))
11*c*—fuel induction path (second fluid path (high-pressure path))
11*d*—storage hole
11*f*—coupling (inlet)
11*g*—fuel supply branch path
12—nozzle body
12*a*—valve seat
12*b*—spray hole
12*c*—high-pressure chamber (fuel sump)
12*d*—fuel feeding path
12*e*—storage hole
13—bar filter
14—retaining nut (retainer)
16—orifice member
161—valve body-side end surface
162—plat surface
16*a*—communication path (outlet side orifice, outer orifice)
16*b*—communication path (inlet side orifice, inner orifice)
16*c*—communication path (pressure control chamber)
16*d*—valve seat
16*e*—fuel release path
16*g*—guide hole
16*h*—inlet
16*k*—gap
16*p*—through hole
16*r*—fuel leakage groove
17—valve body
17*a*, 17*b*—through hole
17*c*—valve chamber
17*d*—low-pressure path (communication path)
18*a*—groove (branch path)
18*b*—pressure sensing chamber
18*c*—communication path (pressure control chamber)
18*c*2—processing substrate
18*e*—electric wire
18*f*—pressure sensor
18*g*—lower body

18*h*—sensing portion communication path
18*k*—glass layer
18*m*—gauge
18*n*—diaphragm
18*p*—through hole
18*q*—other surface
18*r*—single-crystal semiconductor chip
18*s*—through hole
18*t*—positioning member
19*c*—wire, pad,
19*d*—oxide film
102—fuel tank
103—high-pressure fuel pump
104—common rail
105—high-pressure fuel path
106—low-pressure fuel path
107—electronic control device (ECU)
108—fuel pressure sensor
109—crank angle sensor
110—accelerator sensor
2—injector
20—nozzle needle
21—fluid induction portion
22—injector
30—control piston
30*c*—needle
30*p*—outer end wall
31—annular member
32—injector
35—spring
37—fuel path
301—nozzle
302—piezo-actuator (actuator)
303—back pressure control mechanism
308—holding member
321—housing
322—piezoelectric device
323—lead wire
331—valve body
335—high-pressure seat surface
336—low-pressure seat surface
341, 341*a* to 341*c*—storage hole
41—valve member
41*a*—spherical portion
42—valve armature
50—connector
51*a*, 51*b*—terminal pin
52—upper body
53—upper housing
54—intermediate housing
59—urging member (spring)
61—coil
62—spool
63—stationary core
64—stopper
7—solenoid valve device
8—back pressure chamber (pressure control chamber)
80, 85, 87—pressure sensing portion
81, 86—pressure sensing member (fuel pressure sensor)
82—plate surface
92—positioning member

BEST MODE FOR CARRYING OUT THE INVENTION

Each embodiment embodying the invention will be described below based on drawings. In the following embodiments, the same reference numbers are appended to the same or like parts in the drawings.

First Embodiment

Figure 2:
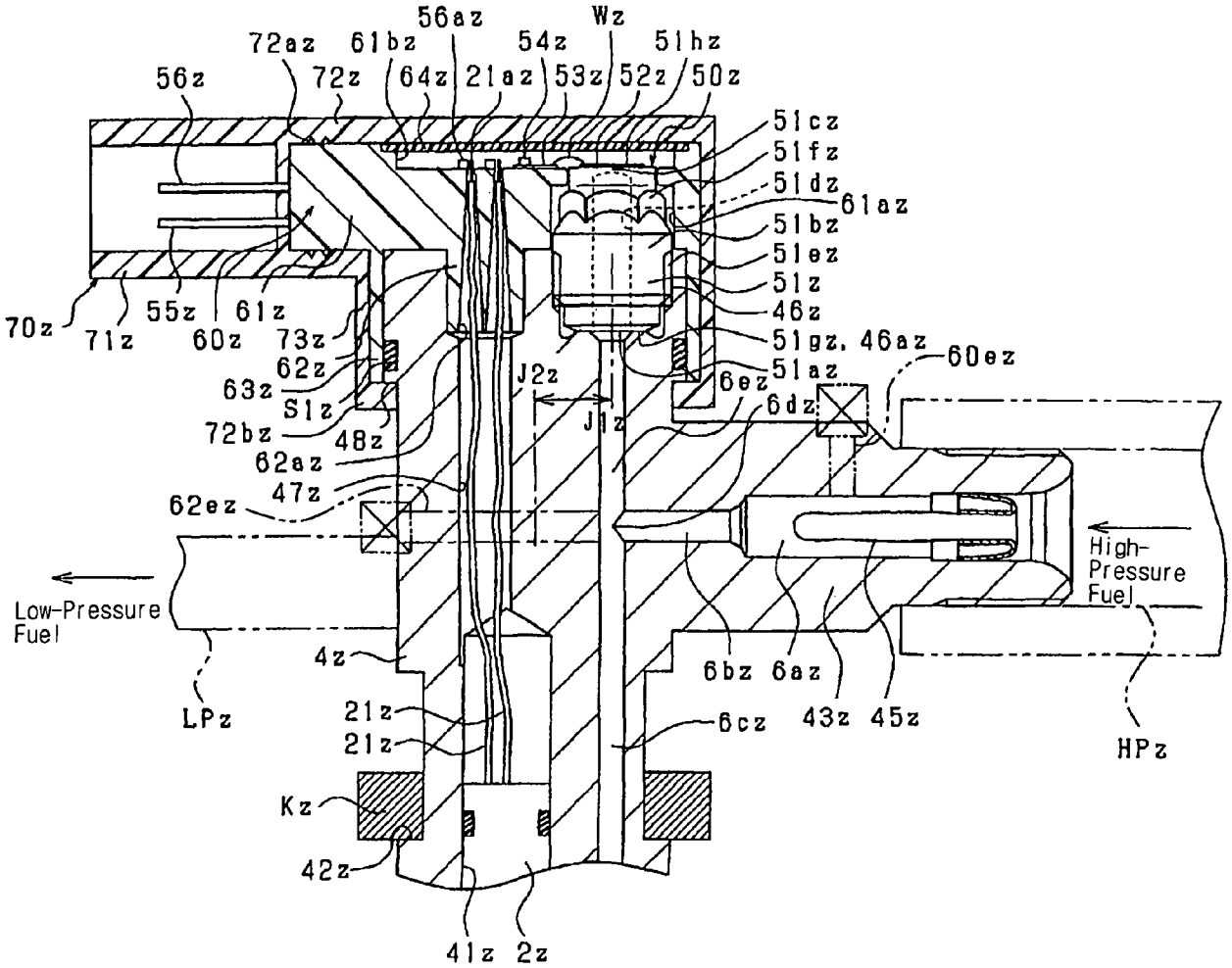
FIG. 2 is an enlarged view to explain FIG. 1 in detail as to the structure of a fuel pressure sensor and installation of the fuel pressure sensor in an injector body.

The first embodiment of the invention will be described using FIGS. 1 and 2. FIG. 1 is a schematic sectional view which shows an outline of inner structure of an injector (i.e., a fuel injection valve) according to this embodiment FIG. 2 is an enlarged view for explaining FIG. 1 in detail.

First, a basic structure and operation of the injector will be described based on FIG. 1. The injector is to spray high-pressure fuel, as stored in a common rail (not shown), into a combustion chamber E1*z* formed in a cylinder of an internal combustion diesel engine and includes a nozzle 1*z* for spraying the fuel when the valve is opened, a piezo actuator 2*z* (opening/closing mechanism) which expands or contracts when charged or discharged electrically, and a back pressure control mechanism 3*z* (opening/closing mechanism) which is driven by the piezo actuator 2*z* to control the back pressure acting on the nozzle 1*z*.

The nozzle 1*z* is made up of a nozzle body 12*z* in which spray holes 11*z* are formed, a needle 13*z* which is placed on or moved away from a valve seat of the nozzle body 12 to open or close the spray hole 11*z*, and a spring 14*z* urging the needle 13*z* in a valve-closing direction.

The piezo actuator 2*z* is made of a stack of piezoelectric devices (i.e., a piezo stack). The piezoelectric devices are capacitive loads which selectively expand or contact through the piezoelectric effect. Specifically, the piezo stack functions as an actuator to move the needle 13*z*.

Within a valve body 31*z* of the back pressure control mechanism 3*z*, a piston 32*z* which is to be moved following the contraction and expansion of the piezo actuator 2*z*, a disc spring 33*z* urging the piston 32*z* toward the piezo actuator 2; and a spherical valve body 34*z* to be driven by the piston 32*z* are disposed. In FIG. 1, the valve body 31*z* is illustrated as being made of a single member, but actually formed by a plurality of blocks.

The cylindrical injector body 4*z* has formed therein a stepped cylindrical storage hole 41*z* extending substantially in an injector axial direction (i.e., a vertical direction, as viewed in FIG. 1) at the radial center thereof. Within the storage hole 41; the piezo actuator 2*z* and the back pressure control mechanism 3*z* are disposed. A cylindrical retainer 5*z* is threadably fitted to the injector body 4*z* to secure the nozzle 1*z* to the end of the injector body 4*z*.

The nozzle body 12*z*, the injector body 4*z*, the valve body 31*z* have formed therein high-pressure fuel paths 6*z* (corresponding to fluid paths) into which the fuel is delivered at a high pressure from the common rail at all times. The injector body 4*z* and the valve body 31*z* have formed therein a low-pressure fuel path 7*z* leading to the fuel tank (not shown). The bodies 12*z*, 4*z*, and 31*z* are made of metal and inserted into and disposed in an insertion hole E3*z* formed in a cylinder head E2*z* of the engine. The injector body 4*z* has an engaging portion 42*z* (press surface) which engages an end of a clamp Kz. The other end of the clamp Kz is fastened to the cylinder head E2*z* to press the engaging portion 42*z* into the insertion hole E3*z* at the end of the clamp Kz, thereby securing the injector in the insertion hole E3*z* while being pressed.

A high-pressure chamber 15*z* is formed between an outer peripheral surface of a spray hole 11*z* side of the needle 13*z* and an inner peripheral surface of the nozzle body 12*z*. When the needle 13*z* is moved in a valve-opening direction, the high-pressure chamber 15*z* communicates with the spray holes 11*z*. The high-pressure chamber 15*z* is supplied with the high-pressure fuel at all the time through the high-pressure fuel path 6. A back-pressure chamber 16*z* is formed on a spray hole-far side of the needle 13*z*. The spring 14*z* is disposed within the back-pressure chamber 16*z*.

The valve body 31*z* has a high-pressure seat 35*z* formed in a path communicating between the high-pressure path 6*z* in the valve body 31*z* and the back pressure chamber 16*z*. The valve body 31*z* has a low-pressure seat 362 formed in a path communicating between the low-pressure fuel path 7*z* in the valve body 31*z* and the back-pressure chamber 16*z* in the nozzle 1*z*. The above described valve body 34*z* is disposed between the high-pressure seat 35*z* and the low-pressure seat 36*z*.

The injector body 4*z*, as illustrated in FIG. 2, has a high-pressure port 43*z* (a high-pressure joint) connecting with the high-pressure pipe HPz and a low-pressure port 44*z* (a leakage pipe joint) connecting with a low-pressure pipe LPz (a leakage pipe). The low-pressure port 44*z*, as illustrated in FIG. 1, may be disposed on a spray hole side of the clamp Kz or alternatively, as illustrated in FIG. Kz, be disposed a spray hole-far side of the clamp Kz. Similarly, the high-pressure port 43*z* may be disposed on either of the spray hole side or the spray hole-far side of the clamp Kz.

In this embodiment, the fuel, as is delivered from the common rail to the high-pressure port 43*z* through the high-pressure pipe HPz, is supplied from an outer peripheral side of the cylindrical injector body 4*z*. The fuel supplied to the injector passes through portions 6*az* and 6*bz* (see FIG. 2) in the high-pressure port 43*z* of the high-pressure path 6*z* which extends perpendicular to the injector axial direction (i.e., a vertical direction in FIG. 1), enters a portion 6*cz* (see FIG. 2) extending in the injector axial direction (i.e., the vertical direction in FIG. 1), and then flows into the high-pressure chamber 15*z* and the back pressure chamber 16*z*.

The high-pressure path 6*cz* (i.e., a first path) and the high-pressure path 6*bz* (i.e., a second path) intersect perpendicular to each other in the form of an elbow. From the intersection 6*dz*, a branch path 6*ez* extends in the spray hole-opposite direction of the injector body 4*z* coaxially with the high-pressure path 6*cz*. The branch path 6*ez* works to deliver the fuel within the high-pressure paths 6*bz* and 6*cz* to the fuel pressure sensor 50*z*, as will be described later.

In the high-pressure paths 6*az* and 6*bz* within the high-pressure port 43, the large-diameter portion 6*az* which is greater in diameter than the small-diameter portion 6*bz*. In the large-diameter portion 6*az*, the filter 45*z* (see FIG. 2) is disposed to trap foreign objects contained in the high-pressure fuel.

In the above arrangements, when the piezo actuator 2*z* is contracted, it will cause the valve body 34*z*, as illustrated in FIG. 1, to be placed in contact with the low-pressure seat 36*z* to establish communication of the back pressure chamber 16*z* with the high-pressure path 6*z*, so that the high-pressure fuel flows into the back pressure chamber 16*z*. The needle 13*z* is urged in the valve-closing direction by the fuel pressure of the back pressure chamber 16*z* and the spring 14*z* to close the spray holes 11*z*

Alternatively, when the piezoelectric actuator 2*z* is charged so that it expands, the valve body 34*z* is pushed into abutment with the high-pressure seat 35*z* to establish the fluid communication between the back-pressure chamber 16*z* and the low-pressure fuel path 7*z*, so that the pressure in the back-pressure chamber 16*z* drops, thereby causing the needle 13*z* to be urged by the pressure of fuel in the high-pressure chamber 15*z* in the valve-opening direction to open the spray holes 11*z* to spray the fuel into the combustion chamber E1*z* of the engine.

The spraying of the fuel from the spray holes 11*z* will result in a variation in pressure of the high-pressure fuel in the high-pressure path 6*z*. The fuel pressure sensor 50*z* (corresponding to a diaphragm portion and a displacement sensing means) working to monitor such a fuel variation are installed in the injector body 4*z*. The time when the fuel has started to be sprayed actually may be found by sampling the time when the pressure of fuel has started to drop following the start of injection of fuel from the spray holes 11*z* from the waveform of a variation in pressure as measured by the pressure sensor 50*z*. The time when the fuel has stopped from being sprayed actually may be found by sampling the time when the pressure of fuel has started to rise following the termination of the fuel injection. In addition to the injection start time and the injection termination time, the quantity of fuel having been sprayed may be found by sampling the amount by which the fuel has dropped actually which arises from the spraying of the fuel.

The structure of the fuel pressure sensor 50*z* and installation of the fuel pressure sensor 50*z* in the injector body 4*z* will be described using FIG. 2.

The fuel pressure sensor 50*z* is equipped with a stem 51*z* (an elastic body) which is sensitive to the pressure of high-pressure fuel in the branch path 6*ez* to deform elastically and a strain gauge 52*z* (corresponding to a sensing device or a displacement sensing means) working to convert the degree of deformation of the stem 51*z* into an electric signal and output it as a measured-pressure value. The material of the metallic stem 51*z* is required to have a mechanical strength great enough to withstand a ultrahigh pressure and to hardly undergo thermal expansion (i.e., a low coefficient of thermal expansion) to keep adverse effects on the strain gauge 52*z* low. Specifically, the stern 51*z* may be made by selecting material containing main components of Fe, Ni, and Co or Fe and Ni and additional components of Ti, Nb, and Al or Ti and NU as precipitation reinforcing material and pressing, cutting, or cold forging it.

The stem 51*z* includes a cylindrical portion 61*bz* and a disc-shaped diaphragm 51*cz* (corresponding to a thin-wall portion). The cylindrical portion 51*bz* has formed in an end thereof a inlet port 51*az* into which the high-pressure fuel is introduced. The diaphragm 51*cz* closes the other end of the cylindrical portion 51*bz*. The pressure of the high-pressure fuel entering the cylindrical portion 51*bz* at the inlet port 51*az*; is exerted on the diaphragm 51*cz* and an inner wall of the cylindrical portion 51*bz*, so that the stern 51*z* is deformed elastically as a whole.

The cylindrical portion 51*bz* and the diaphragm 51*cz* are axial-symmetrical with respect to an axial line J1*z*, as indicated by a dashed line in FIG. 2, so that the diaphragm 51*cz* will deform axisymmetrically when subjected to the high-pressure fuel. The axial line J1*z* of the stem 51*z* is parallel to the axial line j2*z* of the injector body 4*z*. The fuel pressure sensor 50*z* is offset-disposed, so that the axial line J1*z* of the stem 51*z* is offset from the axial line j2*z* of the injector body 4*z*.

The end surface of the cylindrical injector body 4*z* on the spray hole-far side thereof has formed therein a recess 46*z* into which the cylindrical portion 51*bz* of the stem 51*z* is inserted. The recess 46*z* has an internal thread formed in an inner peripheral surface thereof. The cylindrical portion 51*bz* has an external thread 51*ez* formed on an outer peripheral surface thereof. After the stem 51*z* is inserted into the recess 46*z* from outside the axial line J2*z* of the injector body 4*z*, a chamfered portion 51*fz* formed on the outer peripheral surface of the cylindrical portion 51*bz* is fastened by a tool to establish engagement of the external thread 51*bz* with the internal thread of the recess 46*z*.

A sealing surface 46*az* is formed on the bottom surface of the recess 46*z* which extends in the form of an annular shape so as to surround the inlet port 51*az*. On one end (i.e., the diaphragm-far side) of the cylindrical portion 51*bz*, an annular sealing surface 51*gz* is formed which is to be placed in close abutment with the sealing surface 46*az*. The sealing surface 51*gz* of the cylindrical portion 51*bz* is, therefore, pressed against the sealing surface 46*az* of the recess 46*z* by fastening force produced by threadable engagement of the external thread 51*ez* of the cylindrical portion 51*bz* with the internal thread of the recess 46*z*. This creates metal-to-metal tough sealing between the injector body 4*z* and the stem 51*z* at the sealing surfaces 46*az* and 51*gz*. The metal-to-metal tough sealing avoids the leakage of the high-pressure fuel in the branch path 6*ez* outside the injector body 4*z* through a surface of contact between the injector body 4*z* and the stem 51*z*. The sealing surfaces 46*az* and 51*gz* are so shaped as to expand vertically to the axial line J1*z* and have a flat sealing structure.

The strain gauge 52*z* is affixed to a mount surface 51*hz* of the diaphragm 51*cz* (i.e., a surface opposite the inlet port 51*az*) through an insulating film (not shown). When the pressure of the high-pressure fuel enters the cylindrical portion 51*bz*, so that the stem 51*z* elastically expands, the diaphragm 51*cz* will deform. This causes the strain gauge 52*z* to produce an electrical output as a function of the amount of deformation of the diaphragm 51*cz*. The diaphragm 51*cz* and a portion of the cylindrical portion 51*bz* are located outside the recess 46*z*. The diaphragm 51*cz* is so shaped as to expand vertically to the axial line J1*z*.

An insulating substrate 53*z* is placed in flush with the mount surface 51*hz*. On the insulating substrate 53*z*, circuit component parts 54*z* constituting a voltage applying circuit and an amplifier are mounted. These circuits are joined to the strain gauge 52*z* by wire bonds Wz. The strain gauge 52*z* to which the voltage is applied to the voltage applying circuit constitutes a bridge circuit along with other resistance devices (not shown) and a resistance value which varies as a function of the degree of strain of the diaphragm 51*cz*. This causes an output voltage of the bridge circuit to change as a function of the strain of the diaphragm 51*cz*. The output voltage is outputted to the amplifier as the measured pressure value of the high-pressure fuel. The amplifier amplifies the measured pressure value, as outputted from the stain gauge 52*z* (i.e., the bridge circuit) and output the amplified signal to the sensor terminal 55*z*.

The drive terminals 56*z* are terminals which are joined to positive and negative lead wires 21*z* (i.e., drive lines) connecting with the piezo actuator 2*z* and supply the electric power to the piezo actuator 2*z*. The drive electric power for the piezo actuator 2*z* is at a high voltage (e.g., 160V to 170V) and is on or off each time the piezo actuator 2*z* is charged or discharged.

The sensor terminals 55*z* and the drive terminals 56*z* are disposed integrally in a molded resin 60*z*. The molded resin 60*z* is made up of a body 61*z*, a boss 62*z*, and a cylindrical portion 63*z*. The body 61*z* is placed on the spray hole-far side of the substantially cylindrical injector body 4*z*. The boss 62*z* extends from the body 61*z* to the spray hole side. The cylindrical portion 63*z* extends from the body 61 toward the spray hole side.

The body 61*z* has formed therein a through hole 61*az* within which the fuel pressure sensor 50*z* is disposed. The mount surface 51*hz* of the diaphragm 51*cz* is exposed on the spray hole-far side of the body 61*z*. The insulating substrate 53*z* is affixed to the surface of the body 61*z* which is on the spray hole-far side, so that the mount surface 51*hz* lies in the same plane as the insulating substrate 53*z*. The strain gauge 52*z* on the mount surface 51*hz*, the circuit component parts 54*z*, and the insulating substrate 53*z* are disposed within a recess 61*bz* formed on the spray hole-far side of the body 61*z*. The recess 61*bz* is closed by a resinous cover 64*z*.

The boss 62*z* is inserted into in a lead wire hole 47*z* for the lead wires 21*z* is formed in the injector body 4*z*, thereby positioning the molded resin 60*z* radially of the injector body 4*z*. The boss 62*z* has formed therein a through hole 62*az* which extends substantially parallel to the axial line J2*z*. The lead wires 21*z* are inserted into and disposed in the through hole 62*az*. The ends of the lead wires 21*z* and ends 56*az* of the drive terminals 56 are exposed to the spray hole-far side of the body 61*z* and are welded electrically to each other.

The cylindrical portion 63*z* is so shaped as to extend along the outer periphery of the injector body 4*z*. An O-ring (i.e., a sealing member) S1*z* is fit in between the circumference of the injector body 4*z* and the inner peripheral surface of the cylindrical portion 63*z* to establish a hermetical seal therebetween, which avoids the intrusion of water from outside the injector body 4*z* to the strain gauge 52*z* and the lead wires 21*z* through a contact between the injector body 4*z* and the molded resin 60*z*. When adhered to the lead wires 21*z*, drops of water may flow along the lead wires 21*z* to wet the drive terminals 56*z* and the circuit component parts 54*z* undesirably.

The sensor terminals 55*z* and the drive terminals 56*z* which are unified by the molded resin 60*z* are disposed within a resinous connector housing 70*z*. Specifically, the sensor terminals 55*z*, the drive terminals 56*z*, and the connector housing 70*z* constitute a single connector. The connector housing 70*z* includes a connector connecting portion 71*z* for establishing a connector-connection with external lead wires, a body 72*z* in which the molded resin 60*z* is retained, and a cylindrical portion 73*z* which extends from the body 72*z* to the spray hole side.

The body 72*z* and the cylindrical portion 73*z* are contoured to conform with the contours of the body 61*z*, the cover 64*z*, and the cylindrical portion 63*z* of the molded resin 60*z*. The connector housing 70*z* and the molded resin 60*z* are joined together using welding techniques. Specifically, the body 72*z* has annular welding portions 72*az* which avoids the intrusion of water from outside the injector body 4*z* through a contact between the inner peripheral surface of the cylindrical portion 73*z* of the connector housing 70*z* and the outer peripheral surface of the cylindrical portion 73*z* of the molded resin 60*z* into the sensor terminals 55*z* and the drive terminals 56*z* exposed inside the connector connecting portion 71*z*.

The cylindrical portion 73*z* has an engaging portion 72*bz* formed on a spray hole side end thereof. The engaging portion 72*bz* engages an engaging portion 48*z* formed on the injector body 4*z*, thereby securing the orientation of the connector housing 70*z* and the molded resin 60*z* to the axial line J1*z* with respect to the injector body 4*z*.

Next, a sequence of steps of installing the fuel pressure sensor 50*z* and the connector housing 70*z* in and on the injector body 4*z* will be described below in brief.

First, the piezo-actuator 2*z* and the fuel pressure sensor 50*z* are installed in the storage hole 41*z* and the recess 46*z* of the injector body 4*z*, respectively. The installation of the fuel pressure sensor 50*z* is, as already described above, achieved by inserting the fuel pressure sensor 50*z* into the recess 46*z* from outside the axial line J2*z*, and turning the chamfered surface 51*fz* using the tool to establish the metal-touch-seal between the injector body 4*z* and the stem 51*z* at the sealing surface 46*az* and 51*gz*. The sensor terminals 55*z* and the drive terminals 56*z* are united by the molded resin 60*z*. The insulating substrate 53*z* on which the circuit component parts 54*z* are fabricated is mounted on the molded resin 60*z*.

Next, the molded resin 60*z* in and on which the sensor output terminals 55*z*, the drive terminals 56*z*, and the insulating substrate 53*z* are mounted is fitted in the injector body 4*z* in which the piezo-actuator 2*z* and the fuel pressure sensor 50*z* are already installed. Specifically, the boss 62*z* of the molded resin 60*z* is fitted into the lead wire hole 47*z*. Simultaneously, the lead wires 21*z* are inserted into the through hole 62*az* and the insertion holes 82*az*. The fuel pressure sensor 50*z* is fitted into the through hole 61 az of the body 61*z* so that the mount surface 51*hz* lies flush with the insulating substrate 53*z*.

Subsequently, the strain gauge 52*z* placed on the mount surface 51*hz* is joined electrically to lands not shown on the insulating substrate 53*z* through the wire bonds Wz using a wire-bonding machine. The ends 21*az* of the lead wires 21*z* exposed inside the recess 61*bz* are welded to the ends 56*az* of the drive terminals 56*z*.

The cover 54*z* is welded or glued to the recess 61*bz* of the molded resin 60*z* to hermetically cover the strain gauge 52*z*, the circuit component parts 54*z*, and the insulating substrate 53*z* within the recess 61*bz*. Subsequently, the connector housing 70*z* is installed in the molded resin 60*z*. Specifically, the sensor terminals 55*z* and the drive terminals 56*z* which are disposed integrally in the molded resin 60*z* are placed inside the connector connecting portion 71*z*. Simultaneously, the body 61*z* of the molded resin 60*z* is placed inside the body 72*z* of the connector housing 70*z*. The engaging portion 72*bz* of the connector housing 70*z* is placed in engagement with the engaging portion 48*z* of the injector body 4*z*.

The above steps complete the installation of the fuel pressure sensor 50*z* and the connector housing 70*z* in and on the injector body 4*z*. In this complete assembly, the molded resin 60*z* is located between the injector body 4*z* and the circuit component parts 54*z* and also between the stem 51*z* and the circuit component parts 54*z*. In use, the injector is disposed in the insertion hole E3*z* of the cylinder head E2*z*, so that it is exposed to a high-temperature of, for example, 140° C., which leads to a concern about the thermal breakage of the circuit component parts 54*z*.

In contrast to this the circuit component parts 54*z* and the insulating substrate 53*z* of this embodiment are disposed adjacent the molded resin 60*z* without direct contact with the metallic injector body 4*z* and the metallic stem 51*z*. Specifically, the molded resin 60*z* works as a thermal shield to the circuit component parts 54*z* thermally from the metallic injector body 4*z* and the stem 51*z*, thereby eliminating the concern about the thermal breakage of the circuit component parts 54*z*.

The above described embodiment offers the following advantages.

1) The formation of the branch path 6*ez* which diverges from the high-pressure paths 6*bz* and 6*cz* to deliver the high-pressure fuel to the fuel pressure sensor 50*z* almost eliminates a flow of fuel in the branch path 6*ez* as compared with the high-pressure paths 6*bz* and 6*cz*. The pressure sensor 50*z* measures the high-pressure fuel in the branch path 6*ez* in which the flow of fuel is hardly created, thus avoiding a decrease in measurement accuracy of the fuel pressure sensor 50*z* arising from the flow of the fuel.

2) The diverging of the branch path 6*ez* from the high-pressure path 6*z* will facilitate the ease with which the stress concentrates on an intersection (i.e., a branching portion) between the paths 6*z* and 6*ez* in the body 4*z*, thus requiring the need for ensuring the strength of the body 4*z*. In this embodiment, the branch path 6*ez* diverges from the intersection 6*dz* at which the two high-pressure paths 6*cz* and 6*bz* intersect with each other. The branch path 6*ez* is formed so as to extend coaxially with the high-pressure path 6*cz*. This results in a decrease in number of intersections at which the stress will appear.

3) The installation of the fuel pressure sensor 50*z* working to measure the pressure of the high-pressure fuel in the injector body 4*z* is achieved by making the fuel pressure sensor 50*z* of the stain gauge 52*z* and the stem 51*z* and attaching the strain gauge 52*z* to the stem 51*z* installed in the injector body 4*z*. The stem 51*z* is made independently from the injector body 4*z*, thus permitting a loss of propagation of inner stress in the injector body 4*z* resulting from thermal expansion/contraction to the stem 51*z* to be increased. Specifically, the stem 51*z* is made to be separate from the injector body 4*z*, thus reducing the adverse effects of the distortion of the injector body 4*z* on the stem 51*z* on which the strain gauge 52*z* is disposed as compared with when the strain gauge 52*z* is attached directly to the injector body 4*z*. This results in improved accuracy of the fuel pressure sensor 50*z* in measuring the pressure of fuel and enables the installation of the fuel pressure sensor 50*z* in the injector.

4) The stem 51*zs* made of material whose coefficient of thermal expansion is low, thereby resulting in a decrease in thermal distortion of the stem 51*z*. Only the stem 51*z* may be made by the material whose coefficient or thermal expansion is low, thus resulting in a decrease in material cost as compared with the whole of the body 4*z* is made of material whose coefficient in thermal expansion is low.

5) The stem 51*z* is axisymmetrical in configuration thereof, thus resulting in axisymmetrical deformation thereof when the diaphragm 51*cz* is subjected to the pressure of the fuel, thus causing the diaphragm 51*cz* to deform elastically as a function of the pressure of the fuel exerted thereon accurately. This ensures the accuracy in determining the pressure of the fuel.

6) The diaphragm 51*cz* is located outside the recess 46*z* of the injector body 4*z*, so that it will be insensitive to the thermal distortion of the injector body 4*z*. This minimizes effects of the distortion of the body 4*z* to which the strain gauge 52*z* is subjected, thus improving the accuracy in measuring the pressure of fuel through the fuel pressure sensor 50*z*.

7) The mount surface 51*hz* on which the strain gauge 52*z* is mounted is placed flush with the insulating substrate 53*z* on which the circuit component parts 54*z* are fabricated, thus facilitating ease of bonding the strain gauge 52*z* electrically to the circuit component parts 54*z* through the wire bonds Wz using the wire bonding machine.

8) The sealing surface 51*gz* of the stem 51*z* is pressed against the sealing surface 46*az* of the body 4*z* by a fastening force as produced by engaging the external thread 51*ez* of the stem 51*z* with the internal thread of the body 4*z*, thereby creating the metal-touch-seal between the stem 51*z* and the injector body 4*z* at the sealing surfaces 46*az* and 51*gz*, thus facilitating ease of sealing the clearance between the body 4*z* and the stem 51*z* against the high-pressure fuel.

9) External force is exerted by the clamp Kz, the high-pressure pipe HPz, and the low-pressure pipe LPz on the body 4*z*. Specifically, the force (i.e., the external force) is exerted by the clamp Kz on the body 4z, which presses body 42z against the insertion hole E3z of the cylinder head E2z. Additionally, when the high-pressure pipe HPz and the low-pressure path LPz are shifted from correct positions and joined to the high-pressure port 43z and the low-pressure port 44z, the force (i.e., external force) will be exerted by the pipes HPz and LPz to return the ports 43z and 44z back to the correct positions. The exertion of the external force on the body 4z from the external members Kz, HPz, and LPz results in an increase in internal stress on the body 4z between a portion of the body 4z which is retained by the cylinder head E2z and portions 42z, 43z, and 44z of the body 4z. This leads to a concern about the decrease in accuracy of the fuel pressure sensor 50z in measuring the pressure of fuel.

In contrast to the above problem, in this embodiment, the location where the fuel pressure sensor 50z is installed in the body 4z is far from the cylinder head E2z across the high-pressure port 43z, the low-pressure port 44z, and the engaging portion 42z of the body 4z. The fuel pressure sensor 50z is located away from a portion of the body 4z where the internal stress will be increased (i.e., a portion of the body 4z between a portion of the body 4z retained in the cylinder head E2z and the external force-exerted portions 42z, 43z, and 44z of the body 4z). This minimizes the effects of the internal stress appearing in the body 4z on the fuel pressure sensor 50z and improves the measurement accuracy of the fuel pressure sensor 50z.

Second Embodiment

Figure 3:
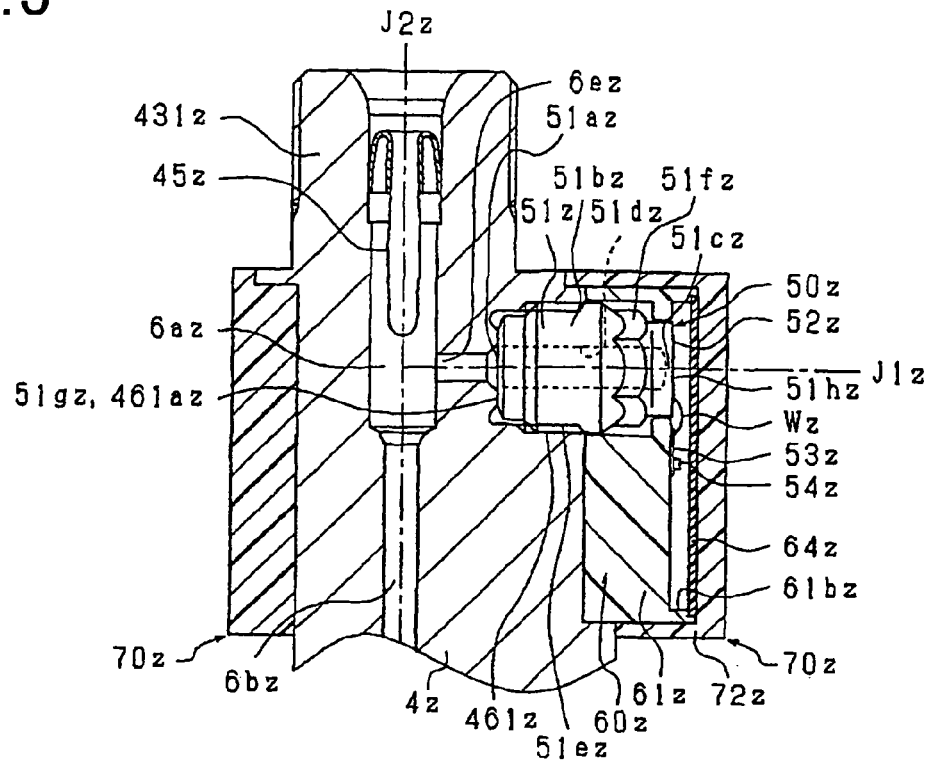
FIG. 3 is a schematic sectional view which shows an outline of internal structure of an injector according to the second embodiment of the invention.

The first embodiment is so designed that the installation of the fuel pressure sensor 50z in the injector body 4z is achieved by fitting it into the injector body 4z from outside the axial line J2z of the cylindrical injector body 4z. In contrast to this, the embodiment of FIG. 3 is designed to achieve the installation from radially outside the cylindrical body 4z. Specifically, the cylindrical injector body 4z has formed in an outer circumferential surface a recess 461z into which the cylinder 51bz of the stem 51z of the fuel pressure sensor 50z is to be fitted. Therefore, a sealing surface 461az of the body 4z which creates the metal-to-metal touch seal between itself and the stem 51z is oriented so as to expand in parallel t the axial line J2z.

The high-pressure port 43z of the injector of the first embodiment is so oriented as to join the high-pressure pipe HPz in the radial direction of the injector. The high-pressure port 4311 of this embodiment is so oriented as to join the high-pressure pipe HPz in axial line J2z of the injector. Specifically, the high-pressure port 431z is formed in the spray hole-opposite end surface of the cylindrical body 4z.

The branch path 6ez diverges from the large-diameter portion 6az in which the filter 45z is disposed, thereby producing an accumulating effect in the large-diameter portion 6az having a great volume, and the ability of measuring the fuel pressure in which a pulsation of pressure as a noise is suppressed. The large-diameter portion 6az formed to have the filter 45z installed therein may be employed as a large-diameter portion for the above accumulating effect, thus permitting the machining processes of the body 4z to be decreased or the size of the injector to be decreased as compared with when an accumulating large-diameter portion is formed separately from the filter large-diameter portion.

Third Embodiment

Figure 4:
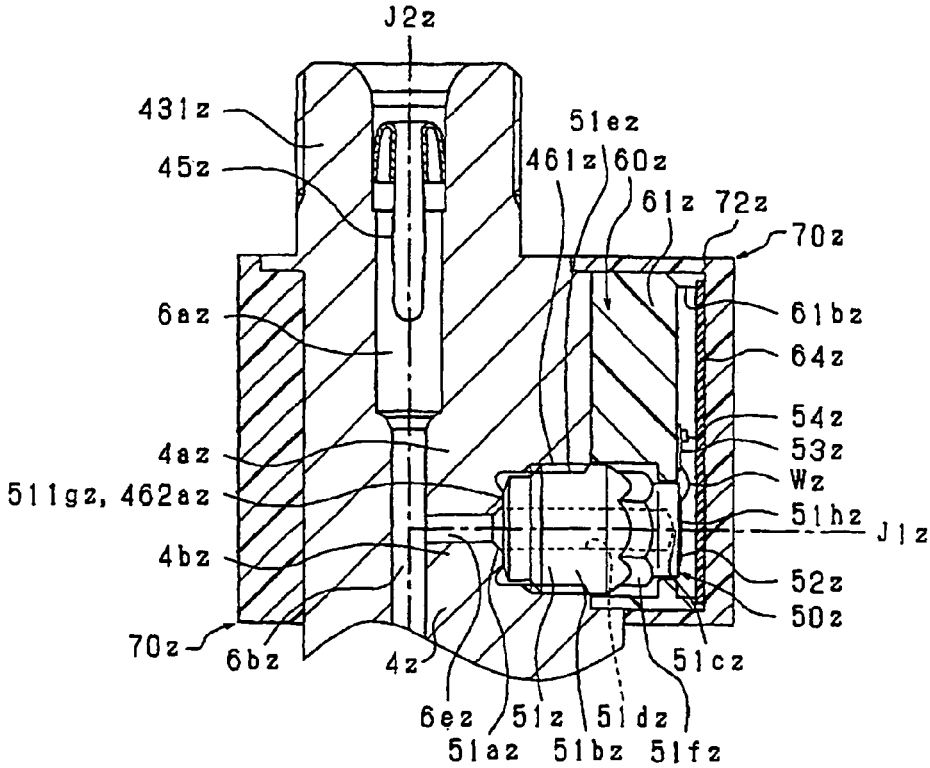
FIG. 4 is a schematic sectional view which shows an outline of internal structure of an injector according to the third embodiment of the invention.

In the second embodiment, the branch path 6ez diverges from the large-diameter portion 6az of the high-pressure path 6z, but this embodiment of FIG. 4 has the branch path 6ez diverging from a small-diameter portion 6bz of the high-pressure path 6z.

The diverging of the branch path 6ez from the high-pressure paths 6az and 6bz facilitates the concentration of stress on a portion of the body 4z (i.e., a branching portion) where the high-pressure paths 6az and 6bz intersects with the branch path 6ez, thus requiring the need for ensuring the strength of the body 4z. This embodiment has the branch path 6ez diverging from the small-diameter portion 6bz, thus improving the strength of the branching portion of the body 4z as compared with when the branch path 6ez diverges from the large-diameter portion 6az.

Fourth Embodiment

Figure 5:
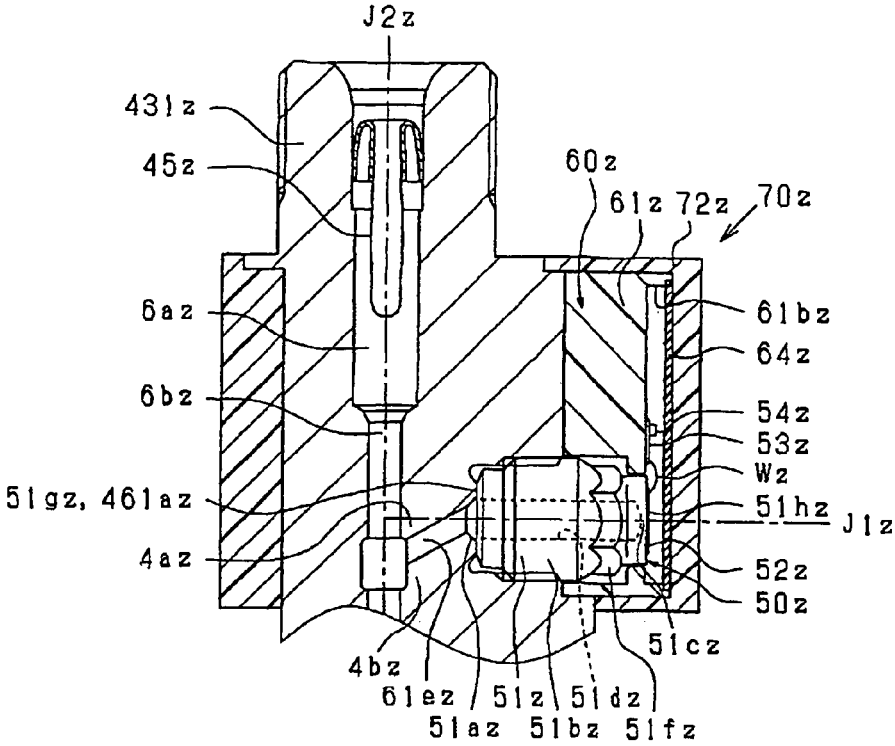
FIG. 5(*a*) is a schematic sectional view which shows an outline of internal structure of an injector according to the fourth embodiment of the invention.
Figure 5:
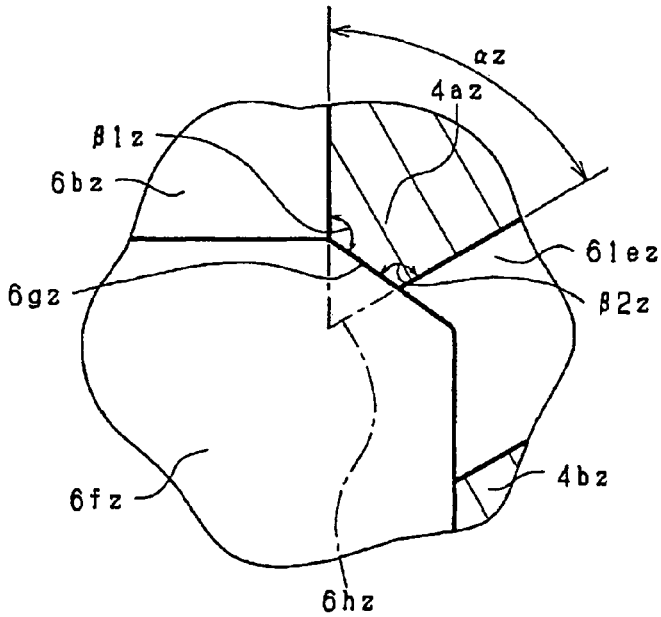

The third embodiment of FIG. 4 has the branch path 6ez formed to extend perpendicular to the high-pressure path 6bz, while this embodiment of FIG. 5 has the branch path 61ez inclined to the high-pressure path 6bz. This improves the degree of freedom of layout of the fuel pressure sensor 50z.

Next, the strength of portions 4az and 4bz of the body 4z (which will be referred to as branch portions below) between the branch path 61ez and the high-pressure path 6bz will be described below using FIG. 5(*b*) that is an enlarged view of FIG. 5(*a*). In the orthogonal shape of FIG. 4, corners of the branch portions are both 90°, while in the inclined shape of FIG. 5, the branch portion 4az that is one of the branch portions 4az and 4bz has an acute-angled corner (see a dashed dotted line 6hz in FIG. 5(*b*)). Therefore, the orthogonal shape of FIG. 4 minimizes the concentration of stress on the corners of the branch portions 4az and 4bz of the body 4z as compared with the inclined shape of FIG. 5.

In the inclined shape of FIG. 5, it is preferable that the corner of the acute-angled side branch portion 4az is, as indicated by a solid line 6gz in FIG. 5(*b*), chamfered in order to decrease the concentration of stress on the branch portions 4az and 4bz. The non-chamfered shape, as indicated by the dashed dotted line 6hz, facilitates the breakage of the branch portion 4az because it has the acute angle αz.

In contrast, this embodiment has the portion 4az having the acute angle αz which is chamfered to have the shape 6gz which defines two corners β1z and β2z. This decreases the possibility of the breakage.

In order to make such a chamfered shape, this embodiment has an expanding pipe portion 6fz in the high-pressure path 6bz, thereby facilitating the ease of chamfering the corner of the branch portion 4az.

Fifth Embodiment

The lead wires 21z of the piezo-actuator 2z and the fuel pressure sensor 50z are disposed inside the connector housing 70z. It is necessary to seal the lead wires 21z and the fuel pressure sensor 50z externally. This sealing structure of the first embodiment is so designed that the O-ring S1z (i.e., a sealing member) is interposed between the inner peripheral surface of the cylinder 63z of the molded resin 60z and the outer peripheral surface of the body 4z. Specifically, the single O-ring S1z seals both the lead wires 21z and the fuel pressure sensor 50z hermetically.

Figure 6:
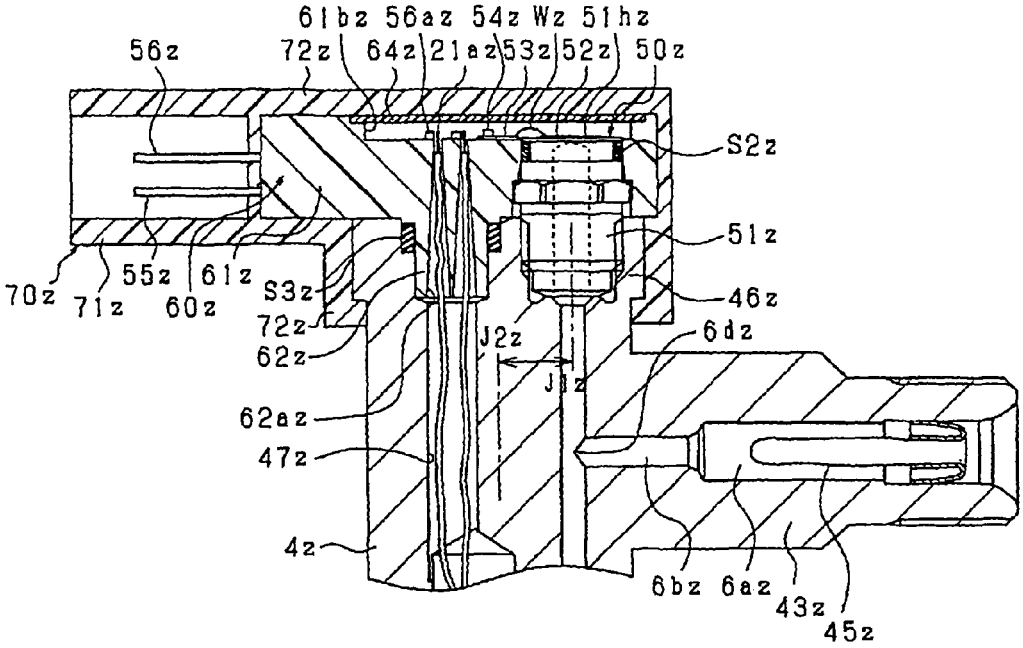
FIG. 6 is a schematic sectional view which shows an outline of internal structure of an injector according to the fifth embodiment of the invention.

In contrast to this, the embodiment, as illustrated in FIG. 6, is designed to have O-rings S2z and S3z (i.e., sealing members) for the lead wires 21z and the fuel pressure sensor 50z. Specifically, the O-ring S2z is interposed between the cylinder body 51bz of the fuel pressure sensor 50z and the recess 46z of the molded resin 60z. The O-ring S3z is interposed between the lead wire hole 47z of the injector body 4z and the boss 62z of the molded resin 60z.

Sixth Embodiment

Figure 7:
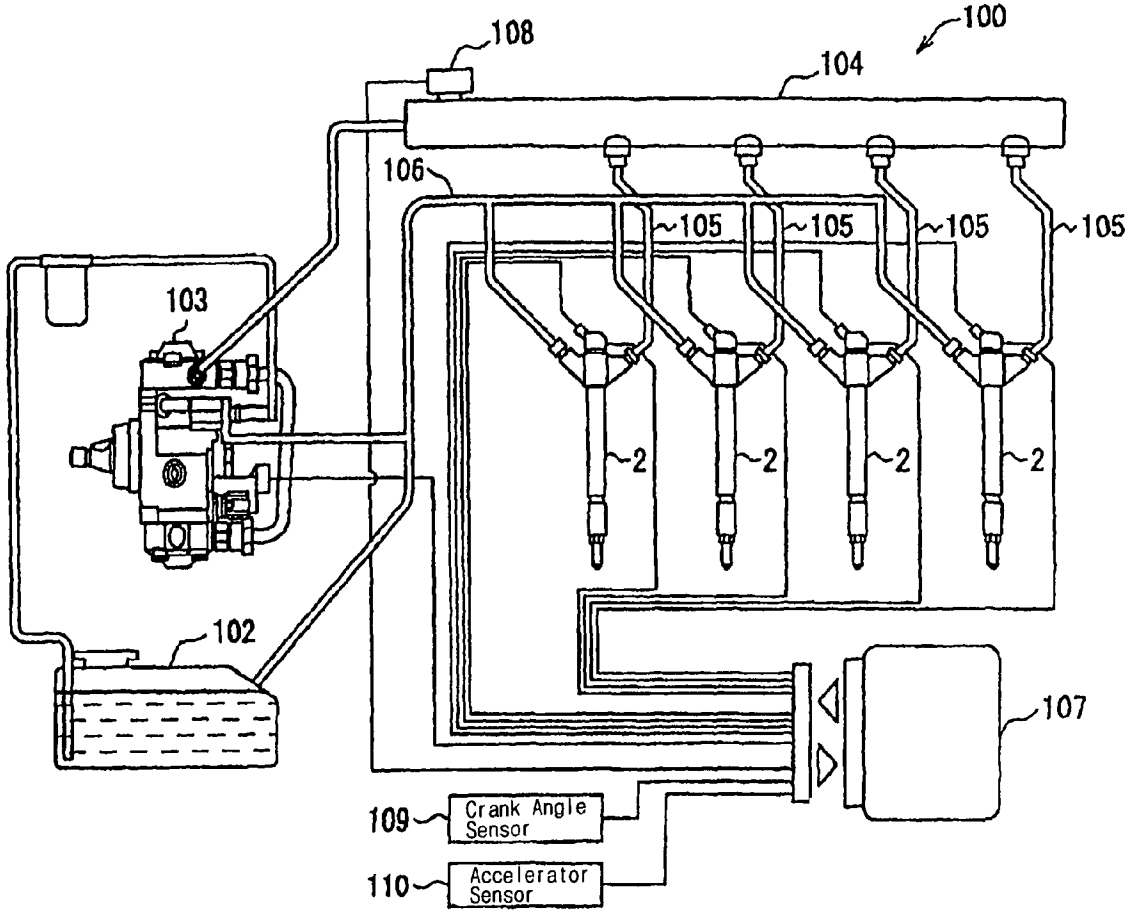
FIG. 7 is a schematic view of a structure in which an injector for a fuel injection device of the sixth embodiment of the invention is installed in a common rail system.
Figure 8:
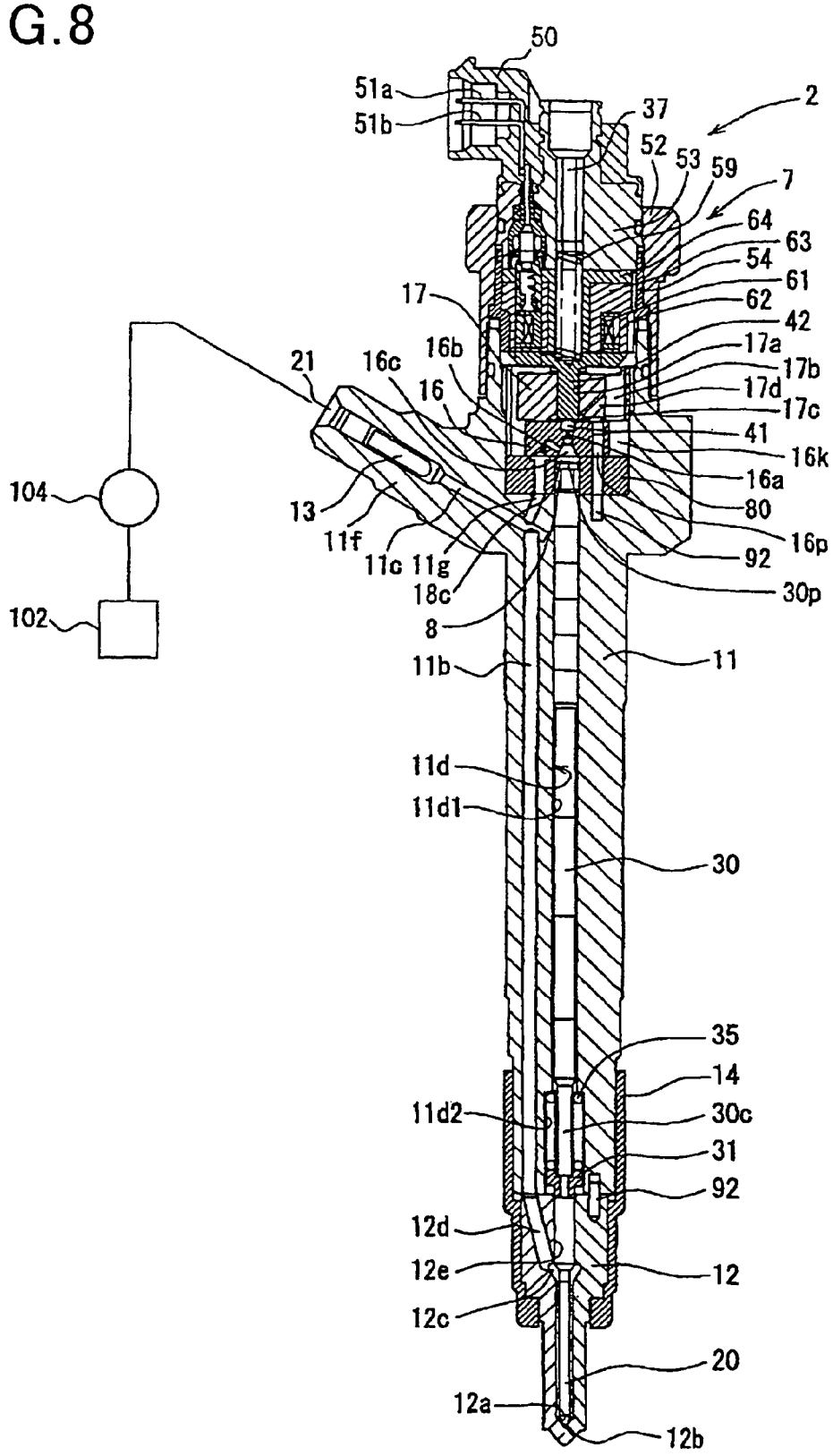
FIG. 8 is a sectional view of an injector for a fuel injection system according to the sixth embodiment.
Figure 9:
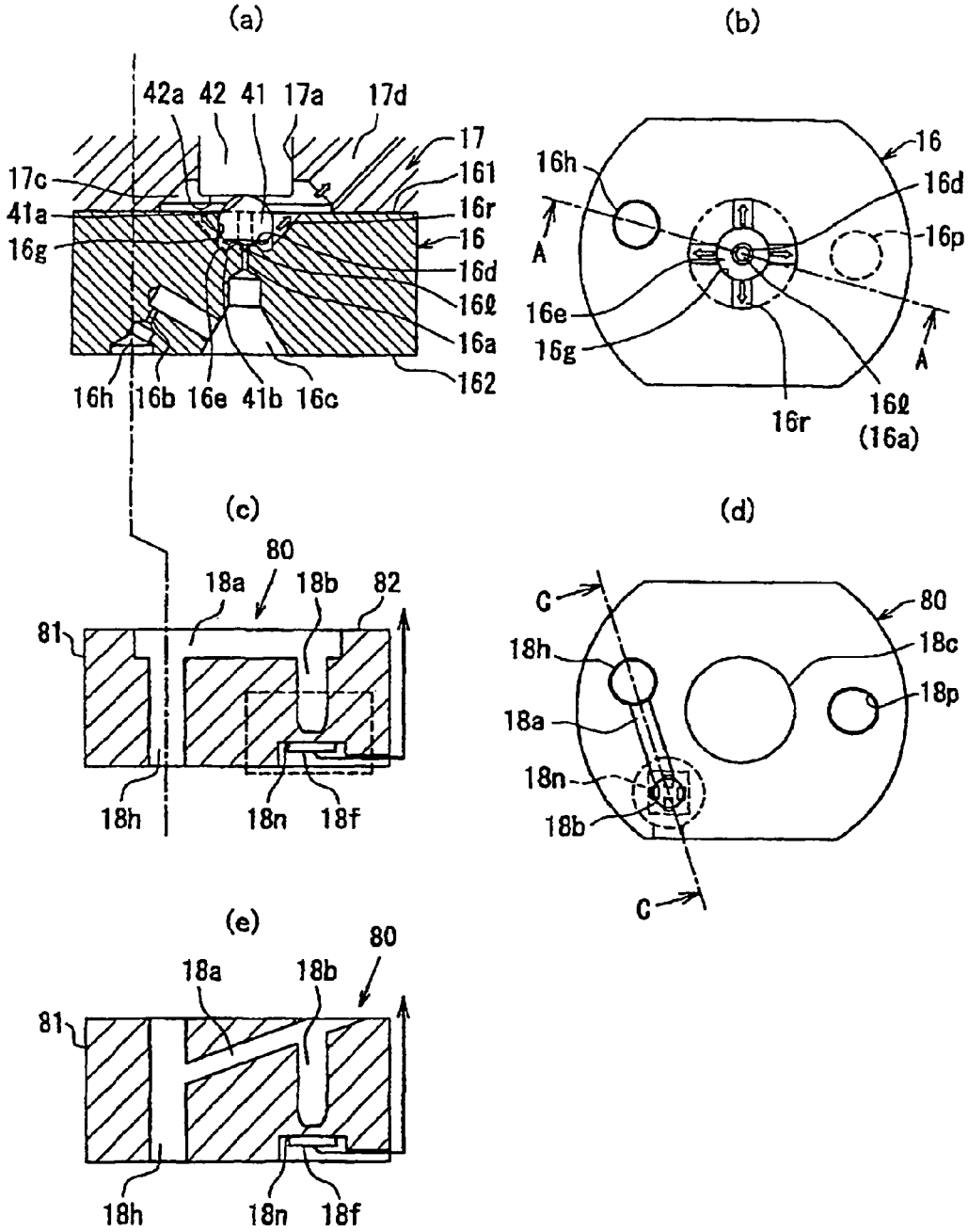
FIG. 9(*a*) is a sectional view of an orifice member in the sixth embodiment.
Figure 10:
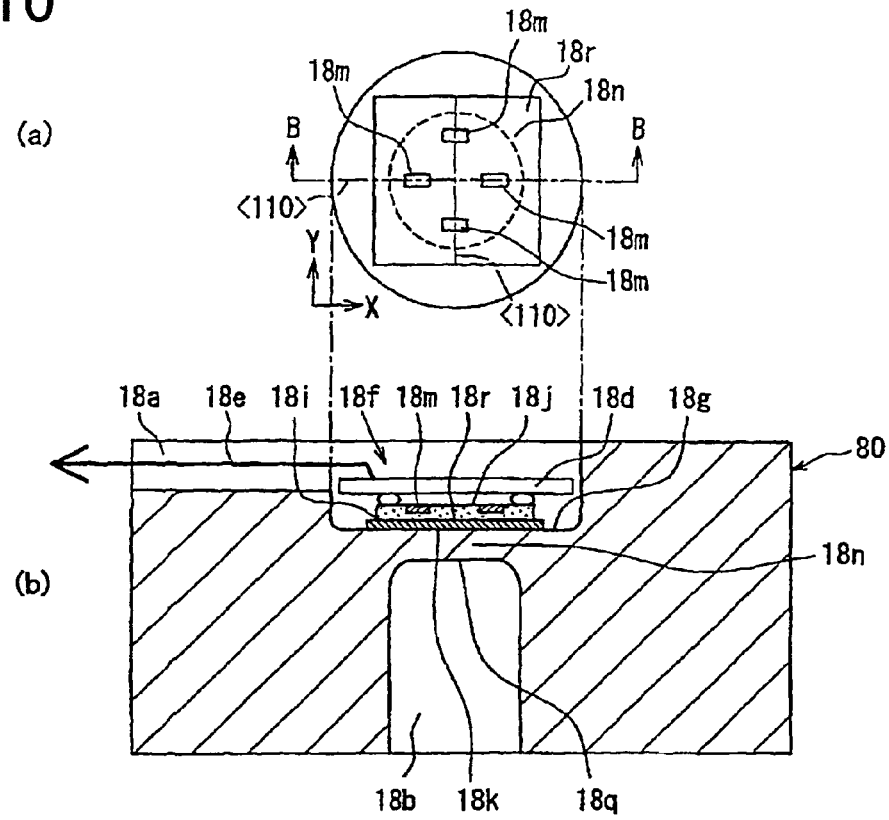
FIG. 10(*a*) is an enlarged plan view near a diaphragm of a pressure sensing member in the sixth embodiment.
Figure 11:
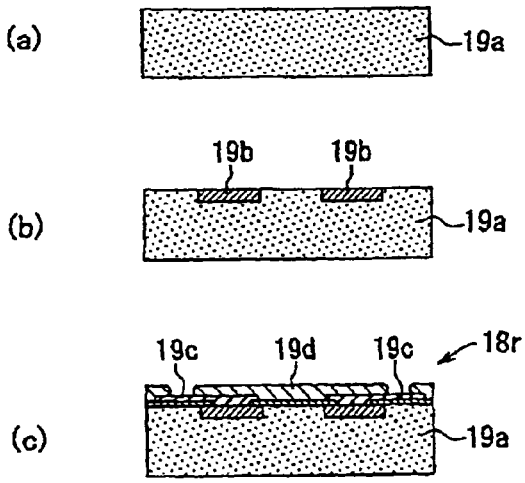
FIG. 11(*a*) is a sectional view which shows a production method of a fuel pressure sensor in the sixth embodiment.

FIG. 7 is a whole structure view of an accumulator fuel injection system 100 including the above diesel engine. FIG. 8 is a sectional view which shows the injector 2 according to this embodiment. FIGS. 9(*a*) and 9(*b*) are partial sectional view and a plane view which illustrate highlights of a fluid control valve in this embodiment. FIGS. 9(*c*) to 9(*e*) are partially sectional views and a plane view which show highlights of a pressure sensing member. FIGS. 10(*a*) and 10(*b*) are a sectional view and a plane view which illustrate highlights of the pressure sensing member. FIGS. 11(*a*) to 11(*c*) are sectional views which illustrate a production method of the pressure sensor. The fuel injection system 100 of this embodiment will be described below with reference to the drawings.

The fuel pumped out of the fuel tank 102 is as illustrated in FIG. 7, pressurized by the high-pressure supply pump (which will be referred to as a supply pump below) 103 and delivered to the common rail 104. The common rail 104 stores the fuel, as supplied from the supply pump 103, at a high pressure and supplies it to the injectors 2 through high-pressure fuel pipes 105, respectively. The injectors 2 are installed one in each of cylinders of a multi-cylinder diesel engine (which will be referred to as an engine below) mounted in an automotive vehicle and work to inject the high-pressure fuel (i.e., high-pressure fluid), as accumulated in the common rail 104, directly into a combustion chamber. The injectors 2 are also connected to a low-pressure fuel path 106 to return the fuel back to the fuel tank 102.

An electronic control unit (ECU) 107 is equipped with a typical microcomputer and memories and works to control an output from the diesel engine. Specifically, the ECU 107 samples results of measurement by a fuel pressure sensor 108 measuring the pressure of fuel in the common rail 104, a crank angle sensor 109 measuring a rotation angle of a crankshaft of the diesel engine, an accelerator position sensor 110 measuring the amount of effort on an accelerator pedal by a user, and pressure measuring portions 80 installed in the respective injectors 2 to measure the pressures of fuel in the injectors 2 and analyzes them.

The injector 2, as illustrated in FIG. 8, includes a nozzle body 12 retaining therein a nozzle needle 20 to be movable in an axial direction, a lower body 11 retaining therein a spring 35 working as urging means to urge the nozzle needle 20 in a valve-closing direction, a retaining nut 14 working as a fastening member to fastening the nozzle body 12 and the lower body 11 through an axial fastening pressure, a solenoid valve device 7, and the pressure sensing portion 80. The nozzle body 12, the lower body 11, and the retaining nut 14 form a nozzle body of the injector with the nozzle body 12 and the lower body 11 fastened by the retaining nut 14. In this embodiment, the lower body 11 and the nozzle body 12 form an injector body. The nozzle needle 20 and the nozzle body 12 forms a nozzle.

The nozzle body 12 is substantially of a cylindrical shape and has at least one spray hole 12*b* formed in a head thereof (i.e., a lower end, as viewed in FIG. 8) for spraying a jet of fuel into the combustion chamber.

The nozzle body 12 has formed therein a storage hole 12*e* (which will also be referred to as a first needle storage hole below) within which the solid-core nozzle needle 20 is retained to be slidable in the axial direction thereof. The first needle storage hole 12*e* has formed in a middle portion thereof, as viewed vertically in the drawing, a fuel sump 12*c* which increases in a hole diameter. Specifically, the inner periphery of the nozzle body 12 defines the first needle storage hole 12*e*, the fuel sump 12*c*, and a valve seat 12*a* in that order in a direction of flow of the fuel. The spray hole 12*b* is located downstream of the valve seat 12*a* and extends from inside to outside the nozzle body 12.

The valve seat 12*a* has a conical surface and continues at a large diameter side to the first needle storage hole 12*e* and at a small diameter side to the spray hole 12*b*. The nozzle needle 20 is seated on or away from the valve seat 12*a* to close or open the nozzle needle 20.

The nozzle body 12 also has a fuel feeding path 12*d* extending from an upper mating end surface thereof to the fuel sump 12*c*. The fuel feeding path 12*d* communicates with a fuel supply path 11*b*, as will be described later in detail, formed in the lower body 11 to deliver the high-pressure fuel, as stored in the common rail 104, to the valve seat 12*a* through the fuel sump 12*c*. The fuel feeding path 12*d* and the fuel supply path 11*b* define a high-pressure fuel path.

The lower body 11 is substantially of a cylindrical shape and has formed therein a storage hole 11*d* (which will also be referred to as a second needle storage hole below) within which the spring 35 and a control piston 30 which works to move the nozzle needle 20 are disposed to be slidable in the axial direction of the lower body 11. An inner circumference 11*d*2 is formed in a lower mating end surface of the second needle storage hole 11*d*. The inner circumference 11*d*2 is expanded more than a middle inner circumference 11*d*1.

Specifically, the inner circumference 11*d*2 (which will also be referred to as a spring chamber below) defines a spring chamber within which the spring 35, an annular member 31, and a needle 30*c* of the control piston 30 are disposed. The annular member 31 is interposed between the spring 35 and the nozzle needle 20 and serves as a spring holder on which the spring 35 is held to urge the nozzle needle 20 in the valve-closing direction. The needle 30*c* is disposed in direct or indirect contact with the nozzle needle 20 through the annular member 31.

The lower body 11 has a coupling 11*f* (which will be referred to as an inlet below) to which the high-pressure pipe, as illustrated in FIG. 7, connecting with a branch pipe of the common rail 104 is joined in an air-tight fashion. The coupling 11*f* is made up of a fluid induction portion 21 at which the high-pressure fuel, as supplied from the common rail 104, enters and a fuel inlet path 11*c* (will also be referred to as a second fluid path corresponding to a high-pressure path) through which the fuel is delivered to the fuel supply path 11*b* (will also be referred to as a first fluid path corresponding to a high-pressure path). The fuel inlet path 11*c* has a bar filter 13 installed therein. The fuel supply path 11*b* extends in the inlet 111 and around the spring chamber 11*d*2.

The lower body 11 also has a fuel drain path (which is not shown and also referred to as a leakage collecting path) through which the fuel in the spring chamber 11*d*2 is returned to a low-pressure fuel path such as the fuel tank 102, as illustrated in FIG. 10. The fuel drain path and the spring chamber 11*d*2 form the low-pressure fuel path.

As illustrated in FIG. 8, on the other end side of the control piston 30, pressure control chambers 8 and 16*c* (which will be referred to as hydraulic control chambers) are defined to which the hydraulic pressure is supplied by the solenoid-operated valve device 7.

The hydraulic pressure in the hydraulic pressure control chambers 8 and 16*c* is increased or decreased to close or open the nozzle needle 20. Specifically, when the hydraulic pressure is drained from the hydraulic pressure control chambers 8 and 16*c*, it will cause the nozzle needle 20 and the control piston 30 to move upward, as viewed in FIG. 8, in the axial direction against the pressure of the spring 35 to open the spray hole 12*b*. Alternatively, when the hydraulic pressure is supplied to the hydraulic pressure control chambers 8 and 16*c* so that it rises, it will cause the nozzle needle 20 and the control piston 30 to move downward, as viewed in FIG. 9, in the axial direction by the pressure of the spring 35 to close the spray hole 12*b*.

The pressure control chambers 8, 16*c*, and 18*c* are defined by an outer end wall (i.e., an upper end) 30*p* of the control piston 30, the second needle storage hole 11*d*, an orifice member 16, and a pressure sensing member 81. When the spray hole 12*b* is opened, the upper end wall 30*p* lies flush with a flat surface 82 of the pressure sensing member 81 placed in surface contact with the orifice block 16 or is located closer to the spray hole 12*b* than the flat surface 82. In other words, when the spray hole 12*b* is opened, the upper end wall 30*p* is disposed inside the pressure control chamber 18*c* of the pressure sensing member 81.

Next, the solenoid-operated valve 7 will be described in detail. The solenoid-operated valve 7 is an electromagnetic two-way valve which establishes or blocks fluid communication of the pressure control chambers 8, 16*c*, and 18*c* with a low-pressure path 17*d* (which will also be referred to as a communication path below). The solenoid-operated valve 7 is installed on a spray hole-opposite end of the lower body 11. The solenoid-operated valve 7 is secured to the lower body 11 through an upper body 52. The orifice member 16 is disposed on the spray hole-opposite end of the second needle storage hole 11*d* as a valve body.

The orifice member 16 is preferably made of a metallic plate (a first member) extending substantially perpendicular to an axial direction of the fuel injector 2, that is, a length of the control piston 30. The orifice member 16 is machined independently (i.e., in a separate process or as a separate member) from the lower body 11 and the nozzle body 12 defining the injector body and then installed and retained in the lower body 11. The orifice member 16, as illustrated in FIGS. 9(*a*) and 9(*b*), has communication paths 16*a*, 16*b*, and 16*c* formed therein. FIG. 9(*b*) is a plan view of the orifice member 16, as viewed from a valve armature 42. The communication paths 16*a* 16*b*, and 16*c* (which will also be referred to as orifices below) work as an outer orifice defining an outlet, an inner orifice defining an inlet, and the control chamber 16*c* which leads to the second needle chamber 11*d*.

The outer orifice 16*a* communicates between the valve seat 16*d* and the pressure control chamber 16*c*. The outer orifice 16*a* is closed or opened by a valve member 41 through the valve armature 42. The inner orifice 16*b* has an inlet 16*h* opening at the flat surface 162 of the orifice member 16. The inlet 16*h* communicates between the pressure control chamber 16*c* and a fuel supply branch path 11*g* through a sensing portion communication path 18*h* formed in the pressure sensing member 81. The fuel supply branch path 11*g* diverges from the fuel supply path 11*b*.

The valve seat 16*d* of the orifice body 16 on which the valve member 41 is to be seated and the structure of the valve armature 42 will be described later in detail.

The valve body 17 serving as a valve housing is disposed on the spray hole-far side of the orifice member 16. The valve body 17 has formed on the periphery thereof an outer thread which meshes with an inner thread formed on a cylindrical, threaded portion of the lower body 11 to nip the orifice member 16 between the valve body 17 and the lower body 11. The valve body 17 is substantially of a cylindrical shape and has through holes 17*a* and 17*b* (see FIG. 8). The communication path 17*d* is formed between the through holes 17*a* and 17*b*. The hole 17*a* will also be referred to as a guide hole below.

The valve body-side end surface 16*l* of the orifice member 16 and the inner wall of the through hole 17*a* define a valve chamber 17*c*. The orifice member 16 has formed on an outer wall thereof diametrically opposed flats (not shown). A gap 16*k* formed between the flats and the inner wall of the lower body 11 communicates with the through holes 17*b* (see FIG. 8).

The pressure sensing portion 80 is, as illustrated in FIGS. 9(*c*) and 9(*d*), equipped with the pressure sensing member 81 which is separate from the injector body (i.e., the lower body 11 and the valve body 17). FIG. 9(*d*) is a plan view of the pressure sensing member 81, as viewed from the orifice member 16. The pressure sensing member 81 is preferably made of a metallic plate (second member) extending substantially perpendicular to the axial direction of the fuel injector 2, i.e., the length of the control piston 30 and laid to overlap directly or indirectly with the orifice member 16 within the orifice member 16. The pressure sensing member 81 is secured firmly to the lower body 11 and the nozzle body 12. In this embodiment, the pressure sensing member 81 has the flat surface 82 placed in direct surface contact with the flat surface 162 of the orifice member 16 in the liquid-tight fashion. The pressure sensing member 81 and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81, respectively. The orifice member-far side of the sensing portion communication path 18*h* opens at a location corresponding to the fuel supply branch path 11*g* diverging from the fuel supply path 11.*b*. The through hole 18*h* of the pressure sensing member 81 forms a portion of the path from the fuel supply path 11*b* to the pressure control chamber.

The pressure sensing member 81 (corresponding to a fuel pressure sensor) is also equipped with a pressure sensing chamber 18*b* defined by a groove formed therein which has a given depth from the orifice member 16 side and inner diameter. The bottom of the groove defines a diaphragm 18*n*. The diaphragm 18*n* has a semiconductor sensing device 18*f* affixed or glued integrally to the surface thereof opposite the pressure sensing chamber 18*b*.

The diaphragm 18*n* is located at a depth that is at least greater than the thickness of the pressure sensor 18*f* below the surface of the pressure sensing member 81 which is opposite the pressure sensing chamber 18*b*. The surface of the diaphragm 18*n* to which the pressure sensor 18*f* is affixed is greater in diameter than the pressure sensing chamber 18*b*. The thickness of the diaphragm 18*n* is determined during the production thereof by controlling the depth of both of the grooves sandwiching the diaphragm 18*n*. The pressure sensing member 81 also has a groove 18*a* (a branch path below) formed in the flat surface 82 to have a depth smaller than the pressure sensing chamber 18*b*. The groove 18*a* communicates between the sensing portion communication path 18*h* and the pressure sensing chamber 18*b*. When the pressure sensing member 81 is placed in surface abutment with the orifice member 16, the groove 18*a* defines a combined path (a branch path below) whose wall is a portion of the flat surface of the orifice member 16. This establishes fluid communications of the groove 18*a* (i.e., the branch path) at a portion thereof with the inner orifice 16*b* that is the path extending from the fuel supply path 11*b* to the hydraulic pressure control chambers 8 and 16*c* and at another portion thereof with the diaphragm 18*n*, so that the diaphragm 18*n* may be deformed by the pressure of high-pressure fuel flowing into the pressure sensing chamber 18*b*.

The diaphragm 18*n* is the thinnest in wall thickness among the combined path formed between the groove 18*a* and the orifice member 16 and the pressure sensing chamber 18*b*. The thickness of the combined path is expressed by the thickness of the pressure sensing member 81 and the orifice member 16, as viewed from the inner wall of the combined path.

Instead of the groove 18*a*, a hole, as illustrated in FIG. 9(*e*), may be formed which extends diagonally between the sensing portion communication path 18*h* and the pressure sensing chamber 18*b*. The pressure sensor 18*f* (displacement sensing means) and the diaphragm 18*n* function as a pressure sensing portion.

The pressure sensing portion will be described below in detail with reference to FIG. 10.

The pressure sensor 18*f* is equipped with the circular diaphragm 18*n* formed in the pressure sensing chamber 18*b* and a single-crystal semiconductor chip 18*r* (which will be referred to as a semiconductor chip below) bonded as a displacement sensing means to the bottom of the recess 18*g* defining at one of surfaces thereof the surface of the diaphragm 18*n* and designed so that a pressure medium (i.e., gas or liquid) is introduced as a function of the fuel injection pressure in the engine into the other surface 18*q* side of the diaphragm 18*n* to sense the pressure based on the deformation of the diaphragm 18*n* and the semiconductor chip 18*r*.

The pressure sensing member 81 is formed by cutting and has the hollow cylindrical pressure sensing chamber 18*b* formed therein. The pressure sensing member 81 is made of Kovar that is Fi—Ni—Co alloy whose coefficient of thermal expansion is substantially equal to that of glass. The pressure sensing member 81 has formed therein the diaphragm 18*n* subjected at the surface 18*q* to the high-pressure fuel, as flowing into the pressure sensing chamber 18*h*.

As an example, the pressure sensing member 81 has the following measurements. The outer diameter of the cylinder is 6.5 mm. The inner diameter of the cylinder is 2.5 mm. The thickness of the diaphragm 18*n* required under 20 MPa is 0.65 mm, and under 200 MPa is 1.40 mm. The semiconductor chip 18*r* affixed to the surface of the diaphragm 18*n* is made of a monocrystal silicon flat substrate which has a plane direction of (100) and an uniform thickness. The semiconductor ship 18*r* has a surface 18*i* secured to the surface (i.e., the bottom surface of the recess 18*g*) through a glass layer 18*k* made from a low-melting glass material.

Taking an example, the semiconductor chip 18*r* is of a square shape of 3.56 mm×3.56 mm and has a thickness of 0.2 mm. The glass layer has a thickness of for example, 0.06 mm. The semiconductor chip 18*r* is equipped with four rectangular gauges 18*m* installed in the surface 18*j* thereof. The gauges 18*m* is each implemented by a piezoresistor. The semiconductor chip 18*r* whose plane direction is (100) structurally has orthogonal crystal axes <110>.

The four gauges 18*m* are disposed two along each of the orthogonal crystal axes <110>. Two of the gauges 18*m* are so oriented as to have long side thereof extending in the x-direction, while the other two gauges 18*m* are so oriented as to have short sides extending in the y-direction. The four gauges 18*m* are arrayed along a circle whose center O lies at the center of the diaphragm 18*n*.

Although not shown in the drawings, the semiconductor chip 18*r* also has wires and pads which connect the gauges 18*m* together to make a typical bridge circuit and make terminals to be connected to an external device. The semiconductor chip 18*r* also has a protective film formed thereon. The semiconductor chip 18*r* is substantially manufactured in the following steps, as demonstrated in FIGS. 11(*a*) to 11(*c*). First, an n-type sub-wafer 19*a* is prepared. A given pattern is drawn on the sub-wafer 19*a* through the photolithography. Subsequently, boron is diffused over the sub-wafer 19*a* to form pi-regions 19*b* that are piezoresistors working as the gauges 18*m*. Wires and pads 19*c* are formed on the sub-wafer 19*a*. An oxide film 19*d* is also formed over the surface of the sub-wafer 19*a* to secure electric insulation of the wires and the pads 19*c*. Finally, a protective film is also formed. The protective film on the pads is etched to complete the semiconductor chip 18*r*.

The semiconductor chip 18*r* thus produced is glued to the diaphragm 18*n* of the pressure sensing member 81 using a low-melting glass to complete the pressure sensor 18*f*, as illustrated in FIG. 10. The pressure sensor 18*f* converts the displacement (flexing) of the diaphragm 18*n* caused by the pressure of high-pressure fuel into an electric signal (i.e., a difference in potential of the bridge circuit arising from a change in resistance of the piezoresistors). An external processing circuit (not shown) handles the electric signal to determine the pressure.

The processing circuit may be fabricated monolithically on the semiconductor chip 18*r*. In this embodiment, a processing circuit board 18*d* is disposed over the semiconductor chip 18*r* and electrically connected therewith through, for example, the flip chip bonding. A constant current source and a comparator that are parts of the above described bridge circuit is fabricated on the processing circuit board 18*d*. A non-volatile memory (not shown) which stores data on the sensitivity of the pressure sensor 18*f* and the injection quantity characteristic of the fuel injector may also be mounted on the processing circuit board 18*d*. Wires 18*e* are connected at one end to terminal pads arrayed on the side of the processing circuit board 18*d* and at the other end to terminal pins 51*b* mounted in a connector 50 through a wire passage (not shown) formed within the valve body 17 and electrically connected to the ECU 107.

The pressure sensor 18*f* equipped with the piezoresistors and the low-melting glass work as a strain sensing device. The diaphragm 18*n* is installed at a depth from the surface of the pressure sensing member 81 which is opposite the pressure sensing chamber 18*b*. The depth is at least greater than the sum of the thicknesses of the pressure sensor 18*f* and the low-melting glass. In the case where which the processing circuit board 18*d* and the wires 18*e* are disposed on the semiconductor chip 18*r* in the thickness-wise direction thereof, the surface of the diaphragm 18*n* opposite the pressure sensing chamber 18*b* is located at a depth greater than a total thickness of the pressure sensor 18*f*, the processing circuit board 18*d*, and the wires 18*e*.

In this embodiment, the pressure sensor 18*f* of a semiconductor type affixed as the displacement sensing means to the metallic diaphragm 18*n* is used, but instead, strain gauges made of metallic films may be affixed to or vapor-deposited on the diaphragm 18*n*.

Referring back to FIG. 8, a coil 61 is wound directly around a resinous spool 62. The coil 61 and the spool 62 are covered at an outer periphery thereof with a resinous mold (not shown). The coil 61 and the spool 62 may be made by winding wire into the coil 61 using a winding machine, coating the outer periphery of the coil 61 with resin using molding techniques, and resin-molding the coil 61 and the spool 62. The coil 61 is connected electrically at ends thereof to the ECU 107 through terminal pins 51*a* formed in the connector 50 together with terminal pins 51*b*.

A stationary core 63 is substantially of a cylindrical shape. The stationary core 63 is made up of an inner peripheral core portion, an outer peripheral core portion, and an upper end connecting the inner and outer peripheral core portions together. The coil 61 is retained between the inner and outer peripheral core portions. The stationary core is made of a magnetic material.

The valve armature 42 is disposed beneath the lower portion of the stationary core 63, as viewed in FIG. 8, and faces the stationary core 63. Specifically, the valve armature 42 has an upper end surface serving as a pole face which is movable to or away from a lower end surface (i.e., a pole face) of the stationary core 63. When the coil 61 is energized, it will cause a magnetic flux to flow from pole faces of the inner and outer peripheral core portions of the stationary core 63 to the pole face of the valve armature 42 to create a magnetic attraction depending upon the magnetic flux density which acts on the valve armature 42.

A substantially cylindrical stopper 64 is disposed inside the stationary core 63 and held firmly between the stationary core 63 and an upper housing 53. An urging member 59 such as a compression spring is disposed in the stopper 64. The pressure, as produced by the urging member 59, acts on the valve armature 42 to bring the valve armature 42 away from the stationary core 63 so as to increase an air gap between the pole faces thereof. The stopper 64 has an armature-side end surface to limit the amount of lift of the valve armature 42 when lifted up.

The stopper 64 and the upper body 52 have formed therein a fuel path 37 from which the fuel flowing out of the valve chamber 17*c* and a through hole 17*b* is discharged to the low-pressure side.

The upper body 52 (i.e., an upper housing), an intermediate housing 54, and the valve body 17 (i.e., a lower housing) serve as a valve housing. The intermediate housing 54 is substantially cylindrical and retains the stationary core 63 therein so as to guide it. Specifically, the stationary core 63 is cylindrical in shape and has steps and a bottom. The stationary core 63 is disposed within an inner peripheral side of a lower portion of the intermediate housing 54. The outer periphery of the stationary core 63 decreases in diameter downward from the step thereof. The step engages the step formed on the inner periphery of the intermediate housing 54 to avoid the falling out of the intermediate housing 54 from the stationary core 63.

The valve armature 42 is made up of a substantially flat plate-shaped flat plate portion and a small-diameter shaft portion which is smaller in diameter then the flat plate portion. The upper end surface of the flat plate portion has the pole face opposed to the pole faces of the inner and outer peripheral core portions of the stationary core 63. The valve armature 42 is made of a magnetic material such as permendur. The plate portion has the small-diameter shaft portion formed on a lower portion side thereof.

The valve armature 42 has a substantially ball-shaped valve member 41 on the end surface 42*a* of the small-diameter shaft portion. The valve armature 42 is to be seated on the valve seat 16*d* of the orifice member 16 through the valve member 41. The orifice member 16 is positioned by and secured to the lower body 11 through the positioning member 92 such as a pin. The positioning member 92 is inserted into the hole 16*p* of the orifice member 16 and passes through the hole 18*p* of the pressure sensing member 81.

The valve structures of the valve armature 42 to be seated on or away from the valve member 41 and the orifice member 16 equipped with the valve seat 16*d* will also be described below using FIG. 9.

The end surface 42*a* of the small-diameter shaft portion of the valve armature 42 is, as illustrated in FIG. 9, flat and placed to be movable into abutment with or away from a spherical portion 41*a* of the valve member 41. The small-diameter portion of the valve armature 42 is retained by the inner periphery of the through hole 17*a* of the valve body 17 to be slidable in the axial direction and to be insertable into the valve chamber 17*c*. The valve armature 42 is seated on or lifted up from the valve seat 16*d* through the valve member 41, thereby blocking or establishing the flow of fuel from the hydraulic pressure control chambers 8 and 16*c* to the valve chamber 17*c*.

Specifically, the valve member 41 is made of a spherical body with a flat face 41*b*. The flat face 41*b* is to be seated on or lifted away from the valve seat 16*b*. When the flat face 41*b* is seat on the valve seat 16, it closes the outer orifice 16*a*. The flat face 41*b* forms the second flat surface.

The orifice member 16 has a bottomed guide hole 16*g* formed in the valve armature-side end surface 16*l* to guide slidable movement of the spherical portion 41*a* of the valve member 41. The valve seat 16*d* is so formed on the bottom of the inner periphery of the guide hole 16*g* as to have flat seat surface. The valve seat 16*d* constitutes a seat portion. The guide hole 16*g* constitutes a guide portion. The valve seat 16*d* defines a step portion formed in the orifice member 16. The end of an opening of the guide hole 16*b* lies flush with the end surface 16*l* of the orifice member 16.

The outer periphery of the valve seat 16*d* is smaller in size than the inner periphery of the guide hole 16*g*. An annular fuel release path 16*e* is formed between the valve seat 16*d* and the guide hole 16*g*. The outer circumference of the valve seat 16*d* is smaller than that of the flat face 41*b* of the valve member 41, so that when the flat face 41*d* is seated on or away from the valve seat 16*d*, a portion of the bottom of the guide hole 16*g* other than the valve seat 16*d* on which the flat face 41*b* is to be seated does not limit the flow of the fuel.

The fuel release path 16*e* defines a fluid release path in an area where the valve seat is in close contact with the second flat surface.

The fuel release path 16*e* is so shaped as to increase in sectional area thereof from the valve seat 16*d* side to the guide hole 16*g* side, thereby achieving a smooth flow of the fuel, as emerging from the valve seat 16*d* when the valve member 41 is lifted away from the valve seat 16*d*, to the low-pressure side.

The valve member 41 is, as described above, retained by the guide hole 16*g* to be slidable in the axial direction. The size of a clearance between the inner periphery of the guide hole 16*g* and the spherical portion 41*a* of the valve member 41 is, therefore, selected as a guide clearance which permits the sliding motion of the valve member 41. The amount of fuel leaking from the guide clearance is insufficient as the flow rate of fuel flowing from the valve seat 16*d* to the low-pressure side.

In this embodiment, the guide hole 16*g* has formed in the inner peripheral wall thereof fuel leakage grooves 16*r* leading to the valve chamber 17*c* on the low-pressure side. The fuel leakage grooves 16*r* serve to increase a sectional area of a flow path through which the fuel flows from the valve seat 16*d* to the low-pressure side. Specifically, the fuel leakage grooves 16*r* are formed in the inner wall of the guide hole 16*g* to increase the sectional area of the flow path through which the fuel flows from the valve seat 16*d* to the low-pressure side, thereby ensuring the flow rate of fuel to flow into the communication paths 16*a*, 16*b*, and 16*c* without decreasing the flow rate of fuel flowing from the valve seat 16*d* to the low-pressure side when the valve member 41 is lifted away from the valve seat 16*d*.

The fuel leakage grooves 16*r* are so formed in the inner wall of the guide hole 16*g* as to extend radially from the valve seat 16*d* (which is not shown), thereby permitting the plurality (six in this embodiment) of the leakage grooves 16*r* to be provided depending upon the flow rate of fuel to flow out of the communication paths 16*a*, 16*b*, and 16*c*. The radial extension of the leakage grooves 16*r* avoids the instability of orientation of the valve member 41 arising from fluid pressure of the fuel flowing from the valve seat 16*d* to the fuel leakage grooves 16*r*.

The inner periphery of the valve seat 16*d* has the step. The outlet side inner periphery 16*l*, the outer orifice 16*a*, and the pressure control chamber 16*c* are formed in that order.

The valve armature 42 constitutes a supporting member. The orifice member 16 constitutes the valve body with the valve seat. The valve body 17 constitutes the valve housing.

The operation of the fuel injector 2 having the above structure will be described below. The high-pressure fuel is supplied from the common rail 104 as a high-pressure source to the fuel sump 12*c* through the high-pressure fuel pipe, the fuel supply path 11*b*, and the fuel feeding path 12*d*. The high-pressure fuel is also supplied to the hydraulic pressure control chambers 8 and 16*c* through the fuel supply path 11*b* and the inner orifice 16*b*.

When the coil 61 is in a deenergized state, the valve armature 42 and the valve member 41 are urged by the urging member 59 into abutment with the valve seat 16*d* (downward in FIG. 8), so that the valve member 41 is seated on the valve seat 16*d*. This closes the outer orifice 16*a* to block the flow of fuel from the hydraulic pressure control chambers 8 and 16*c* to the valve chamber 17*c* and the low pressure path 17*d*.

The pressure of fuel in the hydraulic pressure control chambers 8 and 16*c* (i.e., the back pressure) is kept at the same level as in the common rail 104. The sum of the operating force (which will also be referred to as a first operating force below) that is the back pressure, as accumulated in the hydraulic pressure control chambers 8 and 16*c*, urging the nozzle needle 20 through the control piston 30 in the spray hole-closing direction and the operating force (which will also be referred to as a second operating force below), as produced by the spring 35, urging the nozzle needle 20 in the spray hole-closing direction is, thus, kept greater than the operating force (which will also be referred to as a third operating force below), as produced by the common rail pressure in the fuel sump 12*c* and around the valve seat 12*a*, urging the nozzle needle 20 in the spray hole-opening direction. This causes the nozzle needle 20 to be placed on the valve seat 12*a* and closes the spray hole 12*b* not to produce a jet of fuel from the spray holes 12*b*. The pressure of fuel (back pressure) in the closed outer orifice 16*a* (i.e., an outlet side inner periphery 16*l*) is exerted on the valve member 41 seated on the valve seat 16*d*.

When the coil 61 is energized (i.e., when the fuel injector 2 is opened), it will cause the coil 61 to produce a magnetic force so that a magnetic attraction is created between the pole faces of the stationary core 63 and the valve armature 42, thereby attracting the valve armature 42 toward the stationary core 63. The operating force (which will also be referred to as a fourth operating force below), as produced by the back pressure in the outer orifice 16*a* is exerted on the valve member 41 to lift the valve member 41 away from the valve seat 16*d*. The valve member 41 is lifted away from the valve seat 16*d* along with the valve armature 42, thus causing the valve member 41 to move along the guide hole 16*g* toward the stationary core 63.

When the valve member 41 is lifted away from the valve seat 16*d* along with the valve armature 42, it creates the flow of fuel from the hydraulic pressure control chambers 8 and 16*c* to the valve chamber 17*c* and to the low-pressure path 17*d* through the outer orifice 16*a*, so that the fuel in the hydraulic pressure control chambers 8 and 16*c* is released to the low-pressure side. This causes the back pressure, as produced by the hydraulic pressure control chambers 8 and 16*c*, to drop, so that the first operating force decreases gradually. When the third operating force urging the nozzle needle in the spray hole-opening direction exceeds the sum of the first and second operating forces urging the nozzle needle 20 in the spray hole-closing direction, it will cause the nozzle needle 20 to be lifted up from the valve seat 12*a* (i.e., upward, as viewed in FIG. 8) is to open the spray hole 12*b*, so that the fuel is sprayed from the spray hole 12*b*.

When the coil 61 is deenergized (i.e., when the injector 2 is closed), it will cause the magnetic force to disappear from the coil 61, so that the valve armature 42 and the valve member 41 are pushed by the urging member 59 to the valve seat 16*d*. When the flat face 41*b* of the valve member 41 is seated on the valve seat 16*d*, it blocks the flow of fuel from the hydraulic pressure control chambers 8 and 16*c* to the valve chamber 17*c* and the low-pressure path 17*d*. This results in a rise in the back pressure in the hydraulic pressure control chambers 8 and 16*c*. When the first and second operating forces exceeds the third operating force, it will cause the nozzle needle 20 to start to move downward, as viewed in FIG. 8. When the nozzle needle 20 is seated on the valve seat 12*a*, it terminates the fuel spraying.

The above described structure of the embodiment enables the pressure sensing portion to be disposed inside itself and possesses the following advantages.

The diaphragm 18*n* made by the thin wall is disposed in the branch path which diverges from the fuel supply path 11*b*. This facilitates the ease of formation of the diaphragm 18*n* as compared with when the diaphragm 18*n* is made directly in a portion of an outer wall of the fuel injector near the fuel flow path, thus resulting the ease of controlling the thickness of the diaphragm 18*n* to avoid a variation in the thickness and increase in accuracy in measuring the pressure of fuel in the fuel.

The diaphragm 18*n* is made by a thinnest portion of the branch path, thus resulting in an increase in deformation thereof arising from a change in pressure of the fuel.

The pressure sensing member 81 which is formed to be separate from the injector body (i.e., the lower body 11 and the valve body 17) has the diaphragm 18*n*, the hole, or the groove, thus facilitating the ease of machining the diaphragm 18*n*. This also results in case of controlling the thickness of the diaphragm 18*n* to improve the accuracy in measuring the pressure of fuel.

The pressure sensing member 81 including the diaphragm 18*n* is stacked on the orifice member 16 constituting the part of the pressure control chambers 8*c* and 16*c*, thereby avoiding an increase in diameter or radial size of the injector body.

The pressure sensing member 81 is made of a plate extending perpendicular to the axial direction of the injector body, thus avoiding an increase in dimension in the radial direction or thickness-wise direction of the injector body when the pressure sensing portion is installed inside the injector body.

The branch path diverges from the path extending from the fuel supply path 11*b* to the pressure control chambers 8 and 16*c*, thus eliminating the need for a special tributary for connecting the branch path to the fuel supply path 11*b*, which avoids an increase in dimension in the radial direction or thickness-wise direction of the injector body when the pressure sensing portion is installed inside the injector body.

The diaphragm 18*n* is located at a depth that is at least greater than the thickness of the strain sensing device below the surface of the pressure sensing member 81, thereby avoiding the exertion of the stress on the strain sensing device when the pressure sensing member 81 is assembled in the injector body, which enables the pressure sensing portion to be disposed in the injector body.

The injector body has formed therein the wire path, thus facilitating ease of layout of the wires. The connector 50 has installed therein the terminal pins 51*a* into which the signal to the coil 61 of the solenoid-operated valve device 7 (actuator) is inputted and the terminal pin 51*b* from which the signal from the pressure sensor 18*f* (displacement sensing means) is outputted, thus permitting steps for connecting with the external to be performed simultaneously.

Seventh Embodiment

Figure 12:
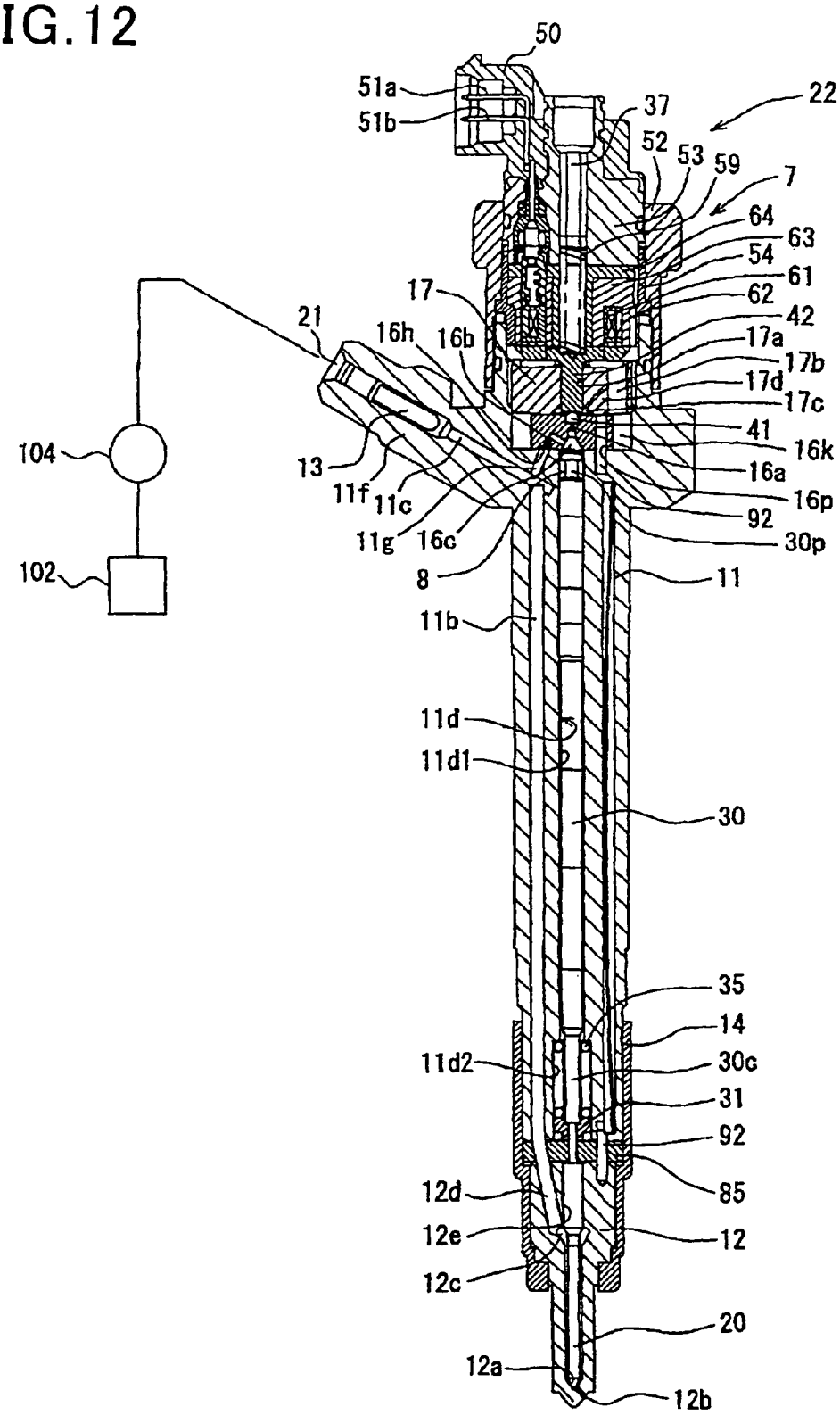
FIG. 12 is a sectional view of an injector for a fuel injection device according to the seventh embodiment.
Figure 13:
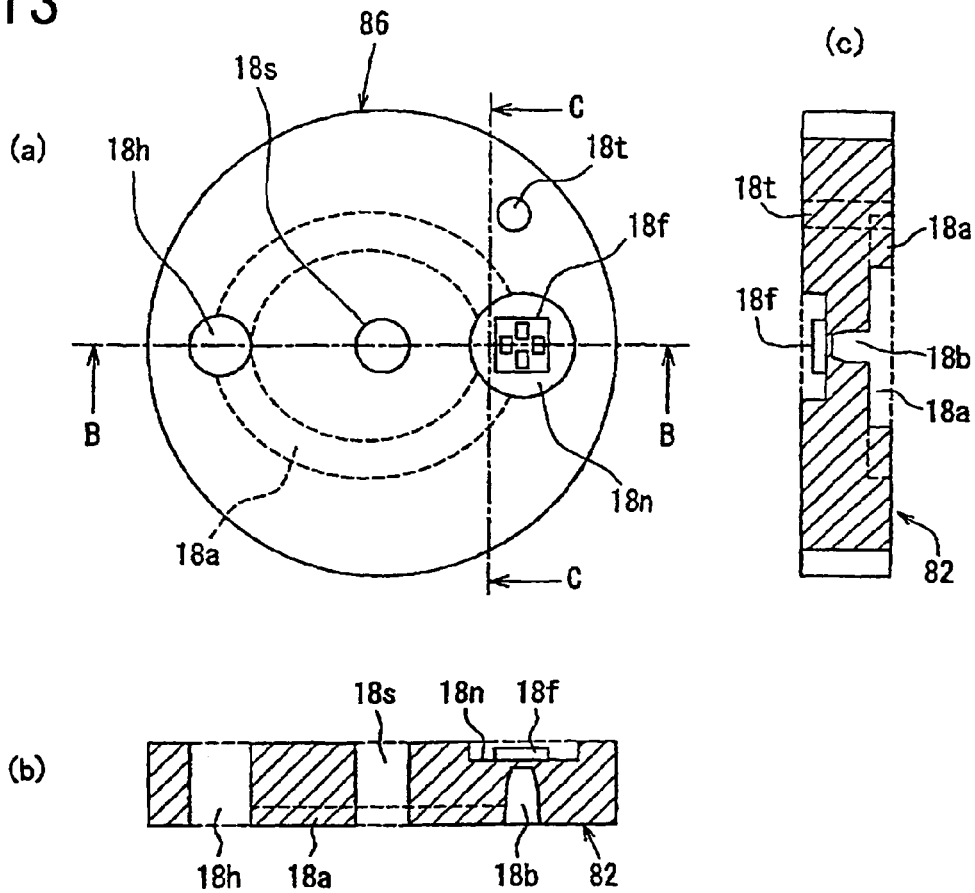
FIG. 13(*a*) is a plan view of a pressure sensing member of the seventh embodiment.

FIG. 12 is a sectional view which shows an injector 22 according to the seventh embodiment of the invention. FIGS. 13(*a*) to 13(*c*) are partial sectional and plane views which illustrate highlights of the pressure sensing member. The fuel injection device of this embodiment will be described below with reference to the drawings. The same reference numbers are attached to the same or similar parts as in the sixth embodiment, and explanation thereof in detail will be omitted here.

The seventh embodiment is equipped with the pressure sensing portion 85 instead of the pressure sensing portion 80 used in the sixth embodiment.

The injector 22, as can be seen in FIG. 12, includes the nozzle body 12 in which the nozzle needle 20 is disposed to be moveable in the axial direction, the lower body 11 in which the spring 35 working as an urging member to urge the nozzle needle 20 in the valve-closing direction, the pressure sensing portion 85 nipped between the nozzle body 12 and the lower body 11, the retaining nut 14 working as a fastening member to fasten the nozzle body 12 and the pressure sensing portion 85 together with a given degree of fastening force, and the solenoid-operated valve device 7 working as a fluid control valve.

The inlet 16*h* of the orifice member 16 is disposed at a location which establishes communication between the pressure control chamber 16*c* and the fuel supply branch path 11*g* diverging from the fuel supply path 11*b*. The pressure control chambers 8*c* and 16*c* of the orifice member 16 constitute a pressure control chamber.

The pressure sensor 85, as illustrated in FIGS. 13(*a*) to 13(*c*), preferably includes a pressure sensing member 86 made of a metallic disc plate (i.e., a second plate member) which extends substantially perpendicular to the axial direction of the fuel injector 2, i.e., the length of the control piston 30 (and the nozzle needle 20) and is nipped between the nozzle body 12 and the lower body 11. In this embodiment, the pressure sensing member 86 has an even or flat surface 82 placed in direct abutment with a flat surface of the nozzle body 12 in a liquid-tight fashion. The pressure sensing member 86 is substantially of a circular shape which is identical in contour with the nozzle body 12 side end surface of the lower body 11. The pressure sensing member 86 is so designed that the fuel supply path 11*b* of the lower body 11, the tip of the needle 30*c* of the control piston 30, and a inserted portion of a positioning pin 92*b* coincide with a sensing portion communication path 18*h*, a through hole 18*s*, and a positioning through hole 18*t*. The sensing portion communication path 18*h* communicates at a lower body-far side thereof with the fuel feeding path 12*d* in the nozzle body 12. The sensing portion communication path 18*h* of the pressure sensing portion 86 foils a portion of a path extending from the fuel supply path 11*b* to the fuel feeding path 12*d*.

The pressure sensing member 86 has a pressure sensing chamber 18*b* defined by a groove which has a given depth from the nozzle body 12-side and an inner diameter. The bottom of the groove defines the diaphragm 18*n*. A semiconductor pressure sensor 18*f*, as described in FIGS. 10 and 11, is attached to the surface of the diaphragm 18*n*. The diaphragm 18*n* is located at a depth that is at least greater than the thickness of the pressure sensing device 18*b* below the surface of the pressure sensing member 86 which is opposite the surface in which the pressure sensing chamber 18 is formed. The surface to which the pressure sensing device 18*f* is affixed is greater in area or diameter than the pressure sensing chamber 18*b*. The thickness of the diaphragm 18*n* is controlled by controlling depths of both the grooves located on both sides of the diaphragm 18*n* during the production process. The pressure sensing member 86 also has grooves 18*a* (branch paths below) formed in the flat surface 82 to have a depth smaller than the pressure sensing chamber 18*b*. The grooves 18*a* communicate between the sensing portion communication path 18*h* and the pressure sensing chamber 18*b*. In this embodiment, the grooves 18*a* (preferably, two grooves 18*a*) are formed on right and left sides of a portion into which the top of the needle 30*c* of the control piston 30 is inserted, thereby ensuring the efficiency in feeding the fuel from the fuel supply path 11*b* to the pressure sensing chamber 18*b*.

Like in the sixth embodiment, the pressure sensor 18*f* including the piezoresistors and a low-melting point glass constitutes a strain sensing device. The diaphragm 18*n* is located below the surface of the pressure sensing member 86 which is opposite the pressure sensing chamber 18*b* at a depth that is at least greater than the sum of thicknesses of the pressure sensing device 18*f* and the low-melting glass. In the case where the processing substrate 18*d* and the wires 18*e* are disposed in the thickness-wise direction, the pressure sensing chamber 18*b*-opposite surface of the diaphragm 18*n* is located at a depth greater than a total thickness of the pressure sensing device 18*f*, the low-melting glass, the processing substrate 18*d*, and the wires 18*e*.

This embodiment has the same advantages as in the sixth embodiment. Particularly, the seventh embodiment offers the following additional advantages.

The diaphragm 18*n* and the holes or the grooves 18*a* are provided in the pressure sensing member 86 which is separate from the injector body, thus facilitating the ease of formation of the diaphragm 18*n*. This results in the ease of controlling the thickness of the diaphragm 18*n* and improvement in measuring the pressure of fuel. The pressure sensing member 86 is stacked between the lower body 11 and the nozzle body 12, thus avoiding an increase in dimension of the injector body in the radius direction thereof. It is possible to measure the pressure of high-pressure fuel near the nozzle body 12, thus resulting in a decrease in time lag in measuring a change in pressure of fuel sprayed actually.

The branch path is provided in the metallic pressure sensing member 86 stacked between the lower body 11 and the nozzle body 12, thus eliminating the need for a special tributary for connecting the branch path to the fuel supply path 11*b* and the fuel feeding path 12*d*, which avoids an increase in dimension in the radial direction or thickness-wise direction of the injector body when the pressure sensing portion 85 is installed inside the injector body.

The diaphragm 18*n* is located at a depth that is at least greater than the thickness of the strain sensing device below the surface of the pressure sensing member 86, thereby avoiding the exertion of the stress on the strain sensing device when the pressure sensing member 86 is assembled in the injector body, which facilitates the installation of the pressure sensing portion in the injector body.

Eighth Embodiment

Figure 14:
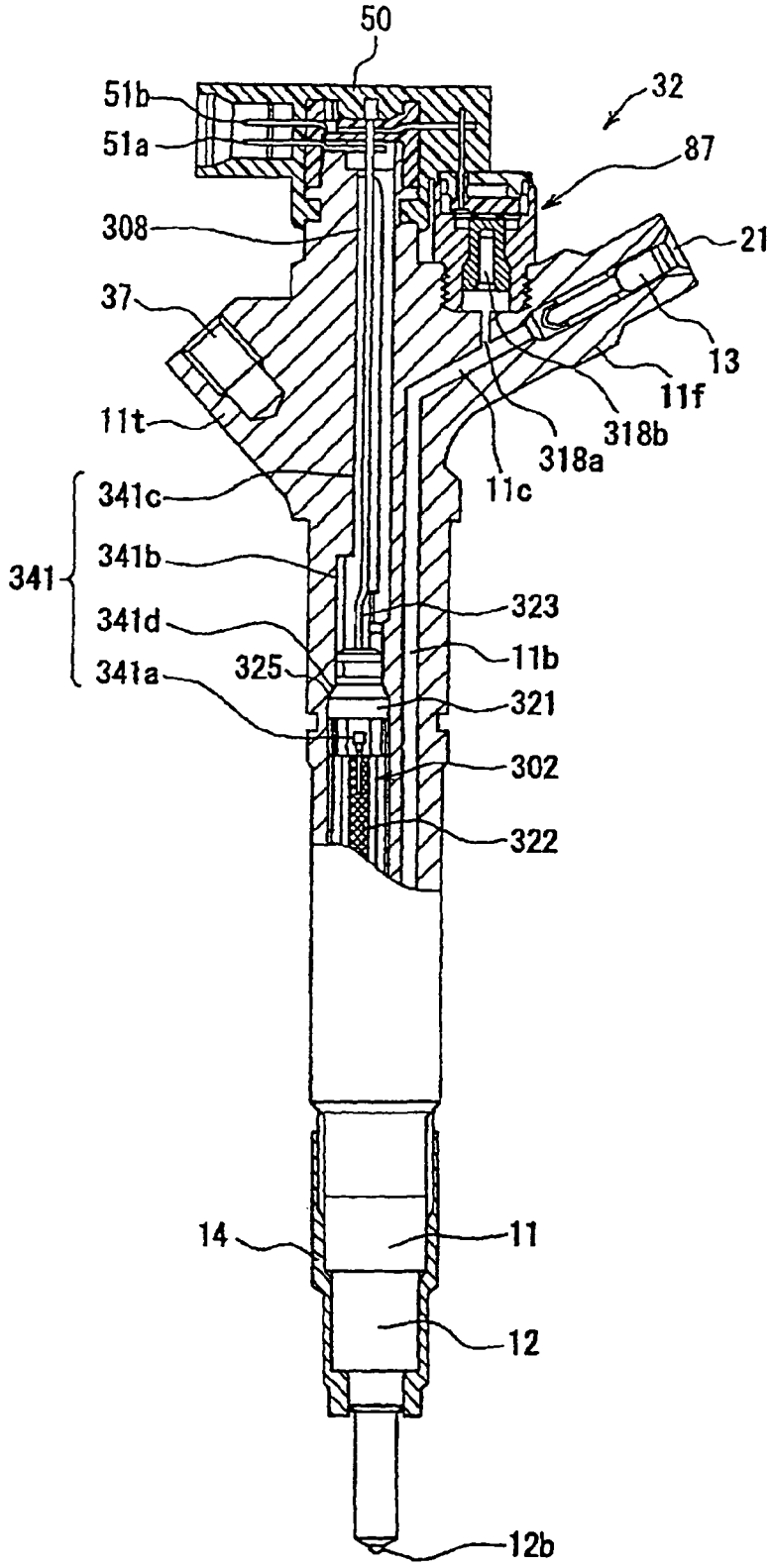
FIG. 14 is a sectional view of an injector for a fuel injection device according to the eighth embodiment.
Figure 15:
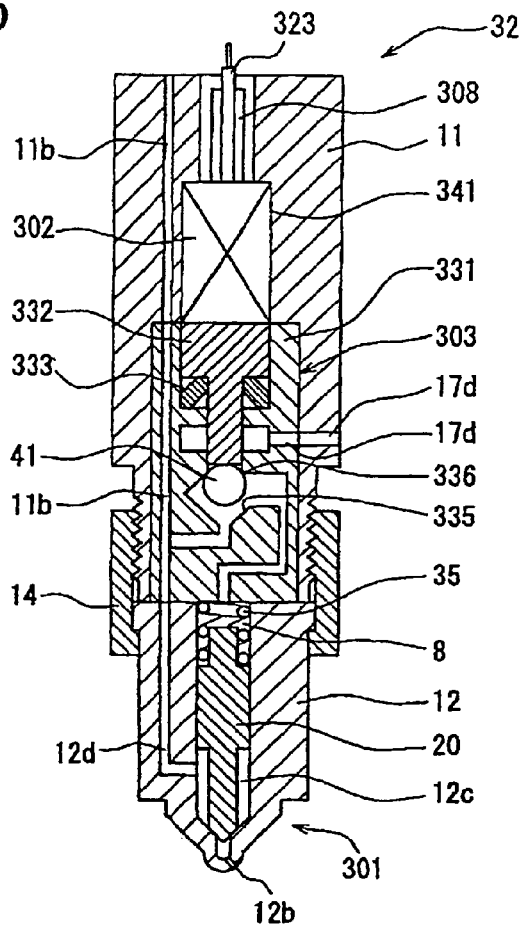
FIG. 15 is a sectional view of an injector for a fuel injection device according to the eighth embodiment.
Figure 16:
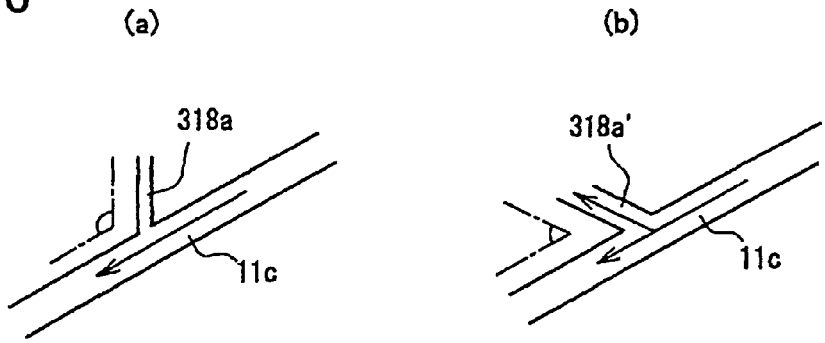
FIG. 16(*a*) is a schematic view to explain a structure of installation of a branch path according to the eighth embodiment.
Figure 17:
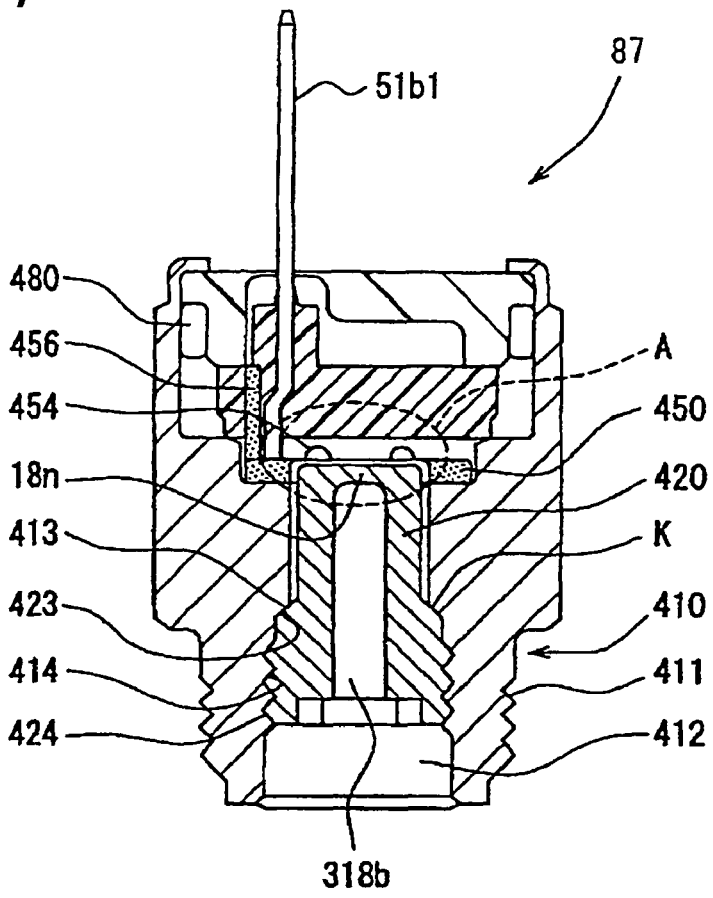
FIG. 17 is an enlarged view of a coupling according to the eighth embodiment.
Figure 18:
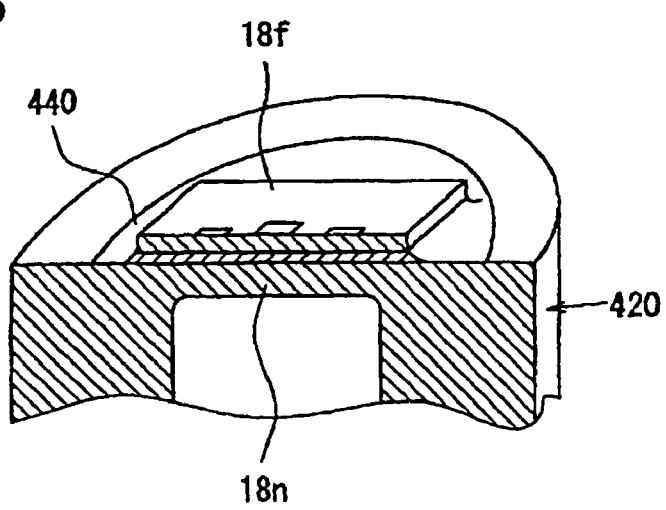
FIG. 18 is a partial sectional view of a diaphragm according to the eighth embodiment.
Figure 19:
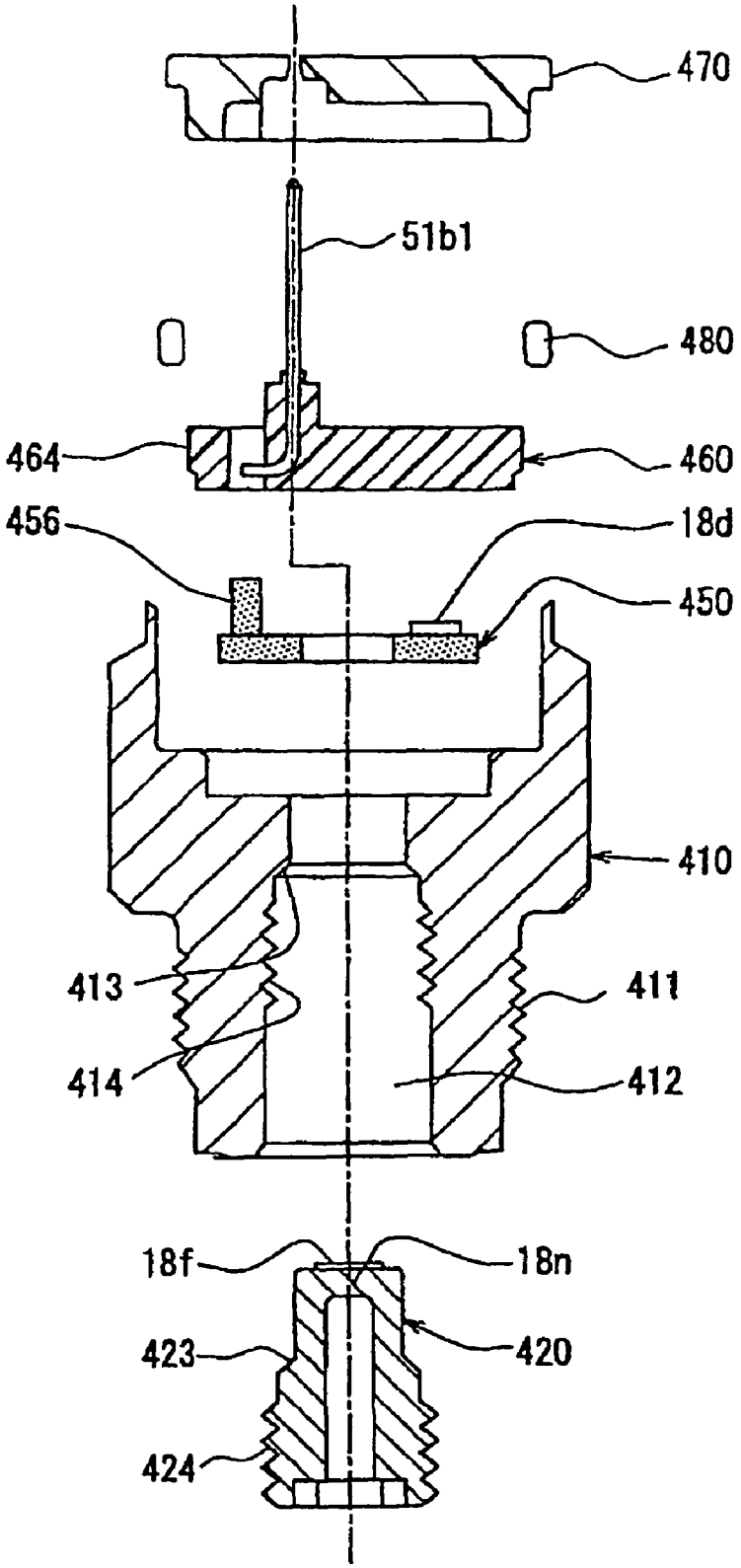
FIG. 19 is a sectional view to explain steps of installing a pressure sensing portion of the eighth embodiment.

The eighth embodiment of the invention will be described below. FIG. 14 is a partial sectional view of an injector for a fuel injection system according to the eighth embodiment of the invention. FIG. 15 is a schematic view which shows an internal structure of the injector of FIG. 14. FIG. 16 is a schematic view for explaining an installation structure for a branch path. FIG. 17 is an enlarged sectional view of a coupling. FIG. 18 is a partial sectional view of a diaphragm. FIG. 19 is a sectional view which shows steps of installing a pressure sensing portion. The same reference numbers are attached to the same or similar parts to those in the sixth or seventh embodiment, and explanation thereof in detail will be omitted here.

The eighth embodiment is different from the sixth embodiment in that the pressure sensing portion 87 is joined threadably to the coupling 11*f* instead of the pressure sensing portion 80 installed inside the lower body 11 (i.e., the injector body), and a control piston is driven by the piezo-actuator 302 instead of the solenoid-operated valve actuator.

The basic operation and structure of the injector 32 of this embodiment will be described with reference to FIGS. 14 and 15.

The injector 32, like in the sixth embodiment, includes the nozzle body 12 retaining therein the nozzle needle 20 to be movable in an axial direction, the injector body 11 retaining therein the spring 35 working as an urging member to urge the nozzle needle 20 in the valve-closing direction, the retainer (a retaining nut) 14 working as a fastening member to fastening the nozzle body 12 and the injector body 11 through an axial fastening pressure, the piezo-actuator (actuator) 302 constituting the back pressure control mechanism 303, and the pressure sensing portion 87 working to measure the pressure of high-pressure fuel. The nozzle body 12 is fastened to the injector body 11 by the retainer 14 to make a nozzle body of the injector made up of the nozzle body 12, the injector body 11, and the retainer 14. The needle 20 and the nozzle body 12 constitute the nozzle portion 301.

The injector body 11 has installed therein the first coupling 111 (which will be referred to as an inlet below) to which a high-pressure pipe (see FIG. 7) connecting with a branch pipe of the common rail 104 is joined in a liquid-tight fashion, and the second coupling 11*t* (outlet) which connects with the low-pressure fuel path 106 in a liquid-tight fashion to return the fuel back to the fuel tank 102. The inlet 11*f* has the fluid induction portion 21 that is an inlet port into which the high-pressure fuel, as supplied from the common rail 104, is introduced, and the fuel induction path 11*c* (corresponding to the second fluid path (i.e., a high-pressure path) through which the high-pressure fuel, as introduced into the fluid induction portion 21 is directed to the fuel supply path 11*b* (corresponding to the first fluid path (i.e., a high-pressure path). The bar-filter 13 is installed inside the fuel injection path 11*c*.

The coupling 111 of the injector body 11 has formed therein the fuel induction path 11*c* (i.e., the second fluid path) leading to the fuel supply path 11*b* (i.e., the first fluid path) which extends obliquely to the axial direction of the injector body 11. In terms of ease of installation, it is preferable that the fuel induction path 11*c* is inclined at 45° to 60° to the axial direction. The first coupling 11*f* has a branch path 318*a* which diverges from the fuel induction path 11*c* and extends substantially parallel to the axial direction of the injector body 11. Specifically, in this embodiment, the branch path 318*a*, as illustrated in FIG. 16(*a*), slants at a turned angle of 120° to 135° to a flow of the fuel within the fuel induction path 11*c* (i.e., an arrow in the drawing), as viewed with reference to the fluid injection path 11*c*. The branch path 318*a* extends preferably parallel to the axial direction of the injector body 11, but may be inclined thereto as long as the turned angle is greater than or equal to 90°.

Upon and after the fuel injection, the amount of fuel corresponding to that having been sprayed or discharged from the injector is supplied from the common rail 104 to the fuel induction path 11*c*. The pressure in the fuel induction path 11*c* is high, so that in the case, as illustrated in FIG. 16(*b*), where the branch path 318' is oriented at an angle smaller than 90° toward the direction of flow of the fuel in the fuel induction path 11*c*, in other words, the branch path 318' is connected to the fuel injection path 11*c* in the forward direction, it will cause the high-pressure to be always exerted into the branch path 318*a*' during the delivery of the fuel into the fuel induction path 11*c*, thus resulting in a small difference in pressure of the fuel between when the fuel is being sprayed and when the fuel is not sprayed. However, the turned angle greater than or equal to 90° causes the movement of the high-pressure fluid in the fuel induction path 11*c* during supply of the fuel to create an attraction which is exerted on the high-pressure fuel loaded into the branch path 318*a* and oriented toward a branch point (i.e., a joint) to the fuel induction path 11*c*. This also causes an additional attraction to be added to a drop in pressure in the high-pressure fuel in the same direction as such a pressure drop, thus resulting in an increased difference in pressure of the fuel between when the fuel is being sprayed and when the fuel is not being sprayed.

The second coupling 11*t* of the injector body 11 has a fuel release path (also called a leakage collection path) 37 as a low-pressure fuel path for returning the low-pressure fuel, as discharged from the back pressure control mechanism 303, back to a low-pressure pipe of the fuel tank (see FIG. 7).

The injector 32 is equipped with the nozzle portion 301 which sprays the fuel when being opened, the piezo-actuator 302 which expands or contracts when being charged or discharged, and the back pressure control mechanism 303 which is driven by the piezo-actuator 302 to control the back pressure on the nozzle portion 301.

The piezo-actuator 302 is made of a stainless steel-made cylindrical housing 321 within which a stack of a plurality of piezoelectric devices 322 are disposed. The piezoelectric devices 322 are connected to a power supply not shown through two lead wires 323. The lead wires 323 are retained by a holding member 302 which is higher in rigidity than the lead wires 323.

The holding member 308 is made of resin such as nylon smaller in hardness than metal in order to decrease the wear of a coating of the lead wires 323. The holding member 308 are made to have a shape and a thickness thereof which provide the rigidity higher than the lead wires 323.

Ends of the lead wires 323 extend so as to protrude partially from an upper end of the injector body 11 which is on the nozzle-opposite end side, that is, above the coupling 11*f*. The connector housing 50 with which the terminal pins 51*a* and 51*b* are molded integrally is installed in the upper portion of the injector body 11 to connect with the lead wires 323.

The nozzle portion 301 is, as illustrated in FIG. 15, made up of the nozzle body 12 in which the spray hole 11 is formed, the needle 20 which is moved into or out of abutment with a seat of the nozzle body 12 to close or open the spray hole 11, and the spring 35 urging the needle 13 in the valve-closing direction.

Within the valve body 331 of the back-pressure control mechanism 303, the piston 332, the disc spring 333, and the ball valve 334 are disposed. The piston 332 is moved following the stroke of the piezo-actuator 2. The disc spring 333 urges the piston 332 toward the piezo-actuator 302. The ball valve 434 is moved by the piston 332. The valve body 331 is illustrated in FIG. 15 as being made by a one-piece member, but is actually formed by a plurality of blocks.

The cylindrical metallic injector body 11 has the storage hole 341 extending from one end to the other end thereof in the injector axial direction. The piezo-actuator 302 and the back-pressure control mechanism 303 are disposed in the storage hole 341. The cylindrical retainer 14 is threadably connected to the injector body 11 to retain the nozzle portion 301 on the end of the injector body 11.

The nozzle body 12, the injector body 11, and the valve body 331 have formed therein the fuel supply path 11*b* and the fuel feeding path 12*d* to which the high-pressure fuel is supplied from the common rail at all the time. The injector body 11 and the valve body 331 have formed therein the low-pressure path 17*d* which is connected to the fuel tank (see FIG. 7) through the release path (also called a leakage collection path) 37.

The fuel sump (i.e., a high-pressure chamber) 12*c* is formed between the outer peripheral surface of the needle 20 on the spray hole 12*b*-side thereof and the inner peripheral surface of the nozzle body 12. The high-pressure chamber 12*c* is supplied with the high-pressure fuel through the fuel supply path 11*b* at all the time. The back pressure chamber 8 is formed as a pressure control chamber in the spray hole-far side of the needle 20. The above described spring 35 is disposed in the back pressure chamber 8.

The valve body 331 has the high-pressure seat 335 formed in a path communicating between the fuel supply path 11*b* in the valve body 331 and the back pressure chamber 8 of the nozzle portion 301. The low-pressure seat 336 is also formed in a path communicating between the low-pressure path 17*d* in the valve body 331 and the back pressure chamber 8 of the nozzle portion 301. The above described valve 41 is disposed between the high-pressure seat 335 and the low-pressure seat 336.

The storage hole 341 of the injector body 11 is, as illustrated in FIG. 14, made up of three cylindrical storage holes 341*a* to 341*c*. The first storage hole 341*a* opens at one end thereof into the nozzle side end surface of the injector body 11 and extends from the nozzle side end surface of the injector body 11 to the nozzle-far side of the injector body 11. The second storage hole 341*b* is smaller in diameter than the first storage hole 341*a* and extends from the nozzle-far side end portion of the first storage hole 341*a* to the nozzle-far side of the injector body 11. The first storage hole 341*a* and the second storage hole 341*b* are disposed coaxially with each other. The third storage hole 341*c* is disposed eccentrically from the first storage hole 341*a* and the second storage hole 341*b* and opens at one end thereof into the nozzle-far side end surface of the injector body 11 and connects at the other end thereof to the second storage hole 341*b*.

The piezo-actuator 302 is disposed within the first storage hole 341*a*. The lead wires 323 and the holding member 308 are disposed in the second storage hole 341*b* and the third storage hole 341*c*. The tapered seat surface 325 formed on the housing 323 of the piezo-actuator 302 is placed in abutment with the step 341*d* between the first and second storage holes 341*a* and 341*b* to position the piezo-actuator 302 in the injector body 11.

In the above structure, when the piezo-actuator 302 is in the contracted state, the valve 41 is, as illustrated in FIG. 15, placed in contact with the low-pressure seat 336 to communicate the back pressure chamber 8 with the fuel supply path 11*b*, so that the high-pressure fuel is introduced into the back pressure chamber 8. The fuel pressure in the back pressure chamber 8 and the spring 35 urge the needle 20 in the valve-closing direction to keep the spray hole 12*b* closed.

When the voltage is applied to the piezo-actuator 302, so that the piezo-actuator 302 is expanded, the valve 41 is brought into contact with the high-pressure seat 335 to communicate the back pressure chamber 8 to the low-pressure path 17*d*, so that the back pressure chamber 8 will be at a low pressure level. This causes the needle 20 to be urged in the valve-opening direction by the fuel pressure in the high-pressure chamber 12*c* to open the spray hole 12*b*, thereby spraying the fuel from the spray hole 12*b* into the cylinder of the internal combustion engine.

The structure of the pressure sensing portion 87 will be described in detail below with reference to FIGS. 17 to 19. FIG. 17 is a sectional view of the pressure sensing portion 87 of this embodiment. FIG. 18 is an enlarged perspective view of a portion A of the pressure sensing portion 87 (including sensor chips and a metallic stern), as enclosed by a broken line in FIG. 17.

The housing 410 is secured directly to the branch path 318*a*. The housing 410 has an external thread 411 formed on an outer periphery thereof for such installation. The housing 410 has formed therein a pressure induction path 412 which establishes fluid communication with the branch path 318*a* when the housing 410 is joined to the fuel induction path 11*c*, so that the pressure is introduced from the one end side (i.e., a lower side of the drawing).

The housing 410 may be made of carbon steel such as S15C which is high in corrosion-resistance and mechanical strength and plated with Zn for increasing the corrosion-resistance. The housing 410 may alternatively be made of XM7, SUS430, SUS304, or SUS630 which is high in corrosion-resistance.

The metallic stem 420 is made of a metallic hollow cylinder with steps and has a thin-walled end working as the diaphragm 18*n* and the pressure-sensing chamber 318*b* which introduces the pressure to the diaphragm 18*n*. The metallic stem 420 also has a tapered step 423 formed on an axially middle portion of an outer peripheral surface thereof. The other end side (i.e., the pressure sensing chamber 318*b* side) of the metallic stem 420 is greater in diameter than the one end side (i.e., the diaphragm 18*n* side) thereof through the step 432.

The pressure induction path 412 of the housing 410 is defined by a stepped inner hole contoured to conform with the outer contour of the metallic stem 424 and has an inner diameter of one end side thereof (i.e., a pressure induction side) as a large-diameter portion. On the inner surface of the pressure induction path 412, the tapered seat surface 413 is formed which corresponds to the step 432 of the metallic stem 420.

The metallic stem 420 also has an external thread 424 formed on the outer peripheral surface of the large-diameter portion thereof. The housing 410 has an internal thread 414 formed on the inner peripheral surface of the pressure induction path 412 which corresponds to the external thread 424. The metallic stem 420 is inserted into the pressure induction path 412 so that the other end side thereof (i.e., the pressure sensing chamber 318*b* side) may be located on the one end side of the pressure induction path 412. The external thread 424 engages the internal thread 414 to secure the metallic stem 420 to the housing 410.

The step 423 on the outer peripheral surface of the metallic stem 420 is pressed by the axial force produced by the above thread-to-thread engagement against the seat surface 413 formed on the inner surface of the pressure induction path 412 of the housing 410 from the other end side to the one end side of the metallic stem 420, so that it is sealed. This causes the pressure sensing chamber 318*b* of the metallic stem 420 to communicate with the pressure induction path 412. The step 432 and the seat surface 413 close to each other establishes the seal K, thereby ensuring the hermetic sealing between the communication portions of the pressure sensing chamber 318*b* and the pressure induction path 412.

The pressure sensor chip 18*f* is, as illustrated in FIG. 18, glued to an outer surface of the diaphragm 18*n* of the metallic stern 420 through a low-melting glass 440. The pressure sensor chip 18*f* is made from single-crystal silicon and works as a strain gauge to measure the deformation of the diaphragm 18*n* arising from the pressure of fuel transmitted from the pressure-sensing chamber 318*b* inside the metallic stem 420.

The material of the metallic stem 420 is required to have a mechanical strength high enough to withstand the super-high pressure of fuel and a coefficient of thermal expansion low enough to secure the joint of the Si-made pressure sensor chip 18*f* thereto using the glass 440. For instance, the metallic stem 420 is made by pressing, cutting, or cold-forging a mixture of main components Fe, Ni, Co or Fe and Ni and precipitation hardened components Ti, Nb, and Al or Ti and Nb.

The diaphragm 18*n* of the metallic stem 420 protrudes from the other end side of the pressure induction path 412 of the housing 410. The ceramic substrate 450 is bonded to the housing 410 around the outer periphery of the diaphragm 18*n*. The ceramic substrate 450 has the amplifier IC chip 18*d* working to amplify an output of the pressure sensor chip 18*f* and the characteristic adjustment IC chip 18*d* glued thereto. The characteristic adjustment IC chip 18*d* is equipped with a non-volatile memory storing therein pressure detection sensitivity data and data on injection characteristics of the fuel injector.

The IC chips 18*d* are connected electrically to conductors (wires) printed on the ceramic substrate 450 through aluminum wires 454 formed by the wire bonding. A pin 51*b*1 is joined to the conductor on the substrate 450 through silver solder. The pin 51*b*1 is connected electrically with the terminal pin 51*b*.

A connector terminal 460 that is an assembly made up of resin 464 and the pin 51*b*1 installed in the resin 464 by the insert molding and the substrate 450 are joined together by laser-welding the pin 51*b*1 to the pin 456 mounted on the substrate 450. The pin 51*b*1 is retained between the connector 50 and the housing 410. The pin 51*b*1 is joined to the terminal pin 51*b* of the connector 50 and to be connected electrically to an automotive ECU etc., through a harness (a wire member) along with the terminal pins 51*a* for the injector.

The connector holder 470 defines an outer shape of the terminal pins 51*b* and unified with the housing 410 secured thereto through the O-ring 480 as a package to protect the pressure sensor chip 18*f*, ICs, electric joints, etc. from moisture or mechanical impact. The connector holder 470 may be made of PPS (polyphenylene sulfide) which is highly hydrolysable.

The assembling of the pressure sensing portion 87 will be described below with reference to FIG. 19. FIG. 19 is a view which shows exploded parts before being assembled in a cross section corresponding to FIG. 17. Basically, the parts are assembled along a dashed line.

First, the metallic stern 420 to which the pressure sensor chip 18*f* is already bonded through the glass 440 is inserted into the one end side (i.e., a pressure induction side) of the pressure induction path 421 of the housing 410 from the one end side (i.e., the diaphragm 18*n* side) thereof. The metallic stem 420 is inserted while being rotated around the axis to achieve engagement between the external thread 424 and the internal thread 414.

The step 423 of the metallic stem 420 is placed close to the seat surface 413 of the housing 410 by the axial force, as produced by the thread-to-thread engagement, so that they are sealed hermetically to ensure the hermetic sealing between the communication portions of the pressure sensing chamber 318*b* of the metallic stem 420 and the pressure induction path 412 of the housing 410.

The ceramic substrate 450 on which the chips 18*d* and the pin 456 are fabricated is secured using adhesive to a portion of the housing 420 on other end side of the pressure induction path 412. The pressure sensor chip 18*f* is connected to the conductors on the substrate 450 through the fine wires 454 using the wire bonding technique.

The terminal pin 51*b*1 is joined to the pin 456 by laser welding (e.g., the YAG laser welding). Next, the connector holder 470 is fitted in the housing 410 through the O-ring 480. The end of the housing 410 is crimped to retain the connector holder 470 within the housing 410 firmly, thereby completing the pressure sensing portion 87, as illustrated in FIG. 17.

The pressure sensing portion 87 is mounted in the coupling 11*f* of the injector body by engaging the external thread 411 of the housing 410 with an internal thread formed in the coupling 11*f*. When the pressure of the fuel (i.e. the pressure of fluid) in the branch path 318*a* of the metallic stem 420 is introduced from the one end side of the pressure induction path 412 and directed from the pressure sensing chamber 318*a* of the metallic stem 420 inside the metallic stem 420 (i.e., the pressure sensing chamber 318*b*), it will cause the diaphragm 18*n* to deform as a function of such pressure.

The degree of deformation of the diaphragm 18*n* is converted by the pressure sensor chip 18*f* into an electric signal which is, in turn, processed by a sensor signal processing circuit on the ceramic substrate 450 to measure the pressure. The ECU 107 controls the fuel injection based on the measured pressure (i.e., the pressure of fuel).

The above structure provides the following beneficial effects, like in the sixth embodiment.

The diaphragm 18*n* made by the thin wall is disposed in the branch path which diverges from the fuel induction path 11*c*. This facilitates the ease of formation of the diaphragm 18*n* as compared with when the diaphragm 18*n* is made directly in a portion of an outer wall of the fuel injector near the fuel flow path, thus resulting the ease of controlling the thickness of the diaphragm 18*n* and increase in accuracy in measuring the pressure of fuel in the fuel.

The diaphragm 18*n* is made by the thinnest portion of the branch path, thus resulting in an increase in deformation thereof arising from a change in pressure of the fuel.

The pressure sensing portion 87 which is formed to be separate from the injector body 11 is used. The pressure sensing portion 87 has the diaphragm 18*n*, the hole, or the groove provided therein, thus facilitating the ease of machining the diaphragm 18*n*. This also results in ease of controlling the thickness of the diaphragm 18*n* to improve the accuracy in measuring the pressure of fuel.

The terminal pins 51*a* into which the signal to the piezo-actuator is inputted and the terminal pin 51*b* from which the signal from the pressure sensor 18*f* (displacement sensing means) is outputted are installed in the common connector 50, thus permitting steps for connecting with the external to be performed simultaneously.

Further, this embodiment has connecting means (i.e., thread means made up of the external thread on the housing side and the internal thread on the coupling 11*f* side) which extend from the outer wall of the coupling 11*f* to the fuel induction path 11*c* and corresponds to the housing of the pressure sensing portion 87, thus facilitating the installation of the pressure sensing portion 87 in the injector 32. The thread means also facilitates the ease of replacing the pressure sensing portion 87.

The branch path 318*a*, as illustrated in FIG. 16(*a*), slants at a turned angle of 120° to 135° to a flow of the fuel within the fuel induction path 11*c* (i.e., an arrow in the drawing), as viewed with reference to the fluid injection path 11*c*. This causes the movement of the high-pressure fluid in the fuel induction path 11*c* during supply of the fuel to create an attraction which is exerted on the high-pressure fuel loaded into the branch path 318*a*' and oriented toward a branch point at the fluid path. This also causes an additional attraction to be added to a drop in pressure in the high-pressure fuel in the same direction as such a pressure drop, thus resulting in an increased difference in pressure of the fuel between when the fuel is being sprayed and when the fuel is not being sprayed.

The branch path 318 extends substantially parallel to the axial direction of the injector body 11, thus avoiding the protrusion of the pressure sensing portion 87 in the radius direction of the injector body 11 over the coupling 11*f*, that is, an increase in dimension in the radius direction.

Ninth Embodiment

Figure 20:
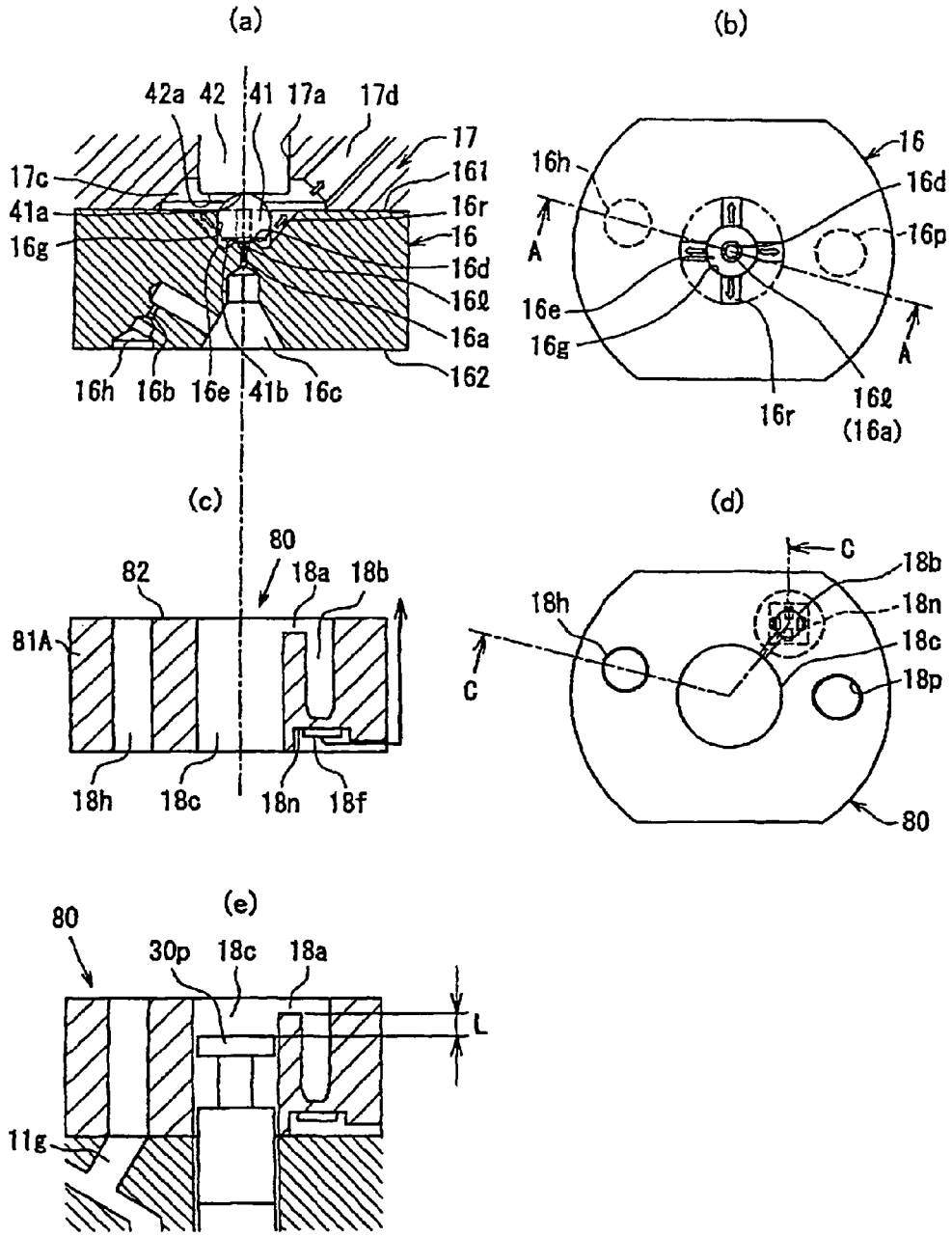
FIG. 20(*a*) is a partial sectional view which shows highlights of an orifice member according to the ninth embodiment.

The ninth embodiment of the invention will be described below, FIGS. 20(*a*) and 20(*b*) are a partial sectional view and a plane view which show highlights of a fluid control valve of this embodiment. FIGS. 20(*c*) and 20(*d*) are a partial sectional view and a plane view which show highlights of a pressure sensing member. FIG. 20(*e*) a sectional view which shows a positional relation between a control piston and the pressure sensing member when being installed in an injector body. The same reference numbers are attached to the same or similar parts to those in the sixth to eighth embodiments, and explanation thereof in detail will be omitted here.

In the ninth embodiment, instead of the pressure sensing member 81 used in the sixth embodiment, the pressure sensing member 81A, as illustrated in FIGS. 20(*c*) and 20(*d*), is used. Other arrangements, functions, and beneficial effects including the orifice member 16 of this embodiment, as illustrated in FIGS. 20(*a*) and 20(*b*), are the same as those in the sixth embodiment.

The pressure sensing member 81A of this embodiment is, as shown in FIGS. 20(*c*) and 20(*d*), made of the pressure sensing member 81A which is separate from the injector body (i.e., the lower body 11 and the valve body 17). The pressure sensing member 81A is preferably made by a metallic plate (second member) disposed substantially perpendicular to the axial direction of the injector 2, that is, the length of the control piston 30 and stacked directly or indirectly on the orifice member 16 in the lower body 11 to be retained integrally with the lower body 11 and the nozzle body 12.

In this embodiment, the pressure sensing member 81A has the flat surface 82 placed in direct surface contact with the flat surface 162 of the orifice member 16 in the liquid-tight fashion. The pressure sensing member 81A and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81, respectively. The orifice member-far side of the sensing portion communication path 18*h* opens at a location corresponding to the fuel supply branch path 11*g* diverging from the fuel supply path 11*b*. The through hole 18*h* of the pressure sensing member 81 forms a portion of the path from the fuel supply path 11*b* to the pressure control chambers 16*c* and 18*c*.

The pressure sensing member 81A is also equipped with the pressure sensing chamber 18*b* defined by a groove formed therein which has a given depth from the orifice member 16 side and inner diameter. The bottom of the groove defines the diaphragm 18*n*. The diaphragm 18*n* has the semiconductor sensing device 18*f*, as illustrated in FIG. 10, affixed or glued integrally to the surface thereof opposite the pressure sensing chamber 18*b*.

The diaphragm 18*n* is located at a depth that is at least greater than the thickness of the pressure sensor 18*f* below the surface of the pressure sensing member 81 which is opposite the pressure sensing chamber 18*b*. The surface of the diaphragm 18*n* to which the pressure sensor 18*f* is affixed is greater in diameter than the pressure sensing chamber 18*b*. The thickness of the diaphragm 18*n* is determined during the production thereof by controlling the depth of both grooves sandwiching the diaphragm 18*n*. The pressure sensing member 81 also has the groove 18*a* (a branch path below) formed in the flat surface 82 to have a depth smaller than the pressure sensing chamber 18*b*. The groove 18*a* communicates between the sensing portion communication path 18*h* and the pressure sensing chamber 18*b*. When the pressure sensing member 81A is placed in surface abutment with the orifice member 16, the groove 18*a* defines a combined path (a branch path below) whose wall is a portion of the flat surface of the orifice member 16. This establishes fluid communications of the groove 18*a* (i.e., the branch path) at a portion thereof with the pressure control chambers 16*c* and 18*c* at a location away from the through hole 18*h* and at another portion thereof with the diaphragm 18*n*, so that the diaphragm 18*n* may be deformed by the pressure of high-pressure fuel flowing into the pressure sensing chamber 18*b*.

The diaphragm 18*n* is the thinnest in wall thickness among the combined path formed between the groove 18*a* and the orifice member 16 and the pressure sensing chamber 18*b*. The thickness of the combined path is expressed by the thickness of the pressure sensing member 81 and the orifice member 16, as viewed from the inner wall of the combined path.

As illustrated in FIG. 20(*e*), the outer end wall (i.e., an upper end) 30*p* of the control piston 30, the orifice member 16, and the is pressure sensing member 81A define the pressure control chambers 16*c* and 18*c*. The outer end wall 30P is so disposed that it lies flush with the lower end of the groove 18*a* or is located at a distance L away from the lower end of the groove 18*a* toward the spray hole 12*b* when the spray hole 12*b* is opened. Specifically, when the spray hole 12*b* is opened (i.e., the control piston 30 is lifted up toward the valve member 41), the outer end wall 30*p* is disposed inside the pressure control chamber 18*c* of the pressure sensing member 81A.

In the case where the outer end wall 30*p* of the control piston 30 is located farther from the spray hole 12*b* than the groove 18*a* when the spray hole 12*b* is opened, the control piston 30 may cover the groove 18*a*. In such an event, it is possible for the pressure sensor to measure a change in pressure in the pressure control chambers 16*c* and 18*c* only after the pressure in the pressure control chambers 16*c* and 18*c* rises to move the control piston 30 in the valve-closing direction, and the groove 18*a* is opened. This results in a loss of time required to measure the pressure. However, in this embodiment, the outer end wall 30*p* is located, as described above, so that the branch path is placed in communication with the pressure control chamber at all the time when the spray hole 12*b* is opened. Needless to say, the control piston 30 is returned back toward the spray hole side upon the valve opening, the outer end wall 30*p* will be located closer to the spray hole 12*b* than the groove 18*a* by the distance L plus the amount of lift. It is advisable that the outer end wall 30*p* be disposed inside the pressure control chamber 18*c* of the pressure sensing member 81A upon the valve closing for avoiding the catch of the outer end wall 30*p* near a contact surface between the pressure sensing member 81A and the pressure control chamber 18*c* when passing it.

In the above embodiment, the chamber 16*c* formed inside the orifice member 16 and the chamber 18*c* formed inside the pressure sensing member 81A define the pressure control chambers 16*c* and 18*c*. In operation, a portion of the high-pressure fuel is supplied to and accumulated in the pressure control chambers 16*c* and 18*c*, thereby producing force in the pressure control chambers 16*c* and 18*c* which urges the nozzle needle 20 in the valve-closing direction to close the spray hole 12*b*. This stops the spraying of the fuel. When the high-pressure fuel, as accumulated in the pressure control chambers 16*c* and 18*c*, is discharged so that the pressure therein drops, the nozzle needle is opened, thereby initiating the spraying of the fuel from the spray hole. Therefore, the time the internal pressure in the pressure control chambers 16*c* and 18*c* changes coincides with that the fuel is sprayed form the spray hole.

Accordingly, in this embodiment, the diaphragm 18*n* is connected indirectly to the pressure control chambers 16*c* and 18*c* through the groove 18*a* to achieve the measurement of a change in displacement of the diaphragm 18*n* using the pressure sensor 18*f* (i.e., displacement sensing means), thereby ensuring the accuracy in measuring the time when the fuel is sprayed actually from the spray hole 12*b*. For instance, the quantity of fuel having been sprayed actually from each injector in the common rail system may be known by calculating a change in pressure of the high-pressure fuel in the injector body and the time of such a pressure change. In this embodiment, a change in pressure in the pressure control chambers 16*c* and 18*c* is measured, thus ensuring the accuracy in measuring the time of the pressure change as well as the degree of the pressure change itself (i.e., an absolute value of the pressure or the amount of the change in pressure) with less time lag.

The pressure sensing body 81A may be, like in the sixth embodiment, made of Kovar that is an Fi—Ni—Co alloy, but is made of a metallic glass material in this embodiment. The metallic glass material is a vitrified amorphous metallic material which has no crystal structure and is low in Young's modulus and thus is useful in improving the sensitivity of measuring the pressure. For instance, a Fe-based metallic glass such as {Fe (Al, Ga) (P, C, B, Si, Ge)}, an Ni-based metallic glass such as {Ni—(Zr, Hf, Nb)—B}, a Ti-based metallic glass such as {Ti—Zr—Ni—Cu}, or a Zr-based metallic glass such as Zr—Al—TM (TM:VI~VIII group transition metal).

The orifice member 6 is preferably made of a high-hardness material because the high-pressure fuel flows therethrough at high speeds while hitting the valve ball 41 many times. Specifically, the material of the orifice member 16 is preferably higher in hardness than that of the pressure sensing member 81A.

In this embodiment, the groove 18*a* is formed at a location in the inner wall of the pressure control chambers 16*c* and 18*c* which is different (i.e., away) from that of the inner orifice 16*b* and the outer orifice 16*a*. In other words, the groove 18*a* is formed on the pressure sensing member 81A side away from a high-pressure fuel flow path extending from the inner orifice 16*b* to the outer orifice 16*a*. The flow of the high-pressure fuel within the inner orifice 16*b* and the outer orifice 16*a* or near openings thereof is high in speed, thus resulting in a time lag until a change in pressure is in the steady state.

Instead of the groove 18*a* of FIG. 20(*c*), a hole (not shown), like in the modification illustrated in FIG. 9(*e*), may be formed which is so inclined as to extend from the pressure control chamber 18*c* of the pressure sensing member 81A to the pressure sensing chamber 18*b*.

The above structure of the embodiment enables the pressure sensing portion to be disposed inside the injector and posses the following beneficial effects, like in the sixth embodiment.

The diaphragm 18*n* made of a thin wall is provided in the branch path diverging from the fuel supply path 11*b*, thus facilitating the ease of formation of the diaphragm 18*n* as compared with when the diaphragm 18*n* is made directly in any portion of an injector outer wall near a fuel flow path extending therein. This results in ease of controlling the thickness of the diaphragm 18*n* and an increase in accuracy in measuring the pressure.

The diaphragm 18*n* is made by a thinnest portion of the branch path, thus resulting in an increase in deformation thereof arising from a change in the pressure.

The pressure sensing body 81A which is separate from the injector body (i.e., the lower body 11 and the valve body 17) has the diaphragms 18*n*, the holes, or the groove, thus facilitating the ease of machining the diaphragm 18*n*. This results in ease of controlling the thickness of the diaphragm 18*n* to improve the accuracy in measuring the pressure of fuel.

The pressure sensing member 81A including the diaphragm 18*n* is stacked on the orifice member 16 constituting the part of the pressure control chambers 8*c* and 16*c*, thereby avoiding an increase in diameter or radial size of the injector body.

The pressure sensing member 81A is made of a plate extending perpendicular to the axial direction of the injector body, thus avoiding an increase in dimension in the radial direction or thickness-wise direction of the injector body when the pressure sensing portion is installed inside the injector body.

The branch path diverges from the path extending from the fuel supply path 11*b* to the pressure control chambers 16*c* and 18*c*, thus eliminating the need for a special tributary for connecting the branch path to the fuel supply path 11*b*, which avoids an increase in dimension in the radial direction or thickness-wise direction of the injector body when the pressure sensing portion is installed inside the injector body.

The diaphragm 18*n* is located at a depth that is at least greater than the thickness of the strain sensing device below the surface of the pressure sensing member 81A, thereby avoiding the exertion of the stress on the strain sensing device when the pressure sensing member 81A is assembled in the injector body, which enables the pressure sensing portion to be disposed in the injector body.

The injector body has formed therein the wire path, thus facilitating ease of layout of the wires. The connector 50 has installed therein the terminal pins 51*a* into which the signal to the coil 61 of the solenoid-operated valve device 7 (actuator) is inputted and the terminal pin 51*b* from which the signal from the pressure sensor 18*f* (displacement sensing means) is outputted, thus permitting steps for connecting with the external to be performed simultaneously.

Tenth Embodiment

Figure 21:
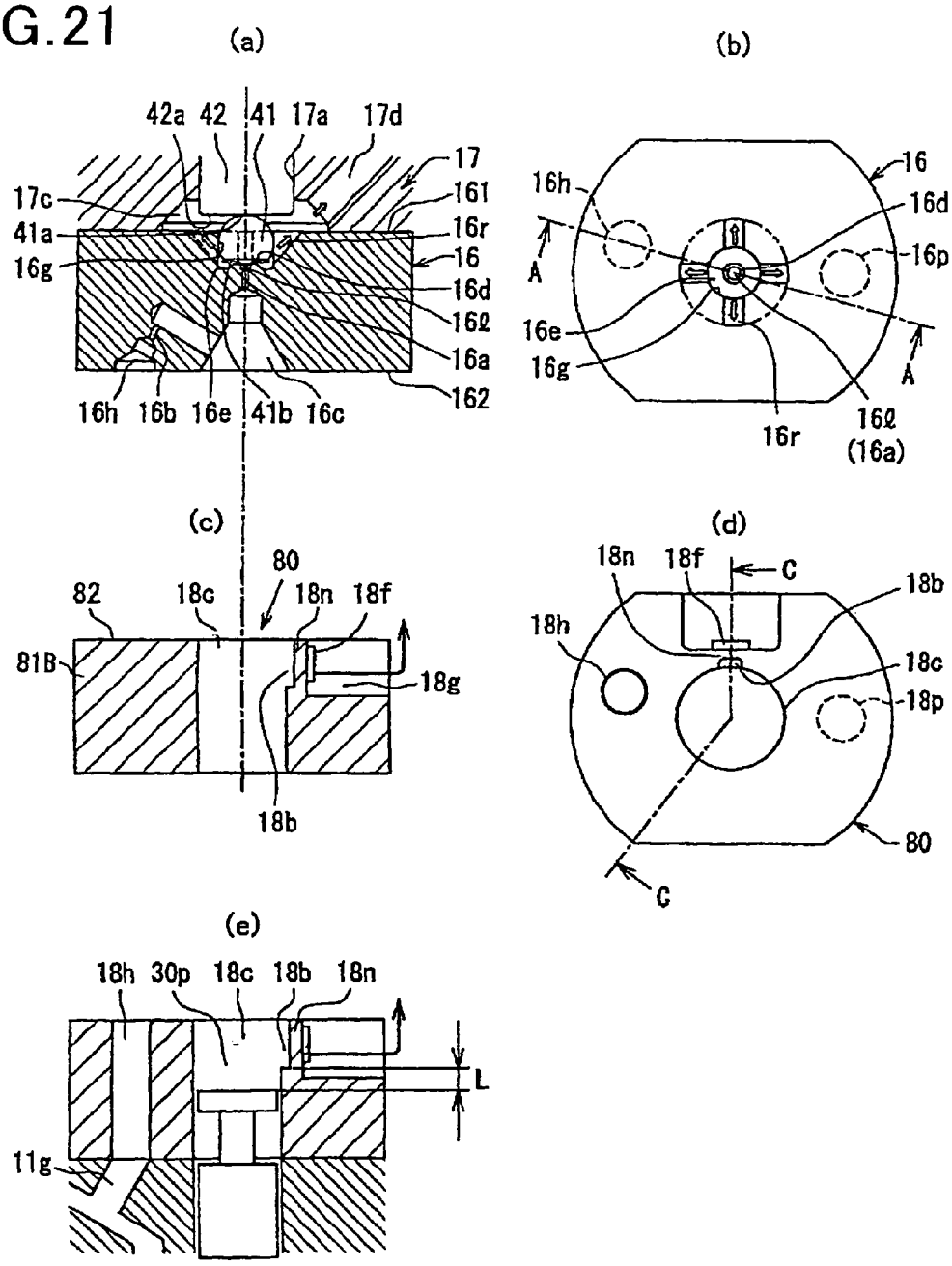
FIG. 21(*a*) a partial sectional view which shows highlights of an orifice member according to the tenth embodiment.

The tenth embodiment of the invention will be described below. FIGS. 21(*a*) and 21(*b*) are a partial sectional view and a plane view which show highlights of a fluid control valve of this embodiment. FIGS. 21(*c*) and 21(*d*) are a partial sectional view and a plane view which show highlights of a pressure sensing member. FIG. 21(*e*) a sectional view which shows a positional relation between a control piston and the pressure sensing member when being installed in an injector body. The same reference numbers are attached to the same or similar parts to those in the sixth to ninth embodiments, and explanation thereof in detail will be omitted here.

In the tenth embodiment, instead of the pressure sensing member 81A used in the ninth embodiment, the pressure sensing member 818, as illustrated in FIGS. 21(*c*) and 21(*d*), is used. Other arrangements, functions, and beneficial effects including the orifice member 16 of this embodiment, as illustrated in FIGS. 21(*a*) and 21(*b*), are the same as those in the sixth embodiment.

The pressure sensing member 81B of this embodiment is, as shown in FIGS. 21(*c*) and 21(*d*), made as being separate from the injector body. The pressure sensing member 81B is made by a metallic plate (second member) disposed substantially perpendicular to the axial direction of the injector 2 and stacked on the orifice member 16 in the lower body 11 to be retained integrally with the lower body 11.

Also, in this embodiment, the pressure sensing member 81B has the flat surface 82 placed in direct surface contact with the flat surface 162 of the orifice member 16 in the liquid-tight fashion. The pressure sensing member 81B and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81B, respectively. The orifice member-far side of the sensing portion communication path 18*h* opens at a location corresponding to the fuel supply branch path 11*g* diverging from the fuel supply path 11*b*.

The pressure sensing member 81B of this embodiment, unlike the pressure sensing member 81A of the ninth embodiment, has the diaphragm 18*n* made of a thin wall provided directly in the pressure control chamber 18*c*, Specifically, the diaphragm (i.e., the thin wall) 18*n* is formed between the recess (i.e., a pressure sensing chamber) 18*b* formed directly in an inner wall of the pressure control chamber 18*c* and the depression 18*g* oriented from the outer wall of the pressure sensing member 81B to the pressure control chamber 18*c*. On the bottom surface of the depression 18*b* of the diaphragm 18*n* which is opposite the pressure control chamber 18*c*, the semiconductor pressure sensor 18*f*, as illustrated in FIG. 10, is affixed integrally.

The depth of the depression 18*b* is at least greater than the thickness of the pressure sensor 18*f*. The depression 18*g* is greater in diameter than the recess 18*b* in the pressure control chamber 18*c*. The thickness of the diaphragm 18*n* is determined by controlling the depth of the recess 18*b* and the depression 18*g* during the formation thereof.

In this embodiment, the diaphragm 18*n* is, as described above, made of the thin-walled portion of the inner wall defining the pressure control chamber 18*c*, thereby possessing the same effects as those in the tenth embodiment. Specifically, it is possible for the pressure sensor 18*f* to measure a change in pressure in the pressure control chamber 18*c* without any time lag.

Also, in this embodiment, as illustrated in FIG. 21(*e*), the outer end wall 30*p* is so disposed that it lies flush with the lower end of the recess 18*b* or is located at a distance L away from the lower end of the recess 18*b* toward the spray hole 12*b* when the spray hole 12*b* is opened. This causes the pressure of the high-pressure fuel introduced into the pressure control chamber 18*c* when the spray hole 12*b* is opened is exerted on the recess 18*b* formed in the inner to wall of the pressure control chamber 18*c* without any problem, thereby ensuring the accuracy in measuring the pressure of the high-pressure fuel in the pressure control chamber 18*c* using the pressure sensor 18*f*.

Also, in this embodiment, the thin-walled portion working as the diaphragm 18*n* is formed in the inner wall of the pressure control chambers 16*c* and 18*c*. The pressure sensor 18*f* senses the displacement of the diaphragm 18*n*, thereby ensuring the accuracy in finding the time the fuel has been sprayed actually from the spray hole 12*b*.

In this embodiment, the diaphragm 18*n* is defined by the portion of the inner wall of the pressure control chambers 16*c* and 18*c*. The location of the diaphragm 18*n* is away from the inner orifice 16*b* and the outer orifice 16*a*, thereby minimizing the adverse effects of a high-speed flow of the high-pressure fuel within the inner orifice 16*b* and the outer orifice 16*a* or near openings thereof, thus enabling a change in the pressure in a region where the flow in the pressure control chambers 16*c* and 18*c* is in the steady state.

Other operations and effects are the same as in the tenth embodiment, and explanation thereof in detail will be omitted here. Also, in this embodiment, the pressure sensing member 81B may be made of a metallic glass.

In this embodiment, the high-pressure path (the fluid path) through which the high-pressure fuel flows to the spray hole 12*b* are made up of the fuel induction path 11*c*, the fuel supply path 11*b*, and the fuel feeding path 12*d*. The branch path diverging from the high-pressure path (i.e., the fluid path) to introduce the high-pressure fuel to the pressure sensing portion 80 is made up of the fuel supply branch path 11*g*, the sensing portion communication path 18*h*, the inlet 16*h*, and the inner orifice 16*b*. Specifically, the branch path of this embodiment is a path which diverges from the fluid induction portion 21 that is the inlet to which the high-pressure fuel is introduced and directs the fuel to the pressure control chamber 16*c*.

Eleventh Embodiment

Figure 22:
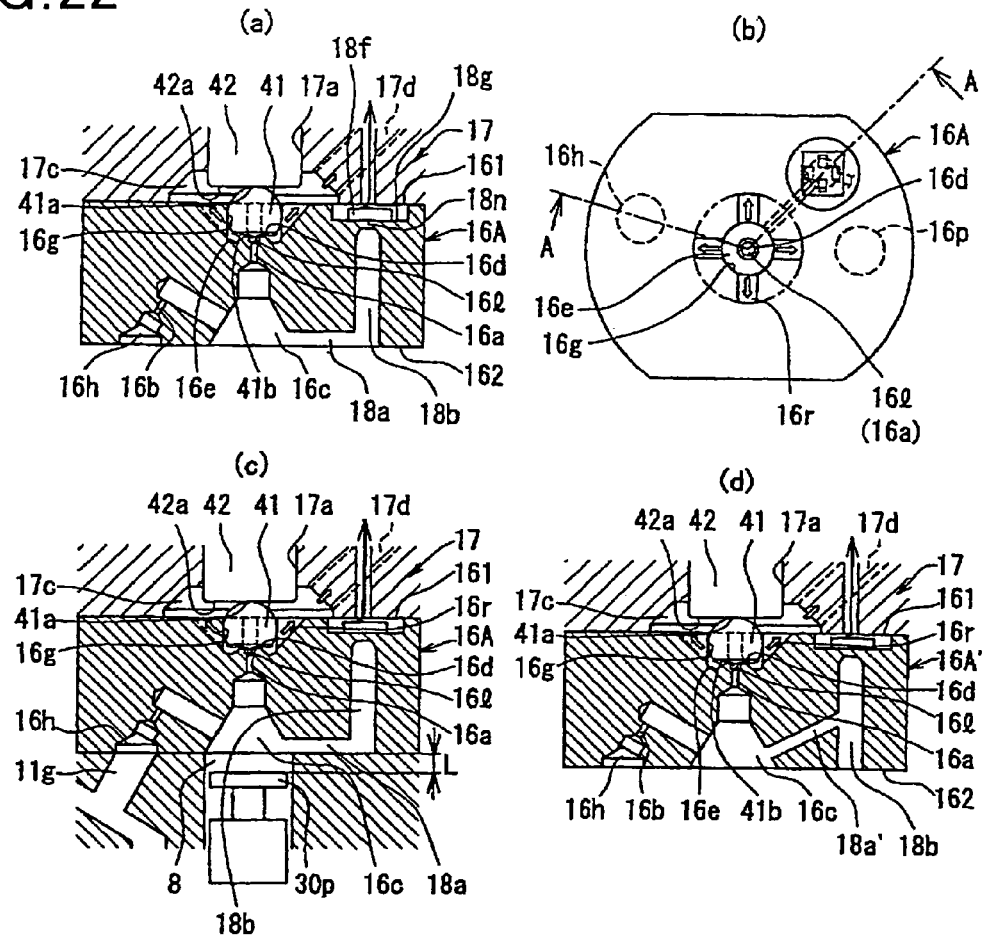
FIG. 22(*a*) is a partial sectional view which shows highlights of an orifice member (pressure sensing member) of an injector for a fuel injection device according to the eleventh embodiment.

The eleventh embodiment of the invention will be described below. FIGS. 22(*a*) and 22(*b*) are a partial sectional view and a plane view which show highlights of a fluid control valve (i.e., the pressure sensing member) of an injector for a fuel injection system in the eleventh embodiment. FIG. 22(*c*) is a sectional view which shows a positional relation between a control piston and the pressure sensing member when being installed in an injector body. The same reference numbers are attached to the same or similar parts to those in the sixth to tenth embodiments, and explanation thereof in detail will be omitted here.

In the sixth to tenth embodiments, the pressure sensing portions 80, 85, and 87 working to measure the pressure of the high-pressure fuel are provided in the pressure sensing members 81, 81A, 81B, and 86 which are separate from the orifice member 16. In contrast to this, this embodiment has the structure functioning as the pressure sensing portion 80 installed in the orifice member 16A.

The specific structure of the orifice member 16A of this embodiment will be described with reference to drawings. The orifice member 16A of this embodiment is, as illustrated in FIGS. 22(*a*) and 22(*b*), made of a metallic plate oriented substantially perpendicular to the axial direction of the injector 2. The orifice member 16A is formed as being separate from the lower body 11 and the nozzle body 12 defining the injector body. After formed, the orifice member 16A is installed and retained in the lower body 11 integrally.

The orifice member 16A, like the orifice member 16 of the sixth embodiment, has the inlet 16*h*, the inner orifice 16*b*, the outer orifice 16*a*, the pressure control chamber 16*c*, the valve seat 16*d*, and the fuel leakage grooves 16*r* formed therein. Their operations are the same as in the orifice member 16 of the sixth embodiment.

However, in this embodiment, the orifice member 16A is equipped with the groove 18*a* which connects the pressure sensing chamber 18*b* and the pressure control chamber 16*c* and which is formed on the flat surface 162, like the pressure sensing chamber 18*b* defined by the groove or hole formed in the flat surface 162 of the orifice member 16A on the valve 41-far side.

Figure 25:
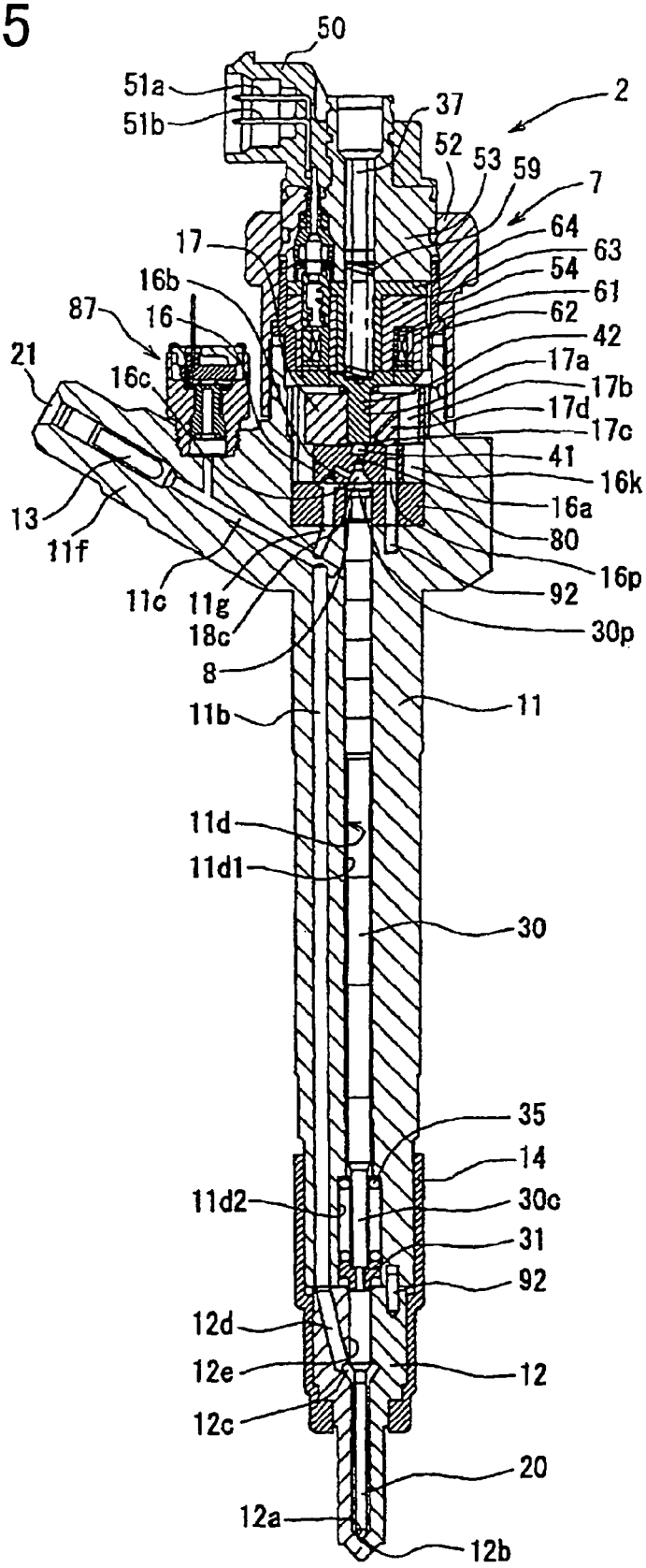
FIG. 25 is a sectional view of an injector according to the fourteenth embodiment.

The depression 18*g* for installation of the semiconductor pressure sensor 18*f* is formed at a location in the valve body side end surface 16*l* of the orifice member 16A which corresponds to the location of the pressure sensing chamber 18*b*. In this embodiment, a portion of the orifice member 16A between the pressure sensing chamber 18*b* and the depression 18*g* on which the pressure sensor 18*f* is installed defines the diaphragm 18*n* which deforms in response to the high-pressure fuel. As illustrated in FIG. 25(*a*), the valve body 17 has formed therein a wire path through which electric wires that are signal lines extend from the pressure sensor 18*f* to the connector 50. The wire path has an opening exposed to the depression 18*f* on which the pressure sensor 18*f* is fabricated.

The surface of the diaphragm 18*n* (i.e., the bottom of the depression 18*g*) which is far from the pressure sensing chamber 18*b* is located at a depth that is at least greater than the thickness of the pressure sensor 18*f* below the valve body-side end surface of the orifice member 16A and is greater in diameter than the pressure sensing chamber 18*b*-side surface thereof. The thickness of the diaphragm 18*n* is determined during the production thereof by controlling the depth of both grooves sandwiching the diaphragm 18*n*.

The orifice 16A has the groove 18*a* formed in the flat surface 162 on the valve 41-far side thereof at a depth greater than that of the pressure sensing chamber 18*b*. The groove 18*a* communicates between the pressure control chamber 16*c* and the pressure sensing chamber 18*b*. The orifice member 16A of this embodiment is placed in surface-contact with the lower body 11, not the pressure sensing member, so that the groove 18*a* defines a combined path (a branch path below) whose wall is a portion of the upper end surface of the lower body 11. This causes the high-pressure fuel, as entering the pressure control chamber 16*c* through the groove 18*a* (i.e., the branch path) to flow into the pressure sensing chamber 18*b*.

When the orifice member 16A is laid to overlap the lower body 11, the inlet 16*h*, the through hole 16*p*, the pressure control chamber 16*c* coincide with the fuel supply path 11*g* diverging from the fuel supply path 11*b*, a bottomed hole (not shown), and the pressure control chamber 8 of the lower body 11, respectively. The inlet 16*h* and the inner orifice 16*b* of the orifice member 16A define a portion of the path extending from the fuel supply path 11*b* to the pressure control chamber 16*c*.

The adoption of the above structure in this embodiment provides the same operations and effects as those in the tenth embodiment. Particularly, in this embodiment, the orifice 16A is designed to perform the function of the pressure sensing portion, thus eliminating the need for the pressure sensing portion.

Also in this embodiment, as illustrated in FIG. 22(*c*), the outer end wall (upper end) 30*p* is so disposed that it lies flush with the lower end of the groove 18*a* or is located at a distance L away from the lower end of the groove 18*a* toward the spray hole 12*b* when the spray hole 12*b* is opened. This causes the groove 18*a* not to be blocked (partially) by the control piston 30 when the spray hole 12*b* is opened, so that the high-pressure fuel which is substantially identical in pressure level with the high-pressure fuel introduced into the pressure control chamber 16*c* to flow into the pressure sensing chamber 18*b* at all times, thereby ensuring the accuracy in measuring the pressure of the high-pressure fuel in the pressure control chamber 16*c* using the pressure sensor 18*f* without any time lag and in finding the time the fuel has been sprayed actually from the spray hole 12*b*.

Also, in this embodiment, the groove 18*a* (i.e., the branch path) is formed in the inner wall of the pressure control chamber 16*c* at a location away from the inner orifice 16*b* and the outer orifice 16*a*, thereby enabling the pressure sensor 18*f* to monitor a change in the pressure in a region where the flow in the pressure control chamber 16*c* is in the steady state. Other operations and effects are the same as those in the tenth embodiment, and explanation thereof in detail will be omitted here.

Also, in this embodiment, instead of the groove 18*a*, the hole 18*a*', as illustrated in FIG. 22(*d*), may alternatively be formed which is so inclined as to extend from the pressure control chamber 16*c* to the pressure sensing chamber 18*b*.

Twelfth Embodiment

Figure 23:
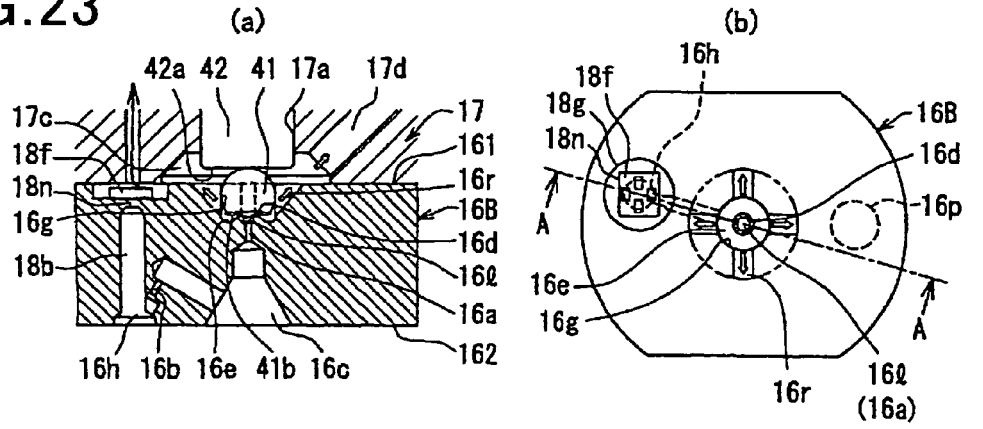
FIG. 23(*a*) is a partial sectional view which shows highlights of an orifice member (pressure sensing member) of an injector for a fuel injection device according to the twelfth embodiment.

The twelfth embodiment of the invention will be described below. FIGS. 23(*a*) and 23(*b*) are a partial sectional view and a plane view which show highlights of a fluid control valve (i.e., the pressure sensing member) of an injector for a fuel injection system in the twelfth embodiment. The same reference numbers are attached to the same or similar parts to those in the sixth to eleventh embodiments, and explanation thereof in detail will be omitted here.

The orifice member 16B of this embodiment is, like the orifice member 16A, designed to have the structure functioning as the pressure sensing portion 80. The lower body 11 has only the orifice member 16B installed therein without having a separate pressure sensing member.

The orifice member 16B of this embodiment is different from the orifice member 16A of the eleventh embodiment in location where the pressure sensing chamber 18*b* is formed. Other arrangements are identical with the orifice member 16A of the eleventh embodiment. The following discussion will refer to only such a difference.

The orifice member 16B of this embodiment is, as can be seen FIGS. 23(*a*) and 23(*b*), designed to have the pressure sensing chamber 18*b* which diverges from a fluid path extending from the inlet 16*h* opening at the flat surface 162 to introduce the fuel thereinto to the pressure control chamber 16*c* through the inner orifice 16*b*. Like this, the pressure control chamber 18*b* may be used as a branch path to introduce the high-pressure fuel thereinto before entering the pressure sensing chamber 18*b* as well as the introduction of the high-pressure fuel into the pressure sensing chamber 18*b* after entering the pressure control chamber 16*c*, like in the eleventh embodiment. In either case, a special tributary needs not be provided as the branch path connecting with the fluid path extending between the inlet 16*h* and the pressure control chamber 16*c* or with the pressure control chamber 16*c*, thereby avoiding an increase in dimension of the injector body in the radial direction, i.e., the diameter thereof. The other operations and effects are the same as those in the eleventh embodiment, and explanation thereof in detail will be omitted here.

In this embodiment, the high-pressure path (the fluid path) through which the high-pressure fuel is directed to the spray hole 12*b* are defined by the fuel induction path 11*c*, the fuel supply path 11*b*, and the fuel feeding path 12*d*. The branch path diverging from the high-pressure path (the fluid path) to introduce the high-pressure fuel to the pressure sensing portion 80 is made up of the fuel supply branch path 11*g*, the sensing portion communication path 18*h*, and the inlet 16*h*. Specifically, the branch path of this embodiment is the path which diverges from the path extending from the fluid induction portion 21 that is an inlet into which the high-pressure fuel enters to the spray hole 12*b* and which directs the fuel to the pressure sensing chamber 18*b*.

The pressure sensing portions 80, 85, 87 of the sixth to tenth embodiments have been described as being forms different from each other, but however, they may be installed in a single injector. Both or either of the orifice members 16A and 16B of the eleventh and twelfth embodiments having the structure functioning as the pressure sensing portion 80 may also be used.

In the above case, as an example, they may be employed redundantly in order to assure the mutual reliability of the pressure sensors 18*f*. As another example, it is possible to use signals from the sensors to control the quantity of fuel to be sprayed finely. Specifically, after the fuel is sprayed, the pressure in the fuel supply path 11*b* drops microscopically from the spray hole 12*b*-side thereof. Subsequently, pulsation caused by such a pressure drop is transmitted to the fluid induction portion 21. Immediately after the spray hole 12*b* is closed, so that the spraying of fuel terminates, the pressure of fuel rises from the spray hole 12*b*-side, so that pulsation arising from such a pressure rise is transmitted toward the fluid induction portion 21. Specifically, it is possible to use a time difference between the changes in pressure on upstream and downstream sides of the fuel induction portion 21 of the fuel supply path 11*b* to control the quantity of fuel to be sprayed finely.

A single injector equipped with a plurality of pressure sensing portions which may be used for the above purposes will be described in the following thirteenth to nineteenth embodiments.

Thirteenth Embodiment

Figure 24:
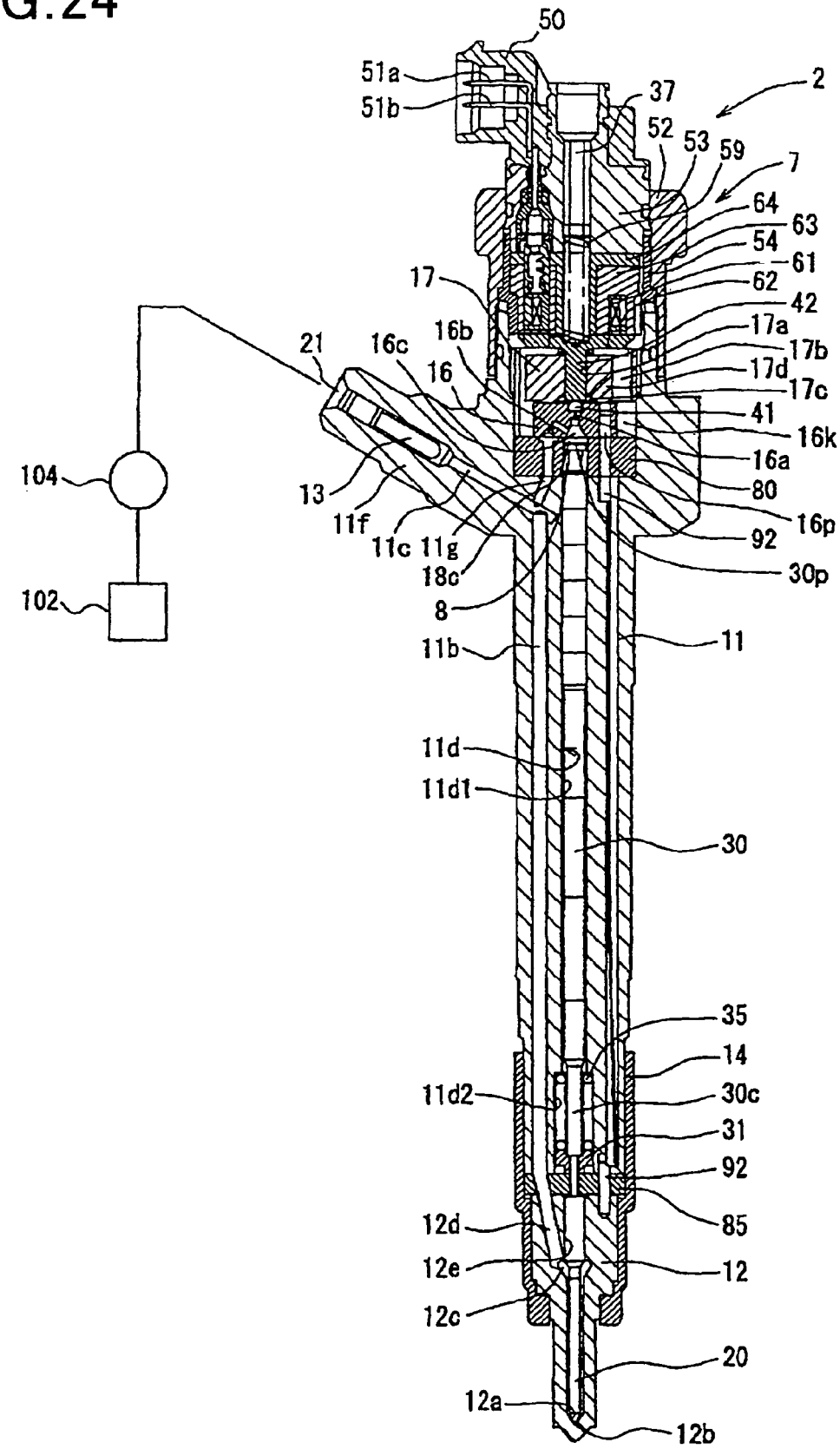
FIG. 24 is a sectional view of an injector according to the thirteenth embodiment.

FIG. 24 is a sectional view which shows the injector 2 in the third embodiment of the invention. The same reference numbers are attached to the same or similar parts to those in the sixth to twelfth embodiments, and explanation thereof in detail will be omitted here.

This embodiment has the pressure sensing portion 80 of the sixth embodiment and the pressure sensing portion 85 of the seventh embodiment. The pressure sensing member 81 equipped with the pressure sensing portion 80 is the same one, as illustrated in FIGS. 9(*c*) and 9(*d*). The pressure sensing member 86 equipped with the pressure sensing portion 85 is the same one, as illustrated in FIGS. 13(*a*) to 13(*c*).

This embodiment is different from the sixth and seventh embodiments in that the terminal pins 51*b* of the connector 50 are implemented by the terminal pins 51*b*1 for the pressure sensing portion 80 and the terminal pins 51*b*2 for the pressure sensing portion 85 (which are not shown) in order to output both signals from the pressure sensing portion 80 and the pressure sensing portion 85.

In this embodiment, the pressure sensing portion 80 is disposed near the fuel induction portion 21. The pressure sensing portion 85 is disposed close to the spray hole 12*b*. The times when pressures of the high-pressure fuel are to be measured by the pressure sensing portions 80 and 85 are, therefore, different from each other, thereby enabling the pressure sensing portions 80 and 85 to output a plurality of signals indicating changes in internal pressure thereof having occurred at different times.

Fourteenth Embodiment

FIG. 25 is a sectional view which shows the injector 2 according to the fourteenth embodiment of the invention. The same reference numbers are attached to the same or similar parts to those in the sixth to thirteenth embodiments, and explanation thereof in detail will be omitted here.

This embodiment has the pressure sensing portion 80 of the sixth embodiment and the pressure sensing portion 87 of the eighth embodiment. The pressure sensing member 81 equipped with the pressure sensing portion 80 is the same one, as illustrated in FIGS. 9(*c*) and 9(*d*). The pressure sensing member 87 is the same one, as illustrated in FIGS. 17 to 19.

Also, in this embodiment, the terminal pins 51*b* of the connector 50 are implemented by the terminal pins 51*b*1 for the pressure sensing portion 80 and the terminal pins 51*b*3 for the pressure sensing portion 87 (which are not shown) in order to output both signals from the pressure sensing portion 80 and the pressure sensing portion 87.

Fifteenth Embodiment

Figure 26:
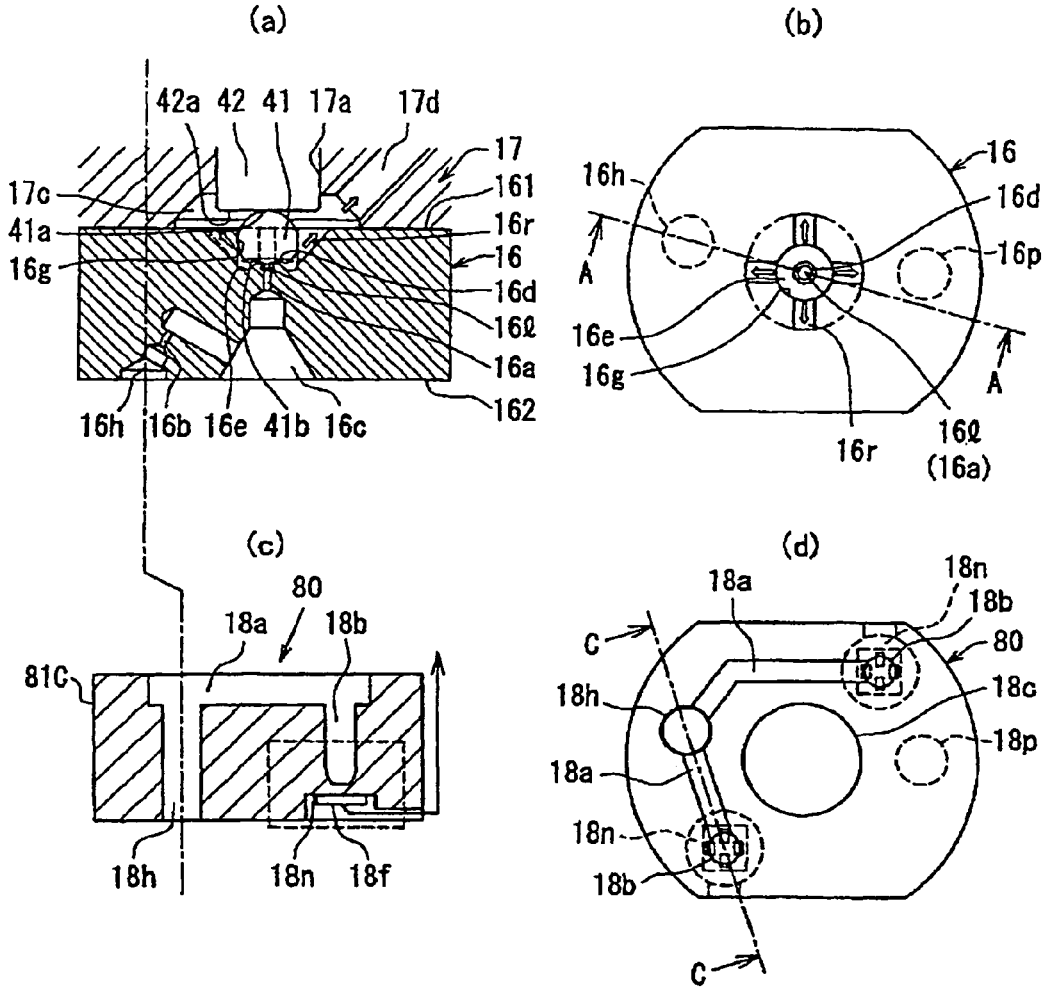
FIG. 26(*a*) is a partial sectional view which shows highlights of an orifice member according to the fifteenth embodiment.

The fifteenth embodiment of the invention will be described below. FIGS. 26(*a*) and 26(*b*) are a partial sectional view and a plane view which show highlights of a fluid control valve in this embodiment. FIGS. 26(*c*) and 26(*d*) are a partial sectional view and a plane view which show highlights of the pressure sensing member 81C. The same reference numbers are attached to the same or similar parts to those in the sixth to fourteenth embodiments, and explanation thereof in detail will be omitted here.

This embodiment is so designed that the pressure sensing member 81 used in the sixth embodiment is, as illustrated in FIGS. 26(*c*) and 26(*d*), equipped with a plurality (two in this embodiment) of pressure sensing portions 80 (i.e., grooves, diaphragms, and pressure sensors) (first and second pressure sensing means). Other arrangements, operations, and effects including those of the orifice member 16 of this embodiment, as illustrated in FIGS. 26(*a*) and 26(*b*), are the same as those in the sixth embodiment.

The pressure sensing member 81C has formed therein two discrete grooves 18*a* (which will be referred to as first and second grooves below) communicating with the sensing portion communication path 18*h*. The first groove 18*a* communicates with the corresponding first pressure sensing chamber 18*b* to transmit its change in pressure to the first pressure sensor 18*f* through the first diaphragm. Similarly, the second groove 18*a* communicates with the corresponding second pressure sensing chambers 18*b* to transmit its change in pressure to the second pressure sensor 18*f* through the second diaphragm.

The two grooves 18*n* are, as illustrated in FIG. 26(*d*), preferably opposed diametrically with respect to the sensing portion communication path 18*h* in order to increase the freedom of design thereof. The two grooves 18*n* are preferably designed to have the same length and depth in order to ensure the uniformity of outputs from the two pressure sensors 18*f*. The grooves 18*a* may alternatively be so formed as to extend on the same side of the sensing portion communication path 18*h*. This permits the wires of the pressure sensors 18*f* to extend from the same side surface of the pressure sensing member 81 and facilitates the layout of the wires.

Sixteenth Embodiment

Figure 27:
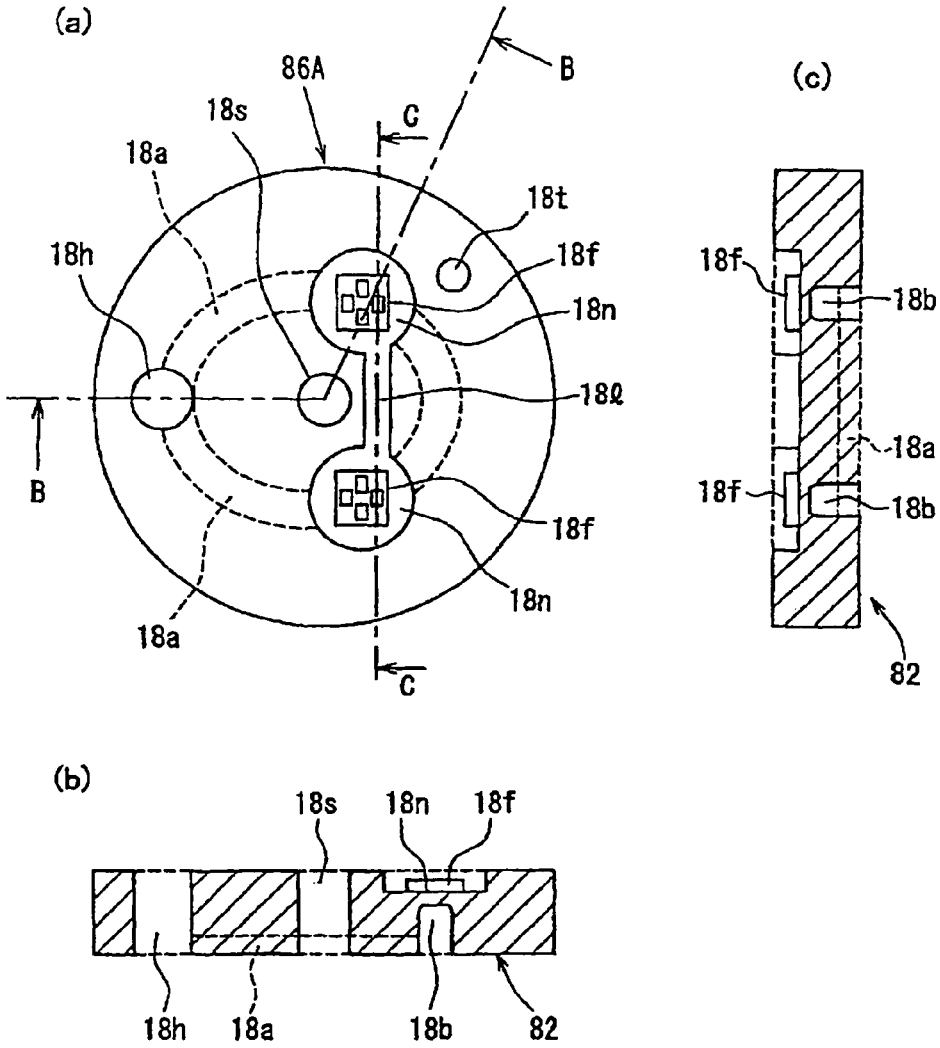
FIG. 27(*a*) a partial sectional view which shows highlights of a pressure sensing member according to the sixteenth embodiment.

The sixteenth embodiment of the invention will be described below. FIGS. 27(*a*) to 27(*c*) are a plan view and partial sectional views which show highlights of the pressure sensing member 86A of this embodiment. The same reference numbers are attached to the same or similar parts to those in the sixth to fifteenth embodiments, and explanation thereof in detail will be omitted here.

The sixteenth embodiment is so designed that the pressure sensing member 86 used in the seventh embodiment is, as illustrated in FIGS. 27(*a*) to 27(*c*), equipped with a plurality (two in this embodiment) of pressure sensing portions 85 (i.e., grooves, diaphragms, and pressure sensors) (first and second pressure sensing means). Other arrangements, operations, and effects including those of the orifice member 16 of this embodiment are the same as those in the seventh embodiment.

The pressure sensing member 86A has formed therein two discrete grooves 18*a* (which will be referred to as first and second grooves below) communicating with the sensing portion communication path 18*h*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are, as illustrated in FIG. 27(*a*), preferably opposed diametrically with respect to the sensing portion communication path 18*h* in order to increase the freedom of design thereof. The two grooves 18*n* are, like in the fifteenth embodiment, preferably designed to have the same length and depth in order to ensure the uniformity of outputs from the two pressure sensors 18*f*.

The two chambers of the pressure sensing member 86A on the side where the pressure sensors 18*f* are disposed are connected to each other through the connecting groove 18*l*. This facilitates the ease of layout of electric wires from the pressure sensors 18*f* through the connecting groove 18*l*.

Seventeenth Embodiment

Figure 28:
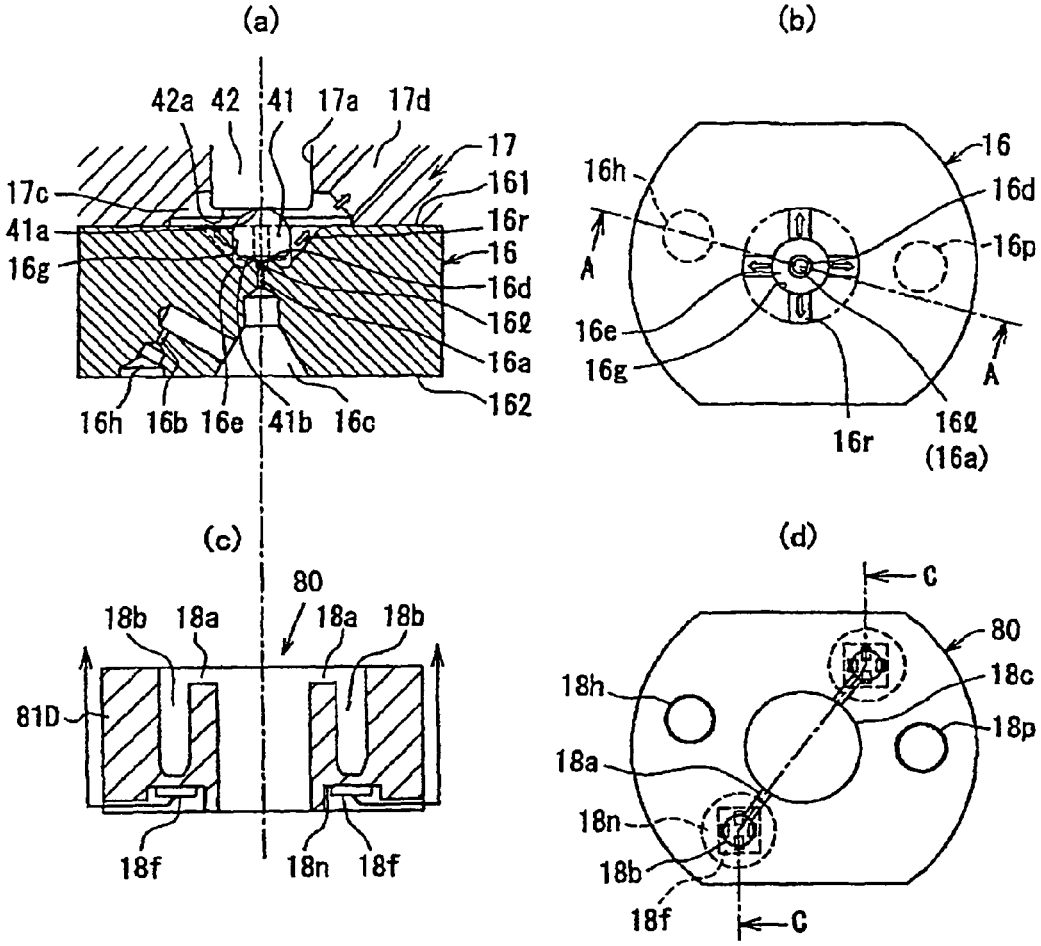
FIG. 28(*a*) is a partial sectional view which shows highlights of an orifice member according to the seventeenth embodiment.

The seventeenth embodiment of the invention will be described below. FIGS. 28(*a*) and 28(*b*) are a partial sectional view and a plan view which show highlights of a fluid control valve of this embodiment. FIGS. 28(*c*) and 28(*d*) are a partial sectional view and a plan view which show highlights of the pressure sensing member 81D. The same reference numbers are attached to the same or similar parts to those in the sixth to sixteenth embodiments, and explanation thereof in detail will be omitted here.

The seventeenth embodiment is so designed that the pressure sensing member 81A used in the ninth embodiment is, as illustrated in FIGS. 28(*c*) and 28(*d*), equipped with a plurality (two in this embodiment) of pressure sensing portions 80 (i.e., grooves, diaphragms, and pressure sensors) (first and second pressure sensing means). Other arrangements, operations, and effects including those of the orifice member 16 of this embodiment are the same as those in the ninth embodiment.

The pressure sensing member 81D has formed therein two discrete grooves 18*a* (which will be referred to as first and second grooves below) communicating with the pressure control chamber 18*c*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are preferably opposed diametrically with respect to the pressure control chamber 18*c* order to increase the freedom of design thereof.

The grooves 18*a* may alternatively be so formed as to extend on the same side of the pressure control chamber 18*c* (not shown). This permits the wires of the pressure sensors 18*f* to extend from the same side surface of the pressure sensing member 81D and facilitates the layout of the wires.

In this embodiment, the grooves 18*a* define paths along with the flat surface 162 of the orifice member 16, but however, the pressure sensing member 81D may be turned upside down. In this case, paths are defined between the grooves 18*a* and the flat surface (not shown) of the lower body 11. The first and second pressure sensors 18*f* are disposed on the orifice member 16-side.

Eighteenth Embodiment

Figure 29:
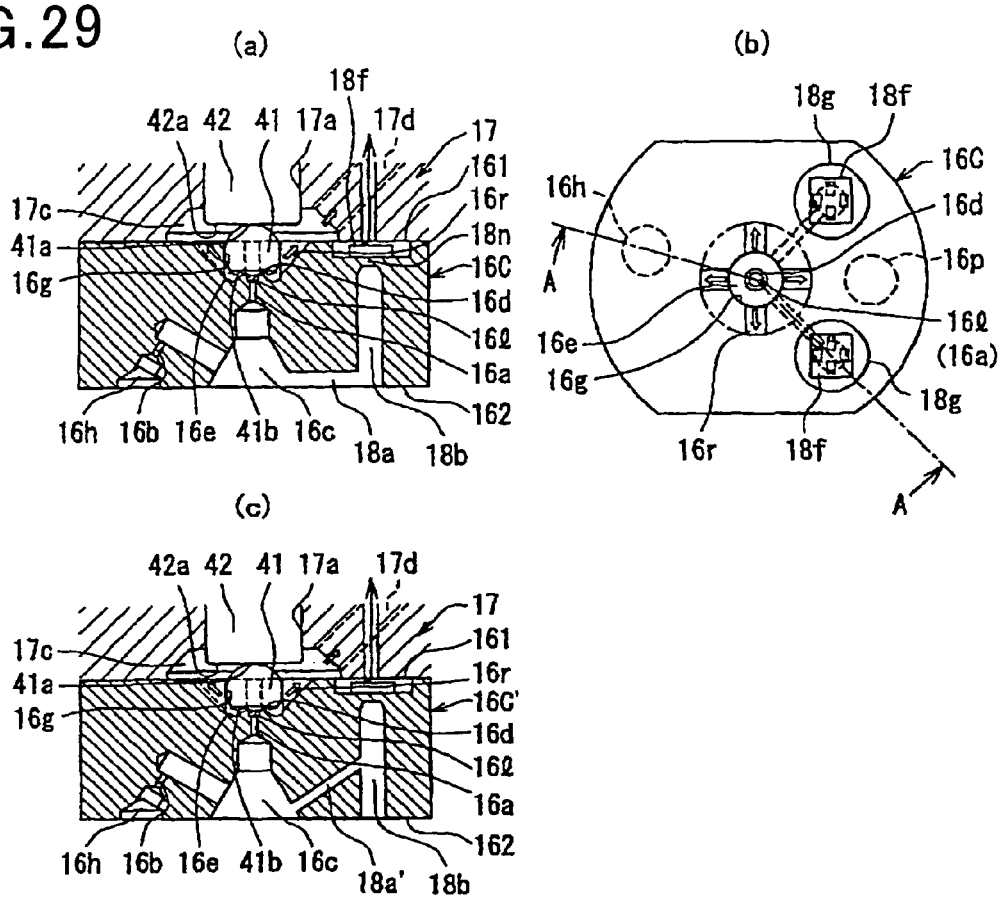
FIG. 29(*a*) is a partially sectional view which shows highlights of an orifice member (pressure sensing member) according to the eighteenth embodiment.

The eighteenth embodiment of the invention will be described below. FIGS. 29(*a*) and 29(*b*) are a partial sectional view and a plan view which show highlights of a fluid control valve (i.e., an orifice member) 16C of this embodiment. The same reference numbers are attached to the same or similar parts to those in the sixth to seventeenth embodiments, and explanation thereof in detail will be omitted here.

The eighteenth embodiment is so designed that the orifice member 16A having the structure of the pressure sensing portion 80 used in the eleventh embodiment is, as illustrated in FIGS. 29(*a*) and 29(*b*), equipped with a plurality (two in this embodiment) of pressure sensing portions 80 (i.e., grooves, diaphragms, and pressure sensors) (first and second pressure sensing means). Other arrangements, operations, and effects are the same as those in the eleventh embodiment.

The orifice member 16C has formed therein two discrete grooves 18*a* (which will be referred to as first and second grooves below) communicating with the pressure control chamber 16*c*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are, as illustrated in FIG. 29(*b*), preferably opposed diametrically with respect to the pressure control chamber 16*c* order to increase the freedom of design thereof.

The grooves 18*a* may alternatively be so formed as to extend on the same side of the pressure control chamber 16*c* (not shown). This permits the wires of the pressure sensors to extend from the same side surface of the orifice member 16C and facilitates the layout of the wires.

Also in this embodiment, instead of the groove 18*a*, a hole 18', as illustrated in FIG. 29(*c*), may be formed which is so inclined as to extend from the pressure control chamber 16*c* to the pressure sensing chamber 18*b*.

Nineteenth Embodiment

Figure 30:
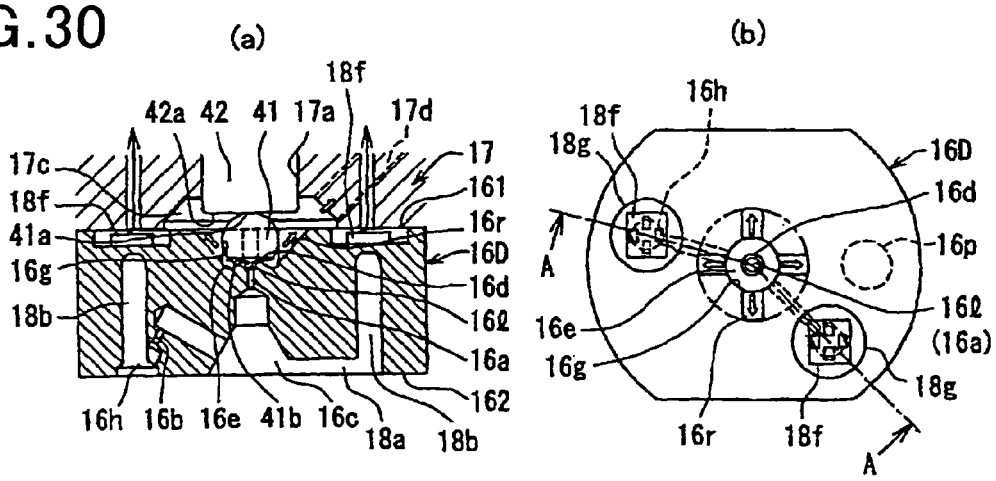
FIG. 30(*a*) is a partial sectional view which shows highlights of an orifice member (pressure sensing member) according to the nineteenth embodiment.

The nineteenth embodiment of the invention will be described below. FIGS. 30(*a*) and 30(*b*) are a partial sectional view and a plan view which show highlights of a fluid control valve (i.e., an orifice member) 16D of this embodiment. The same reference numbers are attached to the same or similar parts to those in the sixth to eighteenth embodiments, and explanation thereof in detail will be omitted here.

The nineteenth embodiment is so designed as to have both the pressure sensing portions of the eleventh and twelfth embodiments. Specifically, the orifice member 16D of this embodiment has formed therein the first pressure sensing chamber 18*b* communicating with the pressure control chamber 16*c* through the groove 18*a* and the second pressure sensing chamber 18*b* diverging from a fluid path extending from the inlet 16*h* to which the fuel is inputted to the pressure control chamber 16*c* through the inner orifice 16*b*. The first and second diaphragms 18*n* and the first and second pressure sensors 18*f* are disposed at locations corresponding to the first and second pressure sensing chambers 18*b*.

This embodiment has disposed between the first and second pressure sensing chambers 18*b* the inner orifice 16*b* which is smaller in diameter than the branch path, thereby causing times when the pressure changes in the first and second pressure sensing chambers 18*b* to be shifted from each other. Other arrangements, operations, and effects are the same as those in the eleventh and twelfth embodiments.

Other Embodiments

Each of the above embodiments may be modified as follows. The invention is not limited to the contents of the embodiments. The features of the structures of the embodiments may be combined in various ways.

In the first embodiment, as illustrated in FIG. 2, when the branch path 6*ez* is bifurcated from the intersection 6*dz* of the two high-pressure paths 6*bz* and 6*cz* (i.e., first and second paths) extending substantially perpendicular to each other, the branch path 6*ez* is oriented coaxially with the high-pressure path that is the first path. Specifically, the branch path 6*ez* is oriented in the direction of the axial line J2*z* of the injector body 4*z*. The branch path 6*ez* may alternatively be, as indicated by two-dot chain line 62*ez* in FIG. 2, oriented coaxially with the high-pressure path 6*bz* that is the second path, that is, perpendicular to the axial line J2*z* of the body 4*z*.

In the first embodiment, as illustrated in FIG. 2, the branch path 6*ez* is bifurcated from the intersection 6*dz* of the two high-pressure paths 6*bz* and 6*cz*, but may be bifurcated, as indicated by the two-dot chain line 60*ez* in FIG. 2, from a portion other than the intersection 6*dz*.

The injector body 4*z* and the stem 51*z* are metal-touch sealed, but the metal tough sealing structure may be omitted. A gasket may be disposed between the body 4*z* and the stem 51*z* to seal therebetween.

In the first to fifth embodiments, the sensor terminals 55*z* and the drive terminals 56*z* are unified by the molded resin 60*z*, but however, they may alternatively be retained by separate resin molds. In this case, it is advisable that the two resin molds be retained in the connector housing 70*z* in order to minimize required connectors.

In the first to fifth embodiments, the strain gauge 52*z* is used to measure the amount of strain of the stem 51*z*, but another type sensing device such as a piezoelectric device may be used.

In the first to fifth embodiments, the insulating substrate 53*z* on which the circuit component parts 54*z* are fabricated is placed flush with the stain gauge 52*z*, but they may be laid overlap each other in the axial direction J1*z*.

As to the location of installation of the fuel pressure sensor 50*z* in the injector body 4*z* in the first to fifth embodiments, the fuel pressure sensor 50*z* is disposed in a portion of the body 4*z* which is located above the insertion hole E3*z* of the cylinder head E2*z*, but may be disposed inside the insertion hole E3*z* of the cylinder head E2*z*.

In the first to fifth embodiments, the molded resin 60*z* functions as a thermal insulator for the circuit parts 54*z* against the heat from the injector body 4*z* and the stern 51*z*, but instead rubber or ceramic may alternatively be used as the thermal insulator. A foamed resin having many cells formed therein may also be used to enhance the thermal insulation.

In each of the above embodiments, the invention is used with the injector for diesel engines, but may be used with direct injection gasoline engines which inject the fuel directly into the combustion chamber E1.

For example, in the sixth and the seventh embodiments, the invention is used with the solenoid-operated injector, but the injector equipped with the piezo-actuator may use either or both the pressure sensing portion 80 of the sixth embodiment and the pressure sensing member 85 of the seventh embodiment, Conversely, the structure in which the pressure sensing portion 87 is installed in the coupling 11*f* may be used with the solenoid-operated injector.

As already described in the thirteenth to nineteenth embodiments, in the case where the pressure sensing portions 80, 85, and 87 are used simultaneously, the first pressure sensing portion may be designed to produce an output signal whose level changes with a change in pressure of the high-pressure fuel more greatly than that of the second pressure portion. This causes two types of output signals to be produced which are different in sensitivity. Such a structure is useful, especially for the case where the first and second pressure sensing portions, like in the fourteenth to eighteenth embodiments, work to measure the substantially same pressure.

Specifically, the first diaphragm constituting the first pressure sensing portion is designed to be of a circular shape greater in diameter than the second diaphragm constituting the second pressure sensing portion. This results in a difference in sensitivity between the first and second pressure sensing portions. Alternatively, the first diaphragm constituting the first pressure sensing portion may be designed to be of a circular shape smaller in thickness than the second diaphragm constituting the second pressure sensing portion. This also results in a difference in sensitivity between the first and second pressure sensing portions.

In the sixth to nineteenth embodiments, the pressure sensor 18*f* is installed on the pressure sensing member 81 which is formed to be separate from the injector body the lower body 11 and the valve body 17), but may alternatively be disposed directly on the injector body.

The invention claimed is:

1. A fuel injection valve which is to be installed in an internal combustion engine to spray fuel from a spray hole, comprising:

a body in which a high-pressure path is formed through which high-pressure fuel flows to said spray hole and has disposed therein an electrically-driven opening/closing mechanism for opening or closing said spray hole; and a fuel pressure sensor installed in said body to measure a dynamic pressure of said high-pressure fuel which is changed by spraying of the fuel from the spray hole, and wherein a branch path is formed in said body which diverges from said high-pressure path to deliver said high-pressure fuel, which is changed in pressure dynamically by the spraying of the fuel from the spray hole, to said fuel pressure sensor at all times while the fuel is being sprayed, and wherein said opening/closing mechanism is controlled based on an output of the fuel pressure sensor.

2. A fuel injection valve as set forth in claim 1, characterized in that said high-pressure path has a large-diameter portion in which a sectional area of the high-pressure path is expanded, and said branch path is bifurcated from said large-diameter portion.

3. A fuel injection valve as set forth in claim 1, characterized in that said high-pressure path has a large-diameter portion in which a sectional area of the high-pressure path is expanded, and said branch path is bifurcated from a small-diameter portion of said high-pressure path other than said large-diameter portion.

4. A fuel injection valve as set forth in claim 2, characterized in that a filter is disposed in said large-diameter portion to trap a foreign object in the high-pressure fuel.

5. A fuel injection valve as set forth in claim 1, characterized in that said high-pressure path includes a first path extending in an axial direction of said body and a second path extending in a direction in which the second path intersects with the first path, and in that said branch path diverges from an intersection of the first and second paths and extends coaxially with either of the first path or the second path.

6. A fuel injection valve as set forth in claim 1, characterized in that said branch path is so formed that an axial direction of said branch path extends perpendicular to that of said high-pressure path.

7. A fuel injection valve as set forth in claim 1, characterized in that said branch path is so formed that an axial direction thereof is inclined radially of said high-pressure path.

8. A fuel injection valve as set forth in claim 7, wherein an acute-angle one of portions of said body where said branch path intersects with said high-pressure path is chamfered.

9. A fuel injection device comprising:

a fuel path to which high-pressure fuel is supplied externally;

a spray hole which connects with said fuel path and sprays at least a portion of the high-pressure fuel;

a branch path which connects with said path at a turned angle of 90° or more to a flow of the fuel in said fuel path;

a diaphragm which is made of a thin wall in said branch path and which is exposed to the high-pressure fuel at all times while the high-pressure fuel is being sprayed, and strains and displaces when subjected to a dynamic pressure of said high-pressure fuel which is changed by spraying of the fuel from the spray hole; and displacement sensing means for converting a displacement of said diaphragm into an electric signal.

10. A fuel injection device as set forth in claim 9, characterized in that said diaphragm is a thinnest walled portion of the branch path.

11. A fuel injection device as set forth in claim 9, characterized in that said displacement sensing means has a semiconductor pressure sensor affixed integrally with one of surfaces of said diaphragm which is farther from said branch path.

* * * * *